US009095875B2

(12) United States Patent
Kitazono et al.

(10) Patent No.: US 9,095,875 B2
(45) Date of Patent: Aug. 4, 2015

(54) METHOD FOR FORMING MULTI-LAYERED COATING FILM

(75) Inventors: Kazuaki Kitazono, Hiratsuka (JP); Hiroshi Kitagawa, Hiratsuka (JP)

(73) Assignee: KANSAI PAINT CO., LTD., Hyogo (JP)

( * ) Notice: Subject to any disclaimer, the term of this patent is extended or adjusted under 35 U.S.C. 154(b) by 30 days.

(21) Appl. No.: 14/004,500

(22) PCT Filed: Apr. 5, 2012

(86) PCT No.: PCT/JP2012/059340

§ 371 (c)(1), (2), (4) Date: Sep. 11, 2013

(87) PCT Pub. No.: WO2012/137864

PCT Pub. Date: Oct. 11, 2012

(65) Prior Publication Data

US 2014/0004365 A1 Jan. 2, 2014

(30) Foreign Application Priority Data

Apr. 6, 2011 (JP) ..... 2011-084805

(51) Int. Cl.
*B05D 5/06* (2006.01)
*B05D 7/00* (2006.01)

(52) U.S. Cl.
CPC ..... *B05D 5/066* (2013.01); *B05D 7/572* (2013.01); *B05D 2401/20* (2013.01); *B05D 2420/01* (2013.01); *B05D 2420/02* (2013.01); *B05D 2507/00* (2013.01); *B05D 2508/00* (2013.01); *Y10T 428/31797* (2015.04)

(58) Field of Classification Search
None
See application file for complete search history.

(56) References Cited

U.S. PATENT DOCUMENTS

| | | | | |
|---|---|---|---|---|
| 2004/0228975 | A1 | 11/2004 | Takesako et al. | |
| 2006/0121204 | A1 | 6/2006 | Nakae et al. | |
| 2009/0186228 | A1 | 7/2009 | Kakii et al. | |
| 2010/0129659 | A1 | 5/2010 | Nemoto et al. | |
| 2011/0135935 | A1* | 6/2011 | Adachi et al. | 428/422.8 |
| 2011/0300389 | A1* | 12/2011 | Kitagawa et al. | 428/423.1 |
| 2012/0021228 | A1* | 1/2012 | Kitagawa et al. | 428/423.1 |
| 2013/0089731 | A1* | 4/2013 | Imanaka et al. | 428/336 |
| 2014/0030528 | A1* | 1/2014 | Kitagawa et al. | 428/407 |

FOREIGN PATENT DOCUMENTS

| | | |
|---|---|---|
| CN | 101733243 | 6/2010 |
| JP | 2002-38098 | 2/2002 |
| JP | 2003/334487 | 11/2003 |
| JP | 2004-358462 | 12/2004 |
| JP | 2009-154050 | 7/2009 |
| JP | 2011-225802 | 11/2011 |
| JP | 2012-57012 | 3/2012 |
| WO | 2005/075587 | 8/2005 |
| WO | 2009/157588 | 12/2009 |
| WO | 2011/052304 | 5/2011 |

OTHER PUBLICATIONS

International Search Report issued May 22, 2012 in International (PCT) Application No. PCT/JP2012/059340.

* cited by examiner

*Primary Examiner* — Erma Cameron
(74) *Attorney, Agent, or Firm* — Wenderoth, Lind & Ponack, L.L.P.

(57) ABSTRACT

The present invention provides a method for forming a multilayer coating film, the method comprising (1) coating on a substrate an aqueous first colored coating composition containing a pigment and a hydroxy-containing polyester resin-containing film-forming resin having an acid value of 30 mg KOH/g or less; (2) coating an aqueous second colored coating composition containing a film-forming resin and a copolymer obtained by copolymerization of monomer components containing a polymerizable unsaturated monomer having a hydrophilic group, and a macromonomer having a polymerizable unsaturated group and a backbone having a number average molecular weight of 1,000 to 10,000, obtained by polymerization of a monomer component having 5 to 100 mass % of a polymerizable unsaturated monomer having a $C_{4-24}$ alkyl group; (3) coating a clear coating composition; and (4) simultaneously curing the three coating films formed in steps (1) to (3).

9 Claims, No Drawings

METHOD FOR FORMING MULTI-LAYERED COATING FILM

CROSS REFERENCE OF RELATED APPLICATION

This application claims priority to JP2011-84805A, filed Apr. 6, 2011, the disclosure of which is incorporated herein by reference in its entirety.

TECHNICAL FIELD

The present invention relates to a method capable of forming a multilayer coating film having excellent smoothness, distinctness of image (DOI), flip-flop property, and water resistance, as well as suppressed metallic mottling, by a 3-coat 1-bake process. The present invention also relates to articles coated by using this method.

BACKGROUND ART

Until now, a method for forming a multilayer coating film by using a 3-coat 2-bake (3C2B) process has been widely used as a method for forming a coating film on automobile bodies. This method sequentially comprises applying an electrodeposition coating composition to a substrate, and performing heat-curing, followed by application of an intermediate coating composition, curing by baking, application of a base coating composition, preheating (preliminary heating), application of a clear coating composition, and curing by baking.

However, in recent years, for the purpose of saving energy, consideration has been given to omitting the bake-curing step that is performed after application of an intermediate coating composition, and to using a 3-coat 1-bake (3C1B) process sequentially comprising the following steps: application of an intermediate coating composition, preheating (preliminary heating), application of a base coating composition, preheating (preliminary heating), application of a clear coating composition, and curing by baking. From the viewpoint of reducing environmental pollution caused by the vaporization of organic solvents, the establishment of a 3-coat 1-bake process using aqueous coating compositions as the intermediate coating composition and the base coating composition is particularly desired.

However, in the 3-coat 1-bake process described above, which uses an aqueous intermediate coating composition and an aqueous base coating composition, a resulting coating film is likely to have insufficient smoothness and distinctness of image due to the formation of a mixed layer from the aqueous intermediate coating composition and the aqueous base coating composition.

In order to solve these problems, Patent Literature (PTL) 1 discloses a method for forming a multilayer coating film, the method comprising (1) providing a target substrate on which an electrodeposition coating film is formed; (2) applying an aqueous intermediate coating composition to the electrodeposition coating film to form an intermediate coating film; (3) sequentially applying an aqueous base coating composition and a clear coating composition to the intermediate coating film by a wet-on-wet process without curing the intermediate coating film to form a base coating film and a clear coating film; and (4) simultaneously curing by baking the intermediate coating film, base coating film, and clear coating film. In relation to such a method, Patent Literature 1 discloses that when the aqueous intermediate coating composition contains a specific acrylic resin emulsion and urethane resin emulsion, and also when the intermediate coating film formed from the aqueous intermediate coating composition has a specific water absorption rate and water elution rate, the formation of a mixed layer from the intermediate coating composition and base coating composition is effectively prevented, and that a multilayer coating film having excellent surface smoothness can thereby be formed.

Patent Literature (PTL) 2 discloses a method for forming a coating film, the method comprising a step of sequentially applying an intermediate coating composition, a base coating composition, and a clear coating composition to an electrodeposition-coated material; and a step of simultaneously curing by baking the three layers formed in the above step. The base coating composition of PTL 2 has a feature in that it has a viscosity at 60° C. (V is (60° C.)) of 10 to 1,000 poise, a viscosity at 90° C. (V is (90° C.)) of 1 to 500 poise, and a viscosity at 120° C. (V is (120° C.)) of 100 to 10,000 poise, and a V is (60° C.)/V is (90° C.) of 1.5 to 10 and a V is (120° C.)/V is (90° C.) of 2 to 20, when the nonvolatile content of the base coating composition is 90 wt %. PTL 2 further discloses that the nonaqueous dispersion contained in this base coating composition functions as a viscosity-imparting agent and prevents blur or inversion from occurring between the layers, and that a coating film excellent in appearance with high distinctness of image and gloss can thus be formed.

CITATION LIST

Patent Literature

PTL 1: JP2004-358462A
PTL 2: JP2002-38098A

SUMMARY OF INVENTION

Technical Problem

However, the multilayer coating film obtained by using the method for forming a multilayer coating film of PTL 1 occasionally had insufficient smoothness and distinctness of image.

Further, applying the method for forming a coating film of PTL 2 to a 3-coat 1-bake process using an aqueous coating composition was difficult because the method for forming a coating film of PTL 2 uses a nonaqueous dispersion as a viscosity-controlling agent.

The present invention has been made in view of these points. An object of the present invention is to provide a method capable of forming a multilayer coating film having excellent smoothness, distinctness of image, flip-flop property, and water resistance, as well as suppressed metallic mottling, by using a 3-coat 1-bake process using an aqueous first colored coating composition, an aqueous second colored coating composition, and a clear coating composition. Another object of the present invention is to provide an article coated by this method for forming a multilayer coating film.

Solution to Problem

As a result of extensive research to achieve the above object, the present inventors found that a method for forming a multilayer coating film by using a 3-coat 1-bake process comprising sequentially applying an aqueous first colored coating composition, an aqueous second colored coating composition, and a clear coating composition to a substrate can form a multilayer coating film having excellent smoothness, distinctness of image, flip-flop property, and water resistance, as well as suppressed metallic mottling, when the aqueous first colored coating composition contains a pigment and a hydroxy-containing polyester resin having a specific acid value, and when the aqueous second colored coating composition contains a specific copolymer and film-forming resin. The present invention is thereby completed.

More specifically, the present invention provides the following method for forming a multilayer coating film. The present invention also provides an article coated by this method for forming a multilayer coating film.

1. A method for forming a multilayer coating film by sequentially performing the following steps (1) to (4):

(1) applying an aqueous first colored coating composition (X) comprising a film-forming resin (A) and a pigment (B) to a substrate to form an uncured first colored coating film, the film-forming resin (A) comprising a hydroxy-containing polyester resin (A1), the hydroxy-containing polyester resin (A1) having an acid value of 30 mg KOH/g or less;

(2) applying an aqueous second colored coating composition (Y) comprising a film-forming resin (C) and a copolymer (D) to the uncured colored coating film obtained in step (1) to form an uncured second colored coating film, the copolymer (D) being obtainable by copolymerizing monomer component (d) comprising a macromonomer (d1) and a polymerizable unsaturated monomer (d2), the macromonomer (d1) having a polymerizable unsaturated group and a backbone that comprises a polymer chain having a number average molecular weight of 1,000 to 10,000, the macromonomer (d1) being obtainable by polymerizing monomer component (m) comprising 5 to 100 mass % of a polymerizable unsaturated monomer (m1), the polymerizable unsaturated monomer (m1) containing a $C_{4-24}$ alkyl group the polymerizable unsaturated monomer (d2) having a hydrophilic group;

(3) applying a clear coating composition (Z) to the uncured second colored coating film obtained in step (2) to form an uncured clear coating film; and (4) heating the uncured first colored coating film, the uncured second colored coating film, and the uncured clear coating film formed respectively in steps (1) to (3) to simultaneously cure these three coating films.

2. The method for forming a multilayer coating film according to Item 1, wherein the aqueous first colored coating composition (X) comprises a water-dispersible hydroxy-containing acrylic resin (A2) having an acid value of 30 mg KOH/g or less as the film-forming resin (A).

3. The method for forming a multilayer coating film according to Item 1 or 2, wherein the aqueous first colored coating composition (X) further comprises a hydroxy-containing polyurethane resin (A3) as the film-forming resin (A).

4. The method for forming a multilayer coating film according to any one of Items 1 to 3, wherein the film-forming resin (C) is a water-dispersible hydroxy-containing acrylic resin (C1) having an acid value of 1 to 100 mg KOH/g and a hydroxy value of 1 to 100 mg KOH/g, the film-forming resin (C) being obtainable by copolymerization of monomer component (c1) comprising 5 to 70 mass % of a hydrophobic polymerizable unsaturated monomer (c1-1), 0.1 to 25 mass % of a hydroxy-containing polymerizable unsaturated monomer (c1-2), 0.1 to 20 mass % of a carboxy-containing polymerizable unsaturated monomer (c1-3), and 0 to 94.8 mass % of a polymerizable unsaturated monomer (c1-4) other than the polymerizable unsaturated monomers (c1-1) to (c1-3).

5. The method for forming a multilayer coating film according to any one of Items 1 to 4, wherein the water-dispersible hydroxy-containing acrylic resin (C1) is a core-shell-type water-dispersible hydroxy-containing acrylic resin (C1'), which has a core-shell structure having, as a core portion, a copolymer (C1'-I) produced with monomer components comprising 0.1 to 30 mass % of a polymerizable unsaturated monomer having two or more polymerizable unsaturated groups per molecule and 70 to 99.9 mass % of a polymerizable unsaturated monomer having one polymerizable unsaturated group per molecule, based on the total mass of the monomer components constituting the core portion, and wherein the core-shell-type water-dispersible hydroxy-containing acrylic resin (C1') is produced with monomer components comprising 5 to 70 mass % of a hydrophobic polymerizable unsaturated monomer (c1-1), 0.1 to 25 mass % of a hydroxy-containing polymerizable unsaturated monomer (c1-2), 0.1 to 20 mass % of a carboxy-containing polymerizable unsaturated monomer (c1-3), and 0 to 94.8 mass % of a polymerizable unsaturated monomer (c1-4) other than the polymerizable unsaturated monomers (c1-1) to (c1-3), based on the total mass of the monomer components constituting the core and shell portions.

6. The method for forming a multilayer coating film according to any one of Items 1 to 5, wherein the monomer component (m) comprises, at least as a part thereof, 5 to 60 mass % of a hydroxy-containing polymerizable unsaturated monomer (m2), based on the total mass of the monomer component (m).

7. The method for forming a multilayer coating film according to any one of Items 1 to 6, wherein component (d2) is at least one polymerizable unsaturated monomer selected from the group consisting of N-substituted (meth)acrylamide, polymerizable unsaturated monomer having a polyoxyalkylene chain, N-vinyl-2-pyrrolidone, 2-hydroxyethyl acrylate, acrylic acid, and methacrylic acid.

8. The method for forming a multilayer coating film according to any one of Items 1 to 7, wherein the monomer component (d) comprises 1 to 40 mass % of component (d1) and 5 to 99 mass % of component (d2), based on the total mass of the monomer component (d).

9. An article having a coating film formed by the method for forming a multilayer coating film according to any one of Items 1 to 8.

Advantageous Effects of Invention

The method for forming a multilayer coating film of the present invention can form a multilayer coating film having an excellent smoothness and DOI by using a 3-coat 1-bake coating process using an aqueous first colored coating composition, an aqueous second colored coating composition, and a clear coating composition, when the aqueous first colored coating composition contains a pigment and a hydroxy-containing polyester resin having the aforementioned specific acid value, and when the aqueous second colored coating composition contains a specific copolymer and film-forming resin.

DESCRIPTION OF EMBODIMENTS

Hereinafter, the method for forming a multilayer coating film of the present invention is described in further detail.

Step (1)

In step (1) of the method for forming a multilayer coating film of the present invention, an aqueous first colored coating composition (X) is applied to a substrate.

The substrate is not particularly limited. Examples of substrates include exterior panel parts of automobile bodies such as passenger cars, trucks, motorcycles, and buses; automotive components; and exterior panel parts of household electric appliances such as cellular phones and audio equipment. Of these substrates, exterior panel parts of automobile bodies and automotive components are preferable.

The material for the substrate is not particularly limited. Examples of the material include iron, aluminum, brass, copper, stainless steel, tin, galvanized steel, steel plated with zinc alloys (Zn—Al, Zn—Ni, Zn—Fe, etc.), and like metal materials; polyethylene resins, polypropylene resins, acrylonitrile-butadiene-styrene (ABS) resins, polyamide resins, acrylic resins, vinylidene chloride resins, polycarbonate resins, polyurethane resins, epoxy resins, and like resins, and various types of fiber-reinforced plastics (FRP), and like plastic materials; glass, cement, concrete, and like inorganic materials; wood; and textile materials such as paper and cloth. Of these materials, metal materials and plastic materials are preferable.

The substrate may be a metal material mentioned above, or a vehicle body, etc., formed from such a metal material, having a metal surface treated with phosphate, chromate, or composite oxide, and optionally further having a coating film on the treated surface.

Examples of a substrate having a coating film include a base material in which the surface is optionally treated, and an undercoating film is formed thereon; and a base material in which the surface is optionally treated, an undercoating film is formed thereon, and an intermediate coating film is further formed thereon. In particular, vehicle bodies having an undercoating film formed thereon using an electrodeposition coating composition are preferable, and vehicle bodies having an undercoating film formed thereon using a cationic electrodeposition coating composition are more preferable.

Aqueous First Colored Coating Composition (X)

As the aqueous first colored coating composition (X) that is applied to a substrate mentioned above, it is possible to use a coating composition containing a film-forming resin (A) and a pigment (B), and optionally containing a curing agent, an additive for coating compositions, and the like. Specifically, the aqueous first colored coating composition contains the components (A) and (B) as essential components, and may optionally further contain a curing agent, additive for coating compositions, and the like.

Film-Forming Resin (A)

A film-forming resin (A) has a feature in that it comprises, as at least a part thereof, a hydroxy-containing polyester resin (A1) having an acid value of 30 mg KOH/g or less.

Film-forming resins other than the above can also be used as the film-forming resin (A). Film-forming resins other than the above may be those that are known per se and that have been used as a film-forming resin for coating compositions. Non-crosslinked type resin and crosslinked type resin both can be used.

Hydroxy-Containing Polyester Resin (A1)

Water-soluble or water-dispersible hydroxy-containing polyester resins that are known per se and that have been used for aqueous coating compositions can be used as a hydroxy-containing polyester resin (A1). The hydroxy-containing polyester resin (A1) may optionally contain a crosslinkable functional group such as a carboxy or epoxy group, in addition to a hydroxy group.

The hydroxy-containing polyester resin (A1) can generally be produced by an esterification or transesterification reaction of an acid component with an alcohol component.

The acid component may be a compound that is generally used as an acid component for producing a polyester resin. Examples of such acid components include aliphatic polybasic acids, alicyclic polybasic acids, aromatic polybasic acids, etc. Of these acid components, aliphatic polybasic acids, alicyclic polybasic acids, or combinations of aliphatic polybasic acids and alicyclic polybasic acids are preferable.

Generally, aliphatic polybasic acids include aliphatic compounds having at least two carboxy groups per molecule, anhydrides of such aliphatic compounds, and esters of such aliphatic compounds. Examples of aliphatic polybasic acids include succinic acid, glutaric acid, adipic acid, pimelic acid, suberic acid, azelaic acid, sebacic acid, undecanedioic acid, dodecanedioic acid, brassylic acid, hexadecanedioic acid, octadecanedioic acid, citric acid, and like aliphatic polycarboxylic acids; anhydrides of such aliphatic polycarboxylic acids; and esters of such aliphatic polycarboxylic acids with lower alkyls having about 1 to 4 carbon atoms. Such aliphatic polybasic acids can be used singly or in a combination of two or more.

In view of smoothness of the resulting coating film, it is particularly preferable to use adipic acid and/or adipic anhydride as an aliphatic polybasic acid.

Generally, alicyclic polybasic acids include compounds having at least one alicyclic structure and at least two carboxy groups per molecule, acid anhydrides of such compounds, and esters of such compounds. The alicyclic structure is mostly a 4-6 membered ring structure. Examples of alicyclic polybasic acids include 1,2-cyclohexanedicarboxylic acid, 1,3-cyclohexanedicarboxylic acid, 1,4-cyclohexanedicarboxylic acid, 4-cyclohexene-1,2-dicarboxylic acid, 3-methyl-1,2-cyclohexanedicarboxylic acid, 4-methyl-1,2-cyclohexanedicarboxylic acid, 1,2,4-cyclohexanetricarboxylic acid, 1,3,5-cyclohexanetricarboxylic acid, and like alicyclic polycarboxylic acids; anhydrides of such alicyclic polycarboxylic acids; and esters of such alicyclic polycarboxylic acids with lower alkyls having about 1 to 4 carbon atoms. Such alicyclic polybasic acids can be used singly or in a combination of two or more.

In view of smoothness of the resulting coating film, preferable alicyclic polybasic acids are 1,2-cyclohexanedicarboxylic acid, 1,2-cyclohexanedicarboxylic anhydride, 1,3-cyclohexanedicarboxylic acid, 1,4-cyclohexanedicarboxylic acid, 4-cyclohexene-1,2-dicarboxylic acid, and 4-cyclohexene-1,2-dicarboxylic anhydride. Among these, it is particularly preferable to use 1,2-cyclohexanedicarboxylic acid and/or 1,2-cyclohexanedicarboxylic anhydride.

Generally, aromatic polybasic acids include aromatic compounds having at least two carboxy groups per molecule; anhydrides of such aromatic compounds; and esters of such aromatic compounds. Examples of aromatic polybasic acids include phthalic acid, isophthalic acid, terephthalic acid, naphthalenedicarboxylic acid, 4,4'-biphenyldicarboxylic acid, trimellitic acid, pyromellitic acid, and like aromatic polycarboxylic acids; anhydrides of such aromatic polycarboxylic acids; and esters of such aromatic polycarboxylic acids with lower alkyls having about 1 to 4 carbon atoms. Such aromatic polybasic acids can be used singly or in a combination of two or more.

Preferable aromatic polybasic acids include phthalic acid, phthalic anhydride, isophthalic acid, trimellitic acid, and trimellitic anhydride.

Acid components other than aliphatic polybasic acids, alicyclic polybasic acids, and aromatic polybasic acids can also be used. Acid components other than aliphatic polybasic acids, alicyclic polybasic acids, and aromatic polybasic acids are not limited, and include, for example, coconut oil fatty acid, cottonseed oil fatty acid, hempseed oil fatty acid, rice bran oil fatty acid, fish oil fatty acid, tall oil fatty acid, soybean oil fatty acid, linseed oil fatty acid, tung oil fatty acid, rapeseed oil fatty acid, castor oil fatty acid, dehydrated castor oil fatty acid, safflower oil fatty acid, and like fatty acids; lauric acid, myristic acid, palmitic acid, stearic acid, oleic acid, linolic acid, linolenic acid, benzoic acid, p-tert-butyl benzoic acid, cyclohexanoic acid, 10-phenyloctadecanoic acid, and like monocarboxylic acids; and lactic acid, 3-hydroxybutanoic acid, 3-hydroxy-4-ethoxybenzoic acid, and like hydroxycarboxylic acids. Such acid components can be used singly or in a combination of two or more.

Polyhydric alcohols having at least two hydroxy groups per molecule can be preferably used as the alcohol component mentioned above. Examples of such polyhydric alcohols include ethylene glycol, propylene glycol, diethylene glycol, trimethylene glycol, tetraethylene glycol, triethylene glycol, dipropylene glycol, 1,4-butanediol, 1,3-butanediol, 2,3-butanediol, 1,2-butanediol, 3-methyl-1,2-butanediol, 2-butyl-2-ethyl-1,3-propanediol, 1,2-pentanediol, 1,5-pentanediol, 1,4-pentanediol, 2,4-pentanediol, 2,3-dimethyltrimethylene glycol, tetramethylene glycol, 3-methyl-4,3-pentanediol, 3-methyl-1,5-pentanediol, 2,2,4-trimethyl-1,3-pentanediol, 1,6-hexanediol, 1,5-hexanediol, 1,4-hexanediol, 2,5-hexanediol, neopentyl glycol, 1,4-cyclohexanedimethanol, tricyclodecanedimethanol, hydrogenated bisphenol A, hydrogenated bisphenol F, and like dihydric alcohols; polylactone diols obtained by adding lactone compounds, such as ϵ-caprolactone, to such dihydric alcohols; bis(hydroxyethyl) terephthalate and like ester diol compounds; alkylene oxide adducts of bisphenol A, polyethylene glycols, polypropylene glycols, polybutylene glycols, and like polyether diol compounds; glycerol, trimethylolethane, trimethylolpropane, diglycerol, triglycerol, 1,2,6-hexanetriol, pentaerythritol, dipentaerythritol, tris(2-hydroxyethyl)isocyanuric acid, sorbitol, mannitol, and like trihydric or higher polyhydric alcohols; and polylactone polyol compounds obtained by adding lactone compounds, such as ϵ-caprolactone, to such trihydric or higher polyhydric alcohols.

Alcohol components other than polyhydric alcohols can also be used. Alcohol components other than polyhydric alcohols are not limited, and include, for example, methanol, ethanol, propyl alcohol, butyl alcohol, stearyl alcohol, 2-phenoxyethanol, and like monohydric alcohols; and alcohol compounds obtained by reacting, with acids, propylene oxide, butylene oxide, Cardura E10 (name of product produced by Hexion Specialty Chemicals; glycidyl ester of a synthetic highly branched saturated fatty acid), and like monoepoxy compounds.

The production method for the hydroxy-containing polyester resin (A1) is not limited, and may be performed by any usual method. For example, the acid component and the alcohol component are heated in a nitrogen stream at about 150 to 250° C. for about 5 to 10 hours to carry out an esterification or transesterification reaction of the acid component with the alcohol component. The hydroxy-containing polyester resin can thereby be produced.

For the esterification or transesterification reaction, the acid component and the alcohol component may be added to a reaction vessel at one time, or one or both of the components may be added in several portions. Further, a hydroxy-containing polyester resin may be first synthesized and then reacted with an acid anhydride for half-esterification to thereby obtain a carboxy- and hydroxy-containing polyester resin. Furthermore, a carboxy-containing polyester resin may be first synthesized, and the alcohol component may be added to obtain a hydroxy-containing polyester resin.

For promoting the esterification or transesterification reaction, known catalysts are usable. Examples of known catalysts include dibutyltin oxide, antimony trioxide, zinc acetate, manganese acetate, cobalt acetate, calcium acetate, lead acetate, tetrabutyl titanate, and tetraisopropyl titanate, etc.

The hydroxy-containing polyester resin (A1) can be modified with a fatty acid, monoepoxy compound, polyisocyanate compound, or the like, during or after the preparation of the resin.

Examples of the fatty acid include coconut oil fatty acid, cottonseed oil fatty acid, hempseed oil fatty acid, rice bran oil fatty acid, fish oil fatty acid, tall oil fatty acid, soybean oil fatty acid, linseed oil fatty acid, tung oil fatty acid, rapeseed oil fatty acid, castor oil fatty acid, dehydrated castor oil fatty acid, and safflower oil fatty acid. Preferable examples of the monoepoxy compound include Cardura E10 (name of product produced by Hexion Specialty Chemicals; glycidyl ester of a synthetic highly branched saturated fatty acid).

Examples of the polyisocyanate compound include lysine diisocyanate, hexamethylene diisocyanate, trimethylhexane diisocyanate, and like aliphatic diisocyanate compounds; hydrogenated xylylene diisocyanate, isophorone diisocyanate, methylcyclohexane-2,4-diisocyanate, methylcyclohexane-2,6-diisocyanate, 4,4'-methylene bis(cyclohexylisocyanate), 1,3-(isocyanatomethyl)cyclohexane, and like alicyclic diisocyanate compounds; tolylene diisocyanate, xylylene diisocyanate, diphenylmethane diisocyanate, and like aromatic diisocyanate compounds; organic polyisocyanates, such as lysine triisocyanate and like tri- or higher polyisocyanates; adducts of such organic polyisocyanates with polyhydric alcohols, low-molecular-weight polyester resins, water, and/or the like; and cyclopolymers (e.g., isocyanurate), biuret adducts, etc., of such organic polyisocyanates. Such polyisocyanate compounds can be used singly or in a combination of two or more.

In the hydroxy-containing polyester resin (A1), the amount of alicyclic polybasic acid in the acid component used as a starting material is preferably about 20 to 100 mol %, more preferably about 25 to 95 mol %, and even more preferably about 30 to 90 mol %, based on the total amount of the acid component, to obtain a coating film with excellent smoothness and water resistance. In particular, as the alicyclic polybasic acid, it is preferable to use 1,2-cyclohexanedicarboxylic acid and/or 1,2-cyclohexanedicarboxylic anhydride, in view of excellent smoothness of the resulting coating film.

The hydroxy-containing polyester resin (A1) preferably has an acid value of 30 mg KOH/g or less, preferably 0.1 to 28 mg KOH/g, and more preferably 1 to 25 mg KOH/g, in view of the smoothness and distinctness of image of the resulting coating film. The acid value can be adjusted to any value by changing the amount of the acid component.

The hydroxy-containing polyester resin (A1) preferably has a hydroxy value of 1 to 200 mg KOH/g, more preferably 2 to 180 mg KOH/g, and still more preferably 5 to 170 mg KOH/g, in view of chipping resistance, water resistance, etc., of the resulting coating film.

In this specification, the acid value (mg KOH/g) is obtained by a potassium-hydroxide-based conversion (mg) of the amount of the acid group per gram (solids content) of a sample. The molecular weight of potassium hydroxide is considered to be 56.1.

In the present invention, the acid value measurement was performed according to JISK-5601-2-1 (1999). More specifically, titration was performed with a potassium hydroxide solution using phenolphthalein as an indicator. The acid value was calculated using the following equation.

$$\text{Acid value (mg KOH/g)}=56.1\times V\times C/m,$$

wherein V represents titration amount (mL), C represents concentration (mol/L) of titrate liquid, and m represents solids content by weight (g) of the sample.

In this specification, the hydroxy value (mg KOH/g) is obtained by a potassium-hydroxide-based conversion (mg) of the amount of the hydroxy group per gram (solids content) of a sample. The molecular weight of potassium hydroxide is considered to be 56.1.

In the present invention, the hydroxy group value was measured according to JISK-0070 (1992). More specifically, 5 ml of acetylating reagent (anhydrous acetic acid pyridine solution obtained by adding pyridine to 25 g of anhydrous acetic acid, adjusted to 100 mL in total) was added to the sample, and the sample was heated in a glycerin bath. Thereafter, the sample was titrated in a potassium hydroxide solution using phenolphthalein as an indicator. Then, the hydroxy group value was calculated using the following equation.

$$\text{Hydroxy group value (mg KOH/g)}=[V\times 56.1\times C/m]+D$$

wherein V represents titration amount (mL), C represents concentration (mol/L) of titrate liquid, m represents solids content by weight (g) of the sample, and D represents acid value (mg KOH/g) of the sample.

The hydroxy-containing polyester resin (A1) preferably has a number average molecular weight of about 500 to 50,000, more preferably about 1,000 to 30,000, and still more preferably about 1,200 to 10,000, in view of smoothness and distinctness of image of the resulting coating film.

In the present specification, the number average molecular weight and the weight average molecular weight are determined by converting the retention time (retention volume) measured by gel permeation chromatography (GPC) into polystyrene molecular weight, based on the retention time (retention volume) of a standard polystyrene having a known molecular weight measured under the same conditions. More specifically, the number average molecular weight and the weight average molecular weight can be measured using a gel permeation chromatography apparatus (HLC8120GPC (product name) produced by Tosoh Corporation) together with four columns (TSKgel G-4000 HXL, TSKgel G-3000 HXL, TSKgel G-2500 HXL, and TSKgel G-2000 HXL produced by Tosoh Corporation), and a differential refractometer as a detector under the following conditions: mobile phase: tetrahydrofuran; measurement temperature: 40° C.; and flow rate: 1 mL/min.

Other Film-Forming Resins

Examples of other film-forming resins that can be used as the film-forming resin (A) with the hydroxy-containing polyester resin (A1) include hydroxy-containing acrylic resins, hydroxy-containing polyurethane resins (A3), alkyd resins, and the like. It is preferable that these resins contain a crosslinkable functional group, such as hydroxy, carboxy, or epoxy.

The hydroxy-containing acrylic resin is preferably a water-dispersible hydroxy-containing acrylic resin (A2). In the present invention, it is preferable that the hydroxy-containing polyester resin (A1) be used in combination with both the water-dispersible hydroxy-containing acrylic resin (A2) and the hydroxy-containing polyurethane resin (A3).

Water-Dispersible Hydroxy-Containing Acrylic Resin (A2)

The water-dispersible hydroxy-containing acrylic resin (A2) can be produced, for example, by copolymerizing a hydroxy-containing polymerizable unsaturated monomer with one or more other polymerizable unsaturated monomers copolymerizable with the hydroxy-containing polymerizable unsaturated monomer using a method known per se, such as an emulsion polymerization method in water.

The hydroxy-containing polymerizable unsaturated monomer is a compound containing one or more hydroxy groups and one or more polymerizable unsaturated bonds per molecule. Examples of the hydroxy-containing polymerizable unsaturated monomer include monoesterified products of (meth)acrylic acid with a dihydric alcohol having 2 to 8 carbon atoms (e.g., 2-hydroxyethyl (meth)acrylate, 2-hydroxypropyl (meth)acrylate, 3-hydroxypropyl (meth)acrylate, and 4-hydroxybutyl (meth)acrylate); ϵ-caprolactone modified products of such monoesterified products of (meth) acrylic acid with a dihydric alcohol having 2 to 8 carbon atoms; N-hydroxymethyl (meth)acrylamide; allyl alcohol; (meth)acrylates that include hydroxy-terminated polyoxyethylene chains; etc. In the present invention, however, the monomers corresponding to the polymerizable unsaturated monomers having a UV-absorbing functional group in item (xvii) below should be defined as other polymerizable unsaturated monomers that are copolymerizable with the hydroxy-containing polymerizable unsaturated monomer and are excluded from hydroxy-containing polymerizable unsaturated monomers. These hydroxy-containing polymerizable unsaturated monomers may be used singly or in a combination of two or more.

As the other polymerizable unsaturated monomers copolymerizable with the hydroxy-containing polymerizable unsaturated monomer, the monomers listed in (i) to (xx) below and other monomers can be used. These polymerizable unsaturated monomers may be used singly or in a combination of two or more.

(i) Alkyl or cycloalkyl (meth)acrylates: for example, methyl (meth)acrylate, ethyl (meth)acrylate, n-propyl (meth) acrylate, isopropyl (meth)acrylate, n-butyl (meth)acrylate, isobutyl (meth)acrylate, tert-butyl (meth)acrylate, n-hexyl (meth)acrylate, n-octyl (meth)acrylate, 2-ethylhexyl (meth) acrylate, nonyl (meth)acrylate, tridecyl (meth)acrylate, lauryl (meth)acrylate, stearyl (meth)acrylate, isostearyl (meth)acrylate, cyclohexyl (meth)acrylate, methylcyclohexyl (meth) acrylate, tert-butylcyclohexyl (meth)acrylate, cyclododecyl (meth)acrylate, and tricyclodecanyl (meth)acrylate.

(ii) Isobornyl-containing polymerizable unsaturated monomers: isobornyl (meth)acrylate, etc.

(iii) Adamantyl-containing polymerizable unsaturated monomers: adamantyl (meth)acrylate, etc.

(iv) Polymerizable unsaturated monomer having a tricyclodecenyl group: tricyclodecenyl (meth)acrylate, etc.

(v) Aromatic-ring-containing polymerizable unsaturated monomers: benzyl(meth)acrylate, styrene, α-methyl styrene, vinyltoluene, etc.

(vi) Polymerizable unsaturated monomers having an alkoxysilyl group: vinyltrimethoxysilane, vinyltriethoxysilane, vinyltris(2-methoxyethoxy)silane, γ (meth)acryloyloxypropyltrimethoxysilane, γ (meth)acryloyloxypropyltriethoxysilane, etc.

(vii) Polymerizable unsaturated monomers having a fluorinated alkyl group: perfluoroalkyl (meth)acrylates, such as perfluorobutylethyl (meth)acrylate and perfluorooctylethyl (meth)acrylate; fluoroolefin; etc.

(viii) Polymerizable unsaturated monomers having a photopolymerizable functional group, such as a maleimide group.

(ix) Vinyl compounds: N-vinylpyrrolidone, ethylene, butadiene, chloroprene, vinyl propionate, vinyl acetate, etc.

(x) Carboxy-containing polymerizable unsaturated monomers: (meth)acrylic acid, maleic acid, crotonic acid, β-carboxyethyl acrylate, etc.

(xi) Nitrogen-containing polymerizable unsaturated monomers: (meth)acrylonitrile, (meth)acrylamide, N,N-dimethylaminoethyl (meth)acrylate, N,N-diethylaminoethyl (meth)acrylate, N,N-dimethylaminopropyl (meth)acrylamide, methylene bis(meth)acrylamide, ethylene bis(meth) acrylamide, adducts of glycidyl (meth)acrylate with amines, etc.

(xii) Polymerizable unsaturated monomers having two or more polymerizable unsaturated groups per molecule: allyl (meth)acrylate, 1,6-hexanediol di(meth)acrylate, etc.

(xiii) Epoxy-containing polymerizable unsaturated monomers: glycidyl (meth)acrylate, β-methylglycidyl (meth)acrylate, 3,4-epoxycyclohexylmethyl (meth)acrylate, 3,4 epoxycyclohexylethyl (meth)acrylate, 3,4-epoxycyclohexylpropyl (meth)acrylate, allyl glycidyl ether, etc.

(xiv) (Meth)acrylates having an alkoxy-terminated polyoxyethylene chain.

(xv) Sulfonic-acid-group-containing polymerizable unsaturated monomers: 2-acrylamide-2-methylpropanesulfonic acid, 2-sulfoethyl (meth)acrylate, allylsulfonic acid, and 4-styrenesulfonic acid; sodium salts and ammonium salts of such sulfonic acids; etc.

(xvi) Phosphate-group-containing polymerizable unsaturated monomers: acid phosphoxyethyl (meth)acrylate, acid phosphoxypropyl (meth)acrylate, acid phosphoxypoly(oxyethylene)glycol (meth)acrylate, acid phosphoxypoly(oxypropylene)glycol (meth)acrylate, etc.

(xvii) Polymerizable unsaturated monomers having a UV-absorbing functional group: 2-hydroxy-4-(3-methacryloyloxy-2-hydroxypropoxy)benzophenone, 2-hydroxy-4-(3-acryloyloxy-2-hydroxypropoxy)benzophenone, 2,2'-dihydroxy-4-(3-methacryloyloxy-2-hydroxypropoxy) benzophenone, 2,2'-dihydroxy-4-(3-acryloyloxy-2-hydroxypropoxy)benzophenone, and 2-(2'-hydroxy-5'-methacryloyloxyethylphenyl)-2H-benzotriazole, etc.

(xviii) Light-stable polymerizable unsaturated monomers: 4-(meth)acryloyloxy-1,2,2,6,6-pentamethylpiperidine, 4-(meth)acryloyloxy-2,2,6,6-tetramethylpiperidine, 4-cyano-4-(meth)acryloylamino-2,2,6,6-tetramethylpiperidine, 1-(meth)acryloyl-4-(meth)acryloylamino-2,2,6,6-tetramethylpiperidine, 1-(meth)acryloyl-4-cyano-4-(meth)acryloylamino-2,2,6,6-tetramethylpiperidine, 4-crotonoyloxy-2,2,6,6-tetramethylpiperidine, 4-crotonoylamino-2,2,6,6-tetramethylpiperidine, 1-crotonoyl-4-crotonoyloxy-2,2,6,6-tetramethylpiperidine, etc.

(xix) Carbonyl-containing polymerizable unsaturated monomers: acrolein, diacetone acrylamide, diacetone methacrylamide, acetoacetoxylethyl methacrylate, formylstyrol, vinyl alkyl ketones having 4 to 7 carbon atoms (e.g., vinyl methyl ketone, vinyl ethyl ketone, and vinyl butyl ketone), etc.

(xx) Acid-anhydride-group-containing polymerizable unsaturated monomers: for example, maleic anhydride, itaconic anhydride, and citraconic anhydride.

In this specification, a polymerizable unsaturated group means an unsaturated group that can undergo radical polymerization. Examples of such polymerizable unsaturated groups include vinyl groups, (meth)acryloyl groups, and the like.

The term "(meth)acrylate" used herein means acrylate or methacrylate. The term "(meth)acrylic acid" means acrylic acid or methacrylic acid. The term "(meth)acryloyl" means acryloyl or methacryloyl. The term "(meth)acrylamide" means acrylamide or methacrylamide.

The amount of the hydroxy-containing polymerizable unsaturated monomer used to produce the water-dispersible hydroxy-containing acrylic resin (A2) is preferably about 0.1 to 50 mass, more preferably about 0.5 to 40 mass, and still more preferably about 1 to 30 mass, based on the total amount of the monomer components.

The water-dispersible hydroxy-containing acrylic resin (A2) preferably has an acid value of 30 mg KOH/g or less, more preferably 25 mg KOH/g or less, still more preferably about 0.1 to 20 mg KOH/g, and even more preferably about 1 to 15 mg KOH/g, in view of, for example, storage stability of the coating composition, water resistance of the resulting coating film, and prevention of the formation of a mixed layer from the aqueous first colored coating composition (X) and the aqueous second colored coating composition (Y).

The water-dispersible hydroxy-containing acrylic resin (A2) preferably has a hydroxy value of about 1 to 200 mg KOH/g, more preferably about 3 to 100 mg KOH/g, and still more preferably about 5 to 50 mg KOH/g, in view of chipping resistance, water resistance, etc., of the resulting coating film.

The water-dispersible hydroxy-containing acrylic resin (A2) is preferably a core-shell type in view of smoothness and water resistance of the resulting coating film.

A suitable example of the core-shell-type water-dispersible hydroxy-containing acrylic resin is a core-shell-type water-dispersible hydroxy-containing acrylic resin (A2') having, as a core portion, a copolymer (A2'-I) comprising, as copolymer components, a polymerizable unsaturated monomer having two or more polymerizable unsaturated groups per molecule and a polymerizable unsaturated monomer having one polymerizable unsaturated group per molecule, and, as a shell portion, a copolymer (A2'-II) comprising, as copolymer components, a hydroxy-containing polymerizable unsaturated monomer, a carboxy-containing polymerizable unsaturated monomer, and one or more other polymerizable unsaturated monomers.

Examples of the polymerizable unsaturated monomer that has two or more polymerizable unsaturated groups per molecule and that can be used as a monomer for the core copolymer (A2'-I) include allyl (meth)acrylate, ethylene glycol di(meth)acrylate, triethylene glycol di(meth)acrylate, tetraethylene glycol di(meth)acrylate, 1,3-butylene glycol di(meth)acrylate, trimethylol propane tri(meth)acrylate, 1,4-butanediol di(meth)acrylate, neopentyl glycol di(meth)acrylate, 1,6-hexanediol di(meth)acrylate, pentaerythritol di(meth)acrylate, pentaerythritol tetra(meth)acrylate, glycerol di(meth)acrylate, 1,1,1-tris-hydroxymethylethane di(meth)acrylate, 1,1,1-tris-hydroxymethylethane tri(meth) acrylate, 1,1,1-tris-hydroxymethylpropane tri(meth)acrylate, triallyl isocyanurate, diallyl terephthalate, divinylbenzene, methylenebis (meth)acrylamide, ethylenebis (meth)acrylamide, and the like. Such monomers can be used singly or in a combination of two or more.

The polymerizable unsaturated monomer having two or more polymerizable unsaturated groups per molecule functions to provide a crosslinked structure to the core copolymer (A2'-I). The amount of the polymerizable unsaturated monomer having two or more polymerizable unsaturated groups per molecule can be suitably determined according to the degree of crosslinking of the core copolymer (A2'-I). The amount thereof is generally preferably about 0.1 to 30 mass, more preferably about 0.5 to 10 mass, and still more preferably about 1 to 7 mass, based on the total mass of the monomers constituting the core copolymer (A2'-I).

The polymerizable unsaturated monomer having one polymerizable unsaturated group per molecule that can be used as a monomer for the core copolymer (A2'-I) is a polymerizable unsaturated monomer copolymerizable with the polymerizable unsaturated monomer having two or more polymerizable unsaturated groups per molecule.

Specific examples of the polymerizable unsaturated monomer having one polymerizable unsaturated group per molecule include the monomers (i) to (xi) and (xiii) to (xx), which are polymerizable unsaturated monomers other than the polymerizable unsaturated monomers having two or more polymerizable unsaturated groups per molecule, among the polymerizable unsaturated monomers listed in the above as other polymerizable unsaturated monomers copolymerizable with the hydroxy-containing polymerizable unsaturated monomers in the description of the water-dispersible hydroxy-containing acrylic resin (A2). Such monomers can be used singly or in a combination of two or more according to the properties required of the core-shell-type water dispersible hydroxy-containing acrylic resin (A2').

Of these, in view of smoothness, distinctness of image, etc., of the resulting coating film, it is particularly preferable that at least one of the polymerizable unsaturated monomers having one polymerizable unsaturated group per molecule be a hydrophobic polymerizable unsaturated monomer.

In this specification, the hydrophobic polymerizable unsaturated monomer is a polymerizable unsaturated monomer having a linear, branched, or cyclic saturated or unsaturated hydrocarbon group having 4 or more carbon atoms, preferably 6 to 18 carbon atoms; and monomers having a hydrophilic group, such as hydroxy-containing polymerizable unsaturated monomers, are excluded therefrom. Examples of such monomers include alkyl or cycloalkyl (meth)acrylate, such as N-butyl (meth)acrylate, isobutyl (meth)acrylate, tert-butyl (meth)acrylate, pentyl (meth)acrylate, hexyl (meth) acrylate, octyl (meth)acrylate, 2-ethylhexyl (meth)acrylate, nonyl (meth)acrylate, tridecyl (meth)acrylate, lauryl (meth) acrylate, stearyl (meth)acrylate, isostearyl (meth)acrylate, cyclohexyl (meth)acrylate, methylcyclohexyl (meth)acrylate, tert-butylcyclohexyl (meth)acrylate, cyclododecyl (meth)acrylate, and tricyclodecanyl (meth)acrylate; isobornyl-containing polymerizable unsaturated compounds, such as isobornyl (meth)acrylate; adamantyl-containing polymerizable unsaturated compounds, such as adamantyl (meth)acrylate; and aromatic-ring-containing polymerizable unsaturated monomers, such as benzyl (meth)acrylate, styrene, α-methylstyrene, and vinyltoluene; and the like. Such monomers can be used singly or in a combination of two or more.

Of these, at least one polymerizable unsaturated monomer selected from the group consisting of n-butyl (meth)acrylate, 2-ethylhexyl (meth)acrylate, and styrene can be preferably used as the hydrophobic polymerizable unsaturated monomer to improve the distinctness of image of the resulting coating film.

When the hydrophobic polymerizable unsaturated monomer is used as a monomer for the core copolymer (A2'-I), the amount of the hydrophobic polymerizable unsaturated monomer is preferably in a range of 5 to 90 mass %, based on the total mass of the monomers constituting the core copolymer (A2'-I), to provide a core-shell-type water-dispersible hydroxy-containing acrylic resin (A2') with excellent stability in an aqueous medium and to obtain a coating film with excellent water resistance, smoothness, and distinctness of image.

As copolymer components, the shell copolymer (A2'-II) comprises a hydroxy-containing polymerizable unsaturated monomer, an acid-group-containing polymerizable unsaturated monomer, and one or more other polymerizable unsaturated monomers.

The hydroxy-containing polymerizable unsaturated monomer used as a monomer for the shell copolymer (A2'-II) introduces a hydroxy group that can be crosslinked with a curing agent described below into the obtained water-dispersible acrylic resin, and thereby functions to enhance the water resistance of the coating film and to enhance the stability of the water-dispersible acrylic resin in an aqueous medium. Examples of the hydroxy-containing polymerizable unsaturated monomer include monoesterified products of (meth) acrylic acid with a dihydric alcohol having 2 to 8 carbon atoms (e.g., 2-hydroxyethyl (meth)acrylate, 2-hydroxypropyl (meth)acrylate, 3-hydroxypropyl (meth)acrylate, and 4-hydroxybutyl (meth)acrylate); ϵ-caprolactone modified products of such monoesterified products of (meth)acrylic acid with a dihydric alcohol having 2 to 8 carbon atoms; N-hydroxymethyl (meth)acrylamide; allyl alcohol; (meth) acrylates that include hydroxy-terminated polyoxyethylene chains; etc. Such monomers can be used singly or in a combination of two or more. Preferable examples of the hydroxy-containing polymerizable unsaturated monomer include 2-hydroxyethyl (meth)acrylate, 2-hydroxypropyl (meth) acrylate, 3-hydroxypropyl (meth)acrylate, 4-hydroxybutyl (meth)acrylate, etc.

To provide a core-shell-type water dispersible hydroxy-containing acrylic resin (A2') with excellent stability in an aqueous medium and to obtain a coating film with excellent water resistance, the amount of the hydroxy-containing polymerizable unsaturated monomer is preferably about 1 to 40 mass %, more preferably about 4 to 25 mass %, and even more preferably about 7 to 19 mass %, based on the total mass of the monomers constituting the shell copolymer (A2'-II).

Specific examples of the carboxy-containing polymerizable unsaturated monomer used as a monomer for the shell copolymer (A2'-II) are the same as those mentioned above as examples of a monomer for the core copolymer (A2'-I). More specifically, examples thereof include the carboxy-containing polymerizable unsaturated monomers in item (x) among the polymerizable unsaturated monomers listed in the examples above as other polymerizable unsaturated monomers copolymerizable with the hydroxy-containing polymerizable unsaturated monomer in the description of the hydroxy-containing water-dispersible acrylic resin (A2). Acrylic acid and/or methacrylic acid is particularly preferable as the carboxy-containing polymerizable unsaturated monomer. The use of the carboxy-containing polymerizable unsaturated monomer in the shell portion ensures the stability of the resulting core-shell-type water-dispersible hydroxy-containing acrylic resin (A2') in an aqueous medium.

When used, the amount of the carboxy-containing polymerizable unsaturated monomer is preferably about 1 to 30 mass %, more preferably about 5 to 25 mass %, and even more preferably about 7 to 19 mass %, based on the total mass of the monomers constituting the shell copolymer (A2'-II), to provide a core-shell-type water-dispersible hydroxy-containing acrylic resin (A2') with excellent stability in an aqueous medium and provide a coating film with excellent water resistance.

The other polymerizable unsaturated monomers used as a monomer for the shell copolymer (A2'-II) are polymerizable unsaturated monomers other than hydroxy-containing polymerizable unsaturated monomers and carboxy-containing polymerizable unsaturated monomers. Examples of such monomers include alkyl or cycloalkyl (meth)acrylates, such as methyl (meth)acrylate, ethyl (meth)acrylate, n-propyl (meth)acrylate, iso-propyl (meth)acrylate, n-butyl (meth) acrylate, iso-butyl (meth)acrylate, and tert-butyl (meth)acrylate; alkyl or cycloalkyl (meth)acrylates, such as n-hexyl (meth)acrylate, octyl (meth)acrylate, 2-ethylhexyl (meth) acrylate, nonyl (meth)acrylate, tridecyl (meth)acrylate, lauryl (meth)acrylate, stearyl (meth)acrylate, isostearyl (meth)acrylate, cyclohexyl (meth)acrylate, methylcyclohexyl (meth) acrylate, tert-butylcyclohexyl (meth)acrylate, cyclododecyl (meth)acrylate, and tricyclodecanyl (meth)acrylate; isobornyl-containing polymerizable unsaturated compounds, such as isobornyl (meth)acrylate; adamantyl-containing polymerizable unsaturated compounds, such as adamantyl (meth)acrylate; and aromatic-ring-containing polymerizable unsaturated monomers, such as benzyl (meth)acrylate, styrene, α-methylstyrene, and vinyltoluene. Such monomers can be used singly or in a combination of two or more.

To enhance the luster of the resulting coating film, it is preferable not to use polymerizable unsaturated monomers having two or more polymerizable unsaturated groups per molecule as the other polymerizable unsaturated monomers for constituting the shell copolymer (A2'-II), thus forming an uncrosslinked copolymer (II).

To enhance the distinctness of image and luster of the resulting coating film, the ratio of the copolymer (I) to the copolymer (II) in the core-shell-type water-dispersible hydroxy-containing acrylic resin (A2') is preferably in the range of about 5/95 to 95/5, more preferably about 10/90 to 90/10, still more preferably about 50/50 to 85/15, and particularly preferably about 65/35 to 80/20, on a solids basis.

In view of storage stability of the coating composition, water resistance of the resulting coating film, and excellent prevention of the formation of a mixed layer from the aqueous first colored coating composition (X) forming a colored coating film and the aqueous second colored coating composition (Y) forming a colored coating film, the core-shell-type water-dispersible hydroxy-containing acrylic resin (A2') preferably has an acid value of about 25 mg KOH/g or less, more preferably about 0.1 to 20 mg KOH/g, and even more preferably about 1 to 15 mg KOH/g.

In view of excellent chipping resistance, water resistance, etc., of the resulting coating film, the core-shell-type water-dispersible hydroxy-containing acrylic resin (A2') preferably has a hydroxy value of about 1 to 200 mg KOH/g, more preferably about 3 to 100 mg KOH/g, and even more preferably about 5 to 50 mg KOH/g.

The core-shell-type water-dispersible hydroxy-containing acrylic resin (A2') can be prepared, for example, by subjecting to emulsion polymerization a monomer mixture of about 0.1 to 30 mass % of a polymerizable unsaturated monomer having two or more polymerizable unsaturated groups per molecule, and about 70 to 99.9 mass % of a polymerizable unsaturated monomer having one polymerizable unsaturated group per molecule to form an emulsion of a core copolymer (A2'-I); adding to this emulsion a monomer mixture of about 1 to 40 mass % of a hydroxy-containing polymerizable unsaturated monomer, about 5 to 50 mass % of a hydrophobic polymerizable unsaturated monomers, and about 10 to 94 mass % of other polymerizable unsaturated monomers; and further performing emulsion polymerization to form a shell copolymer (A2'-II).

The emulsion polymerization for preparing an emulsion of the core copolymer (A2'-I) can be performed according to known methods. For example, the emulsion can be prepared by subjecting the monomer mixture to emulsion polymerization using a polymerization initiator in the presence of a surfactant.

For the surfactant, anionic surfactants and nonionic surfactants are suitable. Examples of anionic surfactants include sodium salts and ammonium salts of alkylsulfonic acids, alkylbenzenesulfonic acids, alkylphosphoric acids, etc. Examples of nonionic surfactants include polyoxyethylene oleyl ether, polyoxyethylene stearyl ether, polyoxyethylene lauryl ether, polyoxyethylene tridecyl ether, polyoxyethylene phenyl ether, polyoxyethylene nonylphenyl ether, polyoxyethylene octylphenyl ether, polyoxyethylene monolaurate, polyoxyethylene monostearate, polyoxyethylene monooleate, sorbitan monolaurate, sorbitan monostearate, sorbitan trioleate, polyoxyethylene sorbitan monolaurate, etc.

Other examples of usable surfactants include polyoxyalkylene-containing anionic surfactants that have an anionic group and a polyoxyalkylene group, such as a polyoxyethylene group or a polyoxypropylene group, per molecule; and reactive anionic surfactants that have an anionic group and a radically polymerizable unsaturated group per molecule. Among these, reactive anionic surfactants are preferable.

Examples of reactive anionic surfactants include sodium salts of sulfonic acid compounds having a radically polymerizable unsaturated group, such as allyl, methallyl, (meth) acryloyl, propenyl, or butenyl; ammonium salts of such sulfonic acid compounds; and the like. Among these, ammonium salts of sulfonic acid compounds having a radically polymerizable unsaturated group are preferable in view of the excellent water resistance of the resulting coating film. Examples of commercially available ammonium salts of such sulfonic acid compounds include LATEMUL S-180A (name of product produced by Kao Corporation).

Among the ammonium salts of sulfonic acid compounds having a radically polymerizable unsaturated group, ammonium salts of sulfonic acid compounds having a radically polymerizable unsaturated group and a polyoxyalkylene group are particularly preferable. Commercially available ammonium salts of sulfonic acid compounds having a radically polymerizable unsaturated group and a polyoxyalkylene group include Aqualon KH-10 (name of product produced by Dai-Ichi Kogyo Seiyaku Co., Ltd.), LATEMUL PD-104 (name of product produced by Kao Corporation), Adeka Reasoap SR-1025 (name of product produced by ADEKA Co., Ltd.), etc.

The amount of surfactant is preferably about 0.1 to 15 mass %, more preferably about 0.5 to 10 mass %, and even more preferably about 1 to 5 mass %, based on the total mass of the monomers used.

Examples of polymerization initiators include organic peroxides such as benzoyl peroxide, octanoyl peroxide, lauroyl peroxide, stearoyl peroxide, cumene hydroperoxide, tert-butyl peroxide, di-tert-amyl peroxide, tert-butyl peroxi-2-ethylhexanoate, tert-butyl peroxylaurate, tert-butyl peroxyisopropylcarbonate, tert-butyl peroxyacetate, and diisopropylbenzene hydroperoxide; azo compounds such as azobisisobutyronitrile, azobis(2,4-dimethylvaleronitrile), azobis(2-methylpropionenitrile), azobis(2-methylbutyronitrile), 4,4'-azobis(4-cyanobutanoic acid), dimethyl azobis(2-methyl propionate), azobis[2-methyl-N-(2-hydroxyethyl)-propionamide], and azobis[2-methyl-N-[2-(1-hydroxy butyl)]-propionamide]; persulfates such as potassium persulfate, ammonium persulfate, and sodium persulfate; and the like. Such polymerization initiators can be used singly or in a combination of two or more. Redox initiators prepared by combining a polymerization initiator as mentioned above with a reducing agent such as sugar, sodium formaldehyde sulfoxylate, iron complex, etc., may also be used.

Generally, the amount of polymerization initiator is preferably about 0.1 to 5 mass %, and more preferably about 0.2 to 3 mass %, based on the total mass of all of the monomers used. The method of adding the polymerization initiator is not particularly limited, and can be suitably selected according to the type, amount, etc., of polymerization initiator. For example, the polymerization initiator may be incorporated into a monomer mixture or an aqueous medium beforehand, or may be added dropwise or all at once at the time of polymerization.

The core-shell-type water-dispersible hydroxy-containing acrylic resin (A2') can be obtained by adding a monomer mixture of a hydroxy-containing polymerizable unsaturated monomer, a hydrophobic polymerizable unsaturated monomer, and other polymerizable unsaturated monomers to the emulsion of the core copolymer (A2'-I) obtained above; and further performing polymerization to form a shell copolymer (A2'-II).

The monomer mixture for forming the shell copolymer (A2'-II) may optionally contain other components, such as polymerization initiators as mentioned above, chain transfer agents, reducing agents, and surfactants. The monomer mixture is preferably added dropwise as a monomer emulsion obtained by dispersing the monomer mixture into an aqueous medium, although it may be added dropwise as is. When it is added dropwise as a monomer emulsion, the particle diameter of the monomer emulsion is not particularly limited.

The method for polymerizing the monomer mixture for forming the shell copolymer (A2'-II) comprises, for example, adding the monomer mixture or emulsion thereof dropwise to the emulsion of the core copolymer (A2'-I) all at once or gradually, and heating the mixture to a suitable temperature while stirring. The core-shell-type water-dispersible hydroxy-containing acrylic resin (A2') thus obtained has a multiple-layer structure comprising a core copolymer (A2'-I) of a monomer mixture of a polymerizable unsaturated monomer having two or more polymerizable unsaturated groups per molecule and a polymerizable unsaturated monomer having one polymerizable unsaturated group per molecule, and a shell copolymer (A2'-II) of a monomer mixture of a hydroxy-containing polymerizable unsaturated monomer, a hydrophobic polymerizable unsaturated monomer, and other polymerizable unsaturated monomers.

The core-shell-type water-dispersible hydroxy-containing acrylic resin (A2') thus obtained usually has a mean particle diameter of about 10 to 1,000 nm, and preferably about 20 to 500 nm. In this specification, the mean particle diameter of the core-shell-type water-dispersible hydroxy-containing acrylic resin (A2') refers to a value obtained by measurement at 20° C. using a submicron particle size distribution analyzer after dilution with deionized water according to a usual method. For example, a COULTER N4 (name of product produced by Beckman Coulter, Inc.) may be used as the submicron particle size distribution analyzer.

To improve the mechanical stability of the particles of the core-shell-type water-dispersible hydroxy-containing acrylic resin (A2'), acid groups such as carboxy groups of the water-dispersible acrylic resin are preferably neutralized with a neutralizing agent. The neutralizing agent is not particularly limited, as long as it can neutralize acid groups. Examples of such neutralizing agents include sodium hydroxide, potassium hydroxide, trimethylamine, 2-(dimethylamino)ethanol, 2-amino-2-methyl-1-propanol, triethylamine, aqueous ammonia, etc. Such a neutralizing agent is preferably used in an amount such that the pH of the aqueous dispersion of the water-dispersible acrylic resin after neutralization is about 6.5 to about 9.0.

Hydroxy-Containing Polyurethane Resin (A3)

Examples of the hydroxy-containing polyurethane resin (A3) include a polyurethane resin obtained by reacting at least one diisocyanate compound selected from the group consisting of aliphatic diisocyanate compounds, alicyclic diisocyanate compounds, and aromatic diisocyanate compounds, with at least one polyol compound selected from the group consisting of polyether polyol, polyester polyol, and polycarbonate polyol.

Specific examples thereof include a polyurethane resin obtained by reacting at least one diisocyanate selected from aliphatic diisocyanate and alicyclic diisocyanate, at least one diol selected from polyetherdiol, polyesterdiol, and polycarbonatediol, a low molecular weight polyhydroxy compound, and a dimethylol alkanoic acid to form a urethane prepolymer; neutralizing the resulting urethane prepolymer with a tertiary amine; dispersing the neutralized urethane prepolymer in water to be emulsified; mixing the resulting emulsion with an aqueous medium containing a chain extension agent such as polyamine, a crosslinking agent, and/or a quenching agent as required; and continuing the reaction until the isocyanate group is substantially removed. This method generally produces a self-emulsified polyurethane resin having a mean particle diameter of about 0.001 to 3 μm.

Curing Agent

The aqueous first colored coating composition (X) may further contain a curing agent, in addition to the film-forming resin (A). A curing agent can cure the aqueous first colored coating composition (X) by reacting with functional groups, such as hydroxy, carboxy, and epoxy, in the film-forming resin (A).

Examples of the curing agent include amino resins, polyisocyanate compounds, blocked polyisocyanate compounds, epoxy-containing compounds, carboxy-containing compounds, carbodiimide-group-containing compounds, hydrazide-group-containing compounds, semicarbazide-group-containing compounds, etc. Preferable among these are amino resins, polyisocyanate compounds, and blocked polyisocyanate compounds, which react with hydroxy groups, and carbodiimide-group-containing compounds, which react with carboxy groups; amino resins are particularly preferable. The curing agent can be used singly or in a combination of two or more.

Usable amino resins include partially or fully methylolated amino resins obtained by the reactions of amino components with aldehyde components. Examples of the amino components include melamine, urea, benzoguanamine, acetoguanamine, steroguanamine, spiroguanamine, dicyandiamide, etc. Examples of aldehyde components include formaldehyde, paraformaldehyde, acetaldehyde, benzaldehyde, etc.

It is also possible to use resins obtained by partially or fully etherifying the methylol groups of methylolated amino resins by using a suitable alcohol. Examples of the alcohols usable for etherification include methyl alcohol, ethyl alcohol, n-propyl alcohol, isopropyl alcohol, n-butyl alcohol, isobutyl alcohol, 2-ethylbutanol, 2-ethylhexanol, etc.

A melamine resin is preferably used as the amino resin. In particular, a methyl-etherified melamine resin obtained by etherifying some or all of the methylol groups of a partially or fully methylolated melamine resin with methyl alcohol, a butyl-etherified melamine resin obtained by etherifying some or all of the methylol groups of a partially or fully methylolated melamine resin with butyl alcohol, and a methyl-butyl mixture-etherified melamine resin obtained by etherifying some or all of the methylol groups of a partially or fully methylolated melamine resin with methyl alcohol and butyl alcohol are preferable.

In view of excellent water resistance of the resulting coating film, the melamine resin preferably has a weight average molecular weight of 400 to 6,000, more preferably 500 to 4,000, and still more preferably 600 to 3,000.

A commercially available melamine resin can be used as the melamine resin. Examples of commercially available products include Cymel 202, Cymel 203, Cymel 238, Cymel 251, Cymel 303, Cymel 323, Cymel 324, Cymel 325, Cymel 327, Cymel 350, Cymel 385, Cymel 1156, Cymel 1158, Cymel 1116, and Cymel 1130 (produced by Nihon Cytec Industries Inc.), U-VAN 120, U-VAN 20HS, U-VAN 20SE60, U-VAN 2021, U-VAN 2028, U-VAN 28-60 (produced by Mitsui Chemicals, Inc.), and the like.

When a melamine resin is used as the curing agent, it is possible to use, as a catalyst, paratoluene sulfonic acid, dodecylbenzenesulfonic acid, dinonylnaphthalene sulfonic acid, and like sulfonic acids; monobutyl phosphate, dibutyl phosphate, mono-2-ethylhexyl phosphate, di-2-ethylhexyl phosphate, and like alkyl phosphoric esters; and salts of these acids with an amine compound.

The polyisocyanate compound has at least two isocyanate groups per molecule. Examples thereof include hexamethylene diisocyanate, trimethylhexamethylene diisocyanate, dimer acid diisocyanate, lysine diisocyanate, and like aliphatic diisocyanate compounds; hydrogenated xylylene diisocyanate, cyclohexylene diisocyanate, isophorone diisocyanate, and like alicyclic diisocyanate compounds; tolylene diisocyanate, phenylene diisocyanate, 4,4'-diphenylmethane diisocyanate, xylylene diisocyanate, tetramethylxylylene diisocyanate, naphthalene diisocyanate, and like aromatic diisocyanate compounds; trivalent or higher organic polyisocyanate compounds such as 2-isocyanatoethyl-2,6-diisocyanatocaproate, 3-isocyanatomethyl-1,6-hexamethylene diisocyanate, 4-isocyanatomethyl-1,8-octamethylene diisocyanate (commonly referred to as triamino-nonane triisocyanate); dimers and trimers of such polyisocyanate compounds; and prepolymers obtained by a urethanization reaction of such polyisocyanate compounds with polyhydric alcohols, low-molecular-weight polyester resins, or water, under conditions such that isocyanate groups are present in excess.

The blocked polyisocyanate compounds are compounds obtained by blocking, with blocking agents, isocyanate groups of polyisocyanate compounds having at least two isocyanate groups per molecule. Examples of such blocking agents include phenol, cresol, xylenol, nitrophenol, ethylphenol, hydroxydiphenyl, butylphenol, isopropylphenol, nonylphenol, octylphenol, methyl hydroxybenzoate, and like phenol-based blocking agents; ϵ-caprolactam, δ-valerolactam, γ-butyrolactam, β-propiolactam, and like lactam-based blocking agents; methanol, ethanol, propyl alcohol, butyl alcohol, amyl alcohol, lauryl alcohol, and like aliphatic alcohol-based blocking agents; ethylene glycol monomethyl ether, ethylene glycol monoethyl ether, ethylene glycol monobutyl ether, diethylene glycol monomethyl ether, diethylene glycol monoethyl ether, propylene glycol monomethyl ether, methoxymethanol, and like ether-based blocking agents; benzyl alcohol, glycolic acid, methyl glycolate, ethyl glycolate, butyl glycolate, lactic acid, methyl lactate, ethyl lactate, butyl lactate, methylol urea, methylol melamine, diacetone alcohol, 2-hydroxyethyl acrylate, 2-hydroxyethyl methacrylate, and like alcohol-based blocking agents; formamide oxime, acetamide oxime, acetoxime, methyl ethyl ketoxime, diacetyl monoxime, benzophenone oxime, cyclohexane oxime, and like oxime-based blocking agents; dimethyl malonate, diethyl malonate, ethyl acetoacetate, methyl acetoacetate, acetylacetone, and like active methylene-based blocking agents; butyl mercaptan, tert-butyl mercaptan, hexyl mercaptan, tert-dodecyl mercaptan, 2-mercaptobenzothiazole, thiophenol, methylthiophenol, ethylthiophenol, and like mercaptan-based blocking agents; acetanilide, acetanisidide, acetotoluide, acrylamide, methacrylamide, acetamide, stearamide, benzamide, and like acid amide-based blocking agents; succinimide, phthalimide, maleimide, and like imide-based blocking agents; diphenylamine, phenylnaphthylamine, xylidine, N-phenylxylidine, carbazole, aniline, naphthylamine, butylamine, dibutylamine, butylphenylamine, and like amine-based blocking agents; imidazole, 2-ethylimidazole, and like imidazole-based blocking agents; urea, thiourea, ethylene urea, ethylenethiourea, diphenylurea, and like urea-based blocking agents; phenyl N-phenylcarbamate and like carbamate-based blocking agents; ethyleneimine, propyleneimine, and like imine-based blocking agents; sodium bisulfite, potassium bisulfite, and like sulfite salt-based blocking agents; and azole compounds, etc. Examples of azole compounds include pyrazole and pyrazole derivatives, such as pyrazole, 3,5-dimethylpyrazole, 3-methylpyrazole, 4-benzyl-3,5-dimethylpyrazole, 4-nitro-3,5-dimethylpyrazole, 4-bromo-3,5-dimethylpyrazole, 3-methyl-5-phenylpyrazole, and the like; imidazole and imidazole derivatives such as imidazole, benzimidazole, 2-methylimidazole, 2-ethylimidazole, 2-phenylimidazole, and the like; imidazoline derivatives such as 2-methylimidazoline, 2-phenylimidazoline, etc.

When a polyisocyanate compound or blocked polyisocyanate compound mentioned above is used as the curing agent, examples of usable catalysts include tin octylate, dibutyltin diacetate, dibutyltin di(2-ethylhexanoate), dibutyltin dilaurate, dibutyltin diacetate, dioctyltin di(2-ethylhexanoate), dibutyltin oxide, dioctyltin oxide, dibutyltin fatty acid salt, lead 2-ethylhexanoate, zinc octylate, zinc naphthenate, zinc fatty acid compounds, cobalt naphthenate, calcium octylate, copper naphthenate, tetra(2-ethylhexyl)titanate, and like organic metal compounds; tertiary amines; and phosphoric acid compounds.

Examples of carbodiimide-group-containing compounds include, for example, those obtained by the decarbonation reactions between isocyanate groups of the polyisocyanate compounds mentioned above. As the carbodiimide-group-containing compound, it is preferable to use a polycarbodiimide compound containing at least two carbodiimide groups per molecule.

The above polycarbodiimide compounds are preferably water-soluble or water-dispersible polycarbodiimide compounds, in terms of the smoothness, DOI, etc., of the resulting coating films. There is no particular limitation to the water-soluble or water-dispersible polycarbodiimide compounds so long as the polycarbodiimide compounds are stably dissolved or dispersed in an aqueous medium.

Examples of the water-soluble polycarbodiimide compounds include Carbodilite SV-02, Carbodilite V-02, Carbodilite V-02-L2, Carbodilite V-04 (names of products produced by Nisshinbo Industries, Inc.), and the like. Examples of the water-dispersible polycarbodiimide compounds include Carbodilite E-01, Carbodilite E-02 (names of products produces by Nisshinbo Industries, Inc.), and the like.

Such polycarbodiimide compounds can be used singly or in a combination of two or more.

When the aqueous first colored coating composition (X) contains a curing agent, it is preferable that the proportions of the film-forming resin (A) and the curing agent in the aqueous first colored coating composition (X) be such that the former is about 30 to 95 mass %, more preferably about 50 to 90 mass %, and even more preferably about 60 to 80 mass %; and the latter is about 5 to 70 mass %, more preferably about 10 to 50 mass %, and even more preferably about 20 to 40 mass %, based on the total amount of the former and the latter, in view of smoothness, distinctness of image, and water resistance of the resulting coating film.

The amount of the curing agent in the aqueous first colored coating composition (X) is generally 5 to 60 parts by mass, preferably 10 to 50 parts by mass, more preferably 20 to 40 parts by mass, based on 100 parts by mass of the solids content of the resin component constituting the coating composition.

The amount of the hydroxy-containing polyester resin (A1) in the aqueous first colored coating composition (X) is preferably about 2 to 70 mass %, more preferably about 10 to 55 mass %, and even more preferably about 15 to 45 mass %, based on the total solids content of the film-forming resin (A) and the curing agent, in view of smoothness, distinctness of image, water resistance, and chipping resistance of the resulting coating film.

When the aqueous first colored coating composition (X) contains the water-dispersible hydroxy-containing acrylic resin (A2), the amount of the water-dispersible hydroxy-containing acrylic resin (A2) is preferably about 2 to 70 mass %, more preferably about 10 to 65 mass %, and even more preferably about 20 to 60 mass %, based on the total solids content of the film-forming resin (A) and the curing agent, in view of smoothness and distinctness of image of the resulting coating film.

When the aqueous first colored coating composition (X) contains the core-shell-type water-dispersible hydroxy-containing acrylic resin (A2'), the amount of the core-shell-type water-dispersible hydroxy-containing acrylic resin (A2') is preferably about 2 to 70 mass %, more preferably about 10 to 65 mass %, and even more preferably about 20 to 60 mass %, based on the total solids content of the film-forming resin (A) and the curing agent, in view of smoothness and distinctness of image of the resulting coating film.

When the aqueous first colored coating composition (X) contains the water-dispersible urethane resin (A3), the amount of the water-dispersible urethane resin (A3) is preferably about 10 to 98 mass %, more preferably about 15 to 60 mass %, and even more preferably about 15 to 55 mass %, based on the total solids content of the film-forming resin (A) and the curing agent, in view of the smoothness and distinctness of image of the resulting multilayer coating film.

Pigment (B)

A pigment (B) may be a color pigment, an extender pigment, an effect pigment, etc.

Examples of color pigments include titanium dioxide, zinc flower, carbon black, molybdenum red, Prussian blue, cobalt blue, azo pigments, phthalocyanine pigments, quinacridone pigments, isoindoline pigments, threne (anthraquinone) pigments, perylene pigments, dioxazine pigments, diketopyrrolopyrrole pigments, and the like. These may be used singly or in a combination of two or more. Of these, titanium dioxide is preferably used as at least one of the color pigments.

When the aqueous first colored coating composition (X) contains a color pigment mentioned above, the amount of the color pigment is generally 1 to 150 parts by mass, preferably 3 to 130 parts by mass, and more preferably 5 to 110 parts by mass, based on 100 parts by mass of the solids content of the film-forming resin (A) and the curing agent in the aqueous first colored coating composition (X).

Examples of extender pigments include clay, kaolin, barium sulfate, barium carbonate, calcium carbonate, talc, silica, alumina white, and the like. These may be used singly or in a combination of two or more. Of these, barium sulfate and/or talc is preferably used, and barium sulfate is more preferably used as at least one of the extender pigments.

When the aqueous first colored coating composition (X) contains an extender pigment mentioned above, the amount of the extender pigment is generally 1 to 150 parts by mass, preferably 3 to 130 parts by mass, and more preferably 5 to 110 parts by mass, based on 100 parts by mass of the total solids content of the film-forming resin (A) and the curing agent in the aqueous first colored coating composition (X).

Examples of effect pigments include aluminium (such as vapor-deposited aluminum), copper, zinc, brass, nickel, aluminium oxide, mica, titanium-oxide-coated or iron-oxide-coated aluminium oxide, titanium-oxide-coated or iron-oxide-coated mica, glass flakes, holographic pigments, and the like. These may be used singly or in a combination of two or more. Of these, at least one effect pigment selected from the group consisting of aluminium, aluminium oxide, mica, titanium-oxide-coated or iron-oxide-coated aluminium oxide, and titanium-oxide-coated or iron-oxide-coated mica is preferably used as the effect pigment.

The effect pigment is preferably in the form of scales. As the effect pigment, pigments having a longitudinal dimension of 1 to 100 μm, particularly 5 to 40 μm, and a thickness of 0.001 to 5 μm, particularly 0.01 to 2 μm, are suitable.

When the aqueous first colored coating composition (X) contains an effect pigment mentioned above, the amount of the effect pigment is generally 1 to 50 parts by mass, preferably 2 to 30 parts by mass, and more preferably 3 to 20 parts by mass, based on 100 parts by mass of the total solids content of the film-forming resin (A) and the curing agent in the aqueous first colored coating composition (X).

In view of the smoothness, distinctness of image, and water resistance of the resulting multilayer coating film, it is preferable that the aqueous first colored coating composition (X) contains titanium dioxide and/or barium sulfate in a total amount of 50 to 150 parts by mass, preferably 55 to 130 parts by mass, and more preferably 60 to 120 parts by mass, based on 100 parts by mass of the total solids content of the film-forming resin (A) and the curing agent. In particular, the amount of the titanium dioxide is preferably 50 to 150 parts by mass, more preferably 55 to 130 parts by mass, and even more preferably 60 to 120 parts by mass, based on 100 parts by mass of the total solids content of the film-forming resin (A) and the curing agent.

Additive for Coating Compositions

The aqueous first colored coating composition (X) may further contain an additive for coating compositions, such as thickeners, curing catalysts, UV absorbers, light stabilizers, antifoaming agents, plasticizers, surface control agents, and antisettling agents.

Examples of thickeners include inorganic thickeners such as silicate, metal silicate, montmorillonite, and colloidal alumina; polyacrylic acid thickeners such as copolymers of (meth)acrylic acid and (meth)acrylic ester, and sodium polyacrylate; associative thickeners having a hydrophilic moiety and a hydrophobic moiety per molecule, and effectively enhancing the viscosity in an aqueous medium by adsorption of the hydrophobic moiety on the surface of a pigment or emulsion particles in a coating composition, or by association between hydrophobic moieties; cellulose-derived thickeners, such as carboxymethylcellulose, methylcellulose, and hydroxyethylcellulose; protein thickeners such as casein, sodium caseinate, and ammonium caseinate; alginate thickeners such as sodium alginate; polyvinyl thickeners such as polyvinyl alcohol, polyvinylpyrrolidone, and polyvinyl benzyl ether copolymers; polyether thickeners such as polyether dialkyl ester, polyether dialkyl ether, and polyether epoxy-modified products; maleic anhydride copolymer thickeners such as partial esters of vinyl methyl ether-maleic anhydride copolymers; and polyamide thickeners such as polyamide amine. These thickeners may be used singly or in a combination of two or more. Of these, polyacrylic acid thickeners and/or associative thickeners are preferably used.

Examples of polyacrylic acid thickeners include commercially available products under the product names ACRYSOL ASE-60, ACRYSOL TT-615, and ACRYSOL RM-5 (produced by Rohm & Haas Co., Ltd.); SN thickener 613, SN thickener 618, SN thickener 630, SN thickener 634, and SN thickener 636 (produced by San Nopco Ltd.); and the like.

Examples of usable associative thickeners include commercially available products under the product names UH-420, UH-450, UH-462, UH-472, UH-540, UH-752, UH-756VF, and UH-814N (produced by ADEKA Co. Ltd.); ACRYSOL RM-8W, Primal RM-12W, ACRYSOL RM-825, and ACRYSOL SCT-275 (produced by Rohm & Haas Co., Ltd.); SN thickener 612, SN thickener 621N, SN thickener 625N, SN thickener 627N, and SN thickener 660T (produced by San Nopco Ltd.); and the like.

When the aqueous first colored coating composition (X) contains a thickener mentioned above, the amount of the thickener is generally 0.01 to 10 parts by mass, preferably 0.05 to 3 parts by mass, and more preferably 0.1 to 2 parts by mass, based on 100 parts by mass of the total solids content of the film-forming resin (A) and the curing agent.

The additives for coating compositions can be prepared by mixing and dispersing in an aqueous medium by using a known method. Examples of the aqueous medium include deionized water, and a mixture of deionized water and a hydrophilic organic solvent. Examples of the hydrophilic organic solvent include propylene glycol monomethyl ether, and the like. It is preferable that the aqueous first colored coating composition (X) contains water in an amount of about 10 to 95 mass %, more preferably about 20 to 80 mass %, and even more preferably about 30 to 70 mass %.

It is preferable that the aqueous first colored coating composition (X) generally has a solids concentration of 30 to 80 mass %, more preferably 40 to 70 mass %, and even more preferably 45 to 60 mass %.

The aqueous first colored coating composition (X) can be coated on a cured electrodeposition coating film by a known method such as air spray coating, airless spray coating, rotary atomization coating, or curtain coating. An electrostatic charge may be applied during the coating. Among these, air spray coating, rotary atomization coating, etc., are preferable.

In view of smoothness of the resulting multilayer coating film, the aqueous first colored coating composition (X) is preferably applied to obtain a film thickness of 5 to 40 μm, more preferably 10 to 30 μm, and even more preferably 15 to 25 μm when cured.

Step (2)

Subsequently, an aqueous second colored coating composition (Y) is applied to the coating film of the aqueous first colored coating composition (X) (hereinafter, sometimes referred to as "first colored coating film") formed in step (1) described above to thereby form an uncured aqueous second colored coating film.

Before application of the aqueous second colored coating composition (Y), the first colored coating film may be subjected to preheating (preliminary heating), air blowing, or the like, under conditions in which the coating film is not substantially cured. In the present invention, a cured coating film refers to a film in a dry-hard condition according to JIS K 5600-1-1, i.e., a condition in which imprints due to fingerprints are not formed on the coated surface and no movement is detected on the coating film when the center of the coated surface is strongly pinched with a thumb and an index finger, and in which scrapes are unobservable on the coated surface when the center of the coated surface is rubbed rapidly and repeatedly with a fingertip. On the other hand, an uncured coating film refers to a film that has not yet reached the dry-hard condition, including a film in a set-to-touch condition and a film in a dry-to-touch condition according to JIS K 5600-1-1.

The preheating temperature is preferably 40 to 100° C., more preferably 50 to 90° C., and even more preferably 60 to 80° C. The preheating time is preferably 30 seconds to 15 minutes, more preferably 1 to 10 minutes, and even more preferably 2 to 5 minutes. Air blowing can be generally performed by blowing either ordinary-temperature air, or air heated to 25 to 80° C., over the coated surface of the substrate for 30 seconds to 15 minutes.

When the first colored coating film is subjected to preheating, air blowing, or the like, before application of the aqueous second colored coating composition (Y), it is preferable that the first colored coating film be prepared so as to have a solids content of 60 to 100 mass %, more preferably 80 to 100 mass %, and even more preferably 90 to 100 mass %.

Aqueous Second Colored Coating Composition (Y)

An aqueous second colored coating composition generally contains a film-forming resin (C) and a copolymer (D).

Film-Forming Resin (C)

As a film-forming resin (C), it is possible to use water-soluble or water-dispersible film-forming resins that are known per se and that have been used as a binder component of aqueous coating compositions. Examples of the film-forming resin (C) include acrylic resin, polyester resin, alkyd resin, silicon resin, fluororesin, epoxy resin, polyurethane resin, etc.

The film-forming resin (C) is preferably a water-dispersible film-forming resin because water-dispersible film-forming resins enable formation of a coating film that has superior appearance with excellent DOI, superior flip-flop property, and suppressed metallic mottling, and excellent water resistance. Water-dispersible film-forming resins are generally obtained by dispersing a relatively hydrophobic film-forming resin in an aqueous medium, thus enabling formation of a coating film that has superior water resistance compared with highly hydrophilic water-soluble film-forming resins. Further, because of the hydrophobic side chain, a copolymer (D) develops viscosity by forming a network structure with the relatively hydrophobic film-forming resin, thus enabling formation of a coating film that has superior appearance with excellent DOI, excellent flip-flop property, and suppressed metallic mottling.

In view of storage stability of the resulting coating composition, the water-dispersible film-forming resin is preferably a film-forming resin that is rendered water-dispersible by a surfactant.

For example, an acrylic resin produced by an emulsion polymerization method that uses a surfactant can be suitably used as the film-forming resin that is rendered water-dispersible by a surfactant.

In view of DOI, the flip-flop property, and metallic mottling of the resulting coating film, the film-forming resin (C) is preferably a resin that includes an ester bond. For example, a copolymer obtainable by polymerizing a monomer mixture that includes ester bond-containing polymerizable unsaturated monomers, acrylic resin, polyester resin, etc., can be suitably used as the ester bond-containing resin. Among these, acrylic resin is preferable.

It is preferable that the film-forming resin (C) contains a crosslinkable functional group, such as hydroxy, carboxy, and epoxy.

It is preferable that the aqueous second colored coating composition (Y) further contains a curing agent described later. When the aqueous second colored coating composition (Y) contains a curing agent, a resin (base resin) that contains a crosslinking functional group such as hydroxy, carboxy, epoxy, etc., and that can form a cured coating by reaction with the curing agent, is generally used as the film-forming resin (C).

Examples of the base resin include acrylic resin, polyester resin, alkyd resin, and polyurethane resin. The base resin is preferably a hydroxy-containing resin, more preferably a hydroxy-containing acrylic resin (C1) and/or a hydroxy-containing polyester resin (C2). To improve DOI and luster of the resulting coating film, it is preferable that the hydroxy-containing acrylic resin (C1) and the hydroxy-containing polyester resin (C2) be used together. When used together, the amount of the hydroxy-containing acrylic resin (C1) is preferably about 20 to 80 mass %, particularly about 30 to 70 mass %, and the amount of the hydroxy-containing polyester resin (C2) is preferably about 80 to 20 mass %, particularly about 70 to 30 mass %, based on the total amount of these resins.

When an acid group such as a carboxy group is contained, the film-forming resin (C) preferably has an acid value of about 5 to 150 mg KOH/g, more preferably about 10 to 100 mg KOH/g, even more preferably about 15 to 80 mg KOH/g. When a hydroxy group is contained, the resin (C) preferably has a hydroxy value of about 1 to 200 mg KOH/g, more preferably about 2 to 180 mg KOH/g, even more preferably about 5 to 170 mg KOH/g.

Hydroxy-Containing Acrylic Resin (C1)

The hydroxy-containing acrylic resin (C1) can be produced by copolymerizing, for example, a hydroxy-containing polymerizable unsaturated monomer and other polymerizable unsaturated monomers copolymerizable with the hydroxy-containing polymerizable unsaturated monomer, using methods known per se, such as a solution polymerization method in an organic solvent, an emulsion polymerization method in water, or a miniemulsion polymerization method in water. When the resin is used as a film-forming resin for aqueous coating compositions, an emulsion polymerization method in water is preferable because this method requires fewer steps to produce the resin.

The hydroxy-containing polymerizable unsaturated monomer is a compound that contains one or more hydroxy groups and one or more polymerizable unsaturated bonds per molecule. Examples of the hydroxy-containing polymerizable unsaturated monomer include monoesterified products of (meth)acrylic acid with a dihydric alcohol having 2 to 8 carbon atoms (e.g., 2-hydroxyethyl (meth)acrylate, 2-hydroxypropyl (meth)acrylate, 3-hydroxypropyl (meth)acrylate, and 4-hydroxybutyl (meth)acrylate); ϵ-caprolactone modified products of such monoesterified products of (meth) acrylic acid with a dihydric alcohol having 2 to 8 carbon atoms; polyoxyalkylene glycol modified products of such monoesterified products of (meth)acrylic acid with a dihydric alcohol having 2 to 8 carbon atoms; N-hydroxymethyl (meth) acrylamide; allyl alcohol; (meth)acrylates that include hydroxy-terminated polyoxyethylene chains; and the like. These may be used singly or in a combination of two or more.

Preferably, the hydroxy-containing polymerizable unsaturated monomer is a hydroxy-containing polymerizable unsaturated monomer having an ester bond, in terms of improving smoothness, DOI, luster, flip-flop property, etc., of the resulting coating film, and suppressing metallic mottling of the resulting coating film. Examples of such hydroxy-containing polymerizable unsaturated monomers having an ester bond include monoesterified products of (meth)acrylic acid with a dihydric alcohol having 2 to 8 carbon atoms (e.g., 2-hydroxyethyl (meth)acrylate, 2-hydroxypropyl (meth) acrylate, 3-hydroxypropyl (meth)acrylate, and 4-hydroxybutyl (meth)acrylate); ϵ-caprolactone modified products of such monoesterified products of (meth)acrylic acid with a dihydric alcohol having 2 to 8 carbon atoms; and polyoxyalkylene glycol modified products of such monoesterified products of (meth)acrylic acid with a dihydric alcohol having 2 to 8 carbon atoms. Of these, monoesterified products of (meth) acrylic acid with a dihydric alcohol having 2 to 8 carbon atoms are preferable, and 2-hydroxyethyl (meth)acrylate, 2-hydroxypropyl (meth)acrylate, 3-hydroxypropyl (meth) acrylate, and 4-hydroxybutyl (meth)acrylate are further preferred.

The other polymerizable unsaturated monomers copolymerizable with the hydroxy-containing polymerizable unsaturated monomer may be, for example, the polymerizable unsaturated monomers (i) to (xx) listed in the examples above as the other polymerizable unsaturated monomers copolymerizable with the hydroxy-containing polymerizable unsaturated monomer, in the description of the water-dispersible hydroxy-containing acrylic resin (A2). Such polymerizable unsaturated monomers may be used singly or in a combination of two or more.

The hydroxy-containing acrylic resin (C1) preferably contains an amide group. The hydroxy-containing acrylic resin containing an amide group can be produced by using, for example, an amide-containing polymerizable unsaturated monomer, such as (meth)acrylamide, N,N-dimethylaminopropyl (meth)acrylamide, methylenebis (meth)acrylamide, or ethylenebis (meth)acrylamide, as one of the other polymerizable unsaturated monomers polymerizable with the hydroxy-containing polymerizable unsaturated monomer.

The amount of the hydroxy-containing polymerizable unsaturated monomer used to produce the hydroxy-containing acrylic resin (C1) is preferably about 1 to 50 mass, more preferably about 2 to 40 mass, even more preferably about 3 to 30 mass %, based on the total amount of the monomer component (c1).

In view of storage stability of the coating composition and water resistance, etc., of the resulting coating film, the hydroxy-containing acrylic resin (C1) has an acid value of preferably about 0.1 to 200 mg KOH/g, more preferably about 2 to 150 mg KOH/g, and further preferably about 5 to 100 mg KOH/g.

Further, in view of water resistance, etc., of the resulting coating film, the hydroxy-containing acrylic resin (C1) has a hydroxy value of preferably about 0.1 to 200 mg KOH/g, more preferably about 2 to 150 mg KOH/g, and even more preferably about 5 to 100 mg KOH/g.

A preferable example of the hydroxy-containing acrylic resin (C1) is a water-dispersible hydroxy-containing acrylic resin (C1) having an acid value of 1 to 100 mg KOH/g and a hydroxy value of 1 to 100 mg KOH/g, obtainable by copolymerizing the monomer component (c1) comprising (c1-1) 5 to 70 mass % of a hydrophobic polymerizable unsaturated monomer, (c1-2) 0.1 to 25 mass % of a hydroxy-containing polymerizable unsaturated monomer, (c1-3) 0.1 to 20 mass % of a carboxy-containing polymerizable unsaturated monomer, and (c1-4) 0 to 94.8 mass % of a polymerizable unsaturated monomer other than the polymerizable unsaturated monomers (c1-1) to (c1-3). By using this water-dispersible hydroxy-containing acrylic resin (C1) in the coating composition as a hydroxy-containing acrylic resin (C1), it is possible to form a coating film excellent in smoothness, DOI, and water resistance; moreover, when the coating composition further contains an effect pigment, it is possible to form a coating film having an excellent luster, with reduced metallic mottling and a superior flip-flop property.

Hydrophobic Polymerizable Unsaturated Monomer (c1-1)

A hydrophobic polymerizable unsaturated monomer (c1-1) is a polymerizable unsaturated monomer that has a linear, branched, or cyclic, saturated or unsaturated hydrocarbon group of 4 or more carbon atoms, preferably 6 to 18 carbon atoms, excluding monomers having a hydrophilic group, such as hydroxy-containing polymerizable unsaturated monomers. Examples of such monomers include alkyl or cycloalkyl (meth)acrylates such as n-butyl (meth)acrylate, isobutyl (meth)acrylate, tert-butyl (meth)acrylate, pentyl (meth)acrylate, hexyl (meth)acrylate, octyl (meth)acrylate, 2-ethylhexyl (meth)acrylate, nonyl (meth)acrylate, tridecyl (meth)acrylate, lauryl (meth)acrylate, stearyl (meth)acrylate, isostearyl (meth)acrylate, cyclohexyl (meth)acrylate, methyl cyclohexyl (meth)acrylate, tert-butyl cyclohexyl (meth)acrylate, cyclododecyl (meth)acrylate, tricyclodecanyl (meth) acrylate, etc.; isobornyl-containing polymerizable unsaturated compounds, such as isobornyl (meth)acrylate, etc.; adamantyl-containing polymerizable unsaturated compounds, such as adamantyl (meth)acrylate, etc.; and aromatic-ring-containing polymerizable unsaturated monomers such as benzyl (meth)acrylate, styrene, α-methyl styrene, vinyl toluene, etc. These monomers may be used singly or in a combination of two or more.

In terms of improving the smoothness, DOI, luster, and waterproofing of the resulting coating film, the hydrophobic polymerizable unsaturated monomer (c1-1) is preferably at least one type of polymerizable unsaturated monomer selected from the group consisting of n-butyl (meth)acrylate, 2-ethylhexyl (meth)acrylate, and styrene.

Hydroxy-Containing Polymerizable Unsaturated Monomer (c1-2)

A hydroxy-containing polymerizable unsaturated monomer (c1-2) improves the stability of the resulting water-dispersible hydroxy-containing acrylic resin (C1) in an aqueous medium. Further, when a compound that is reactive with a hydroxy group is used as the curing agent described later, a coating film with excellent water resistance can be formed in which the water-dispersible hydroxy-containing acrylic resin (C1) and the curing agent are crosslinked. Examples of the hydroxy-containing polymerizable unsaturated monomer (c1-2) include monoesterified products of (meth)acrylic acid with a dihydric alcohol having 2 to 8 carbon atoms (e.g., 2-hydroxyethyl (meth)acrylate, 2-hydroxypropyl (meth) acrylate, 3-hydroxypropyl (meth)acrylate, and 4-hydroxybutyl (meth)acrylate); ϵ-caprolactone modified products of such monoesterified products of (meth)acrylic acid with a dihydric alcohol having 2 to 8 carbon atoms; N-hydroxymethyl (meth) acrylamide; allyl alcohol; (meth)acrylates that include hydroxy-terminated polyoxyethylene chains; etc.

Carboxy-Containing Polymerizable Unsaturated Monomer (c1-3)

A carboxy-containing polymerizable unsaturated monomer (c1-3) improves the stability of the resulting water-dispersible hydroxy-containing acrylic resin (C1) in an aqueous medium. Further, when a compound that is reactive with a carboxy group is used as the curing agent described later, a coating film with excellent water resistance can be formed in which the water-dispersible hydroxy-containing acrylic resin (C1) and the curing agent are crosslinked.

Examples of the carboxy-containing polymerizable unsaturated monomer (c1-3) include (meth)acrylic acid, maleic acid, crotonic acid, β-carboxyethyl acrylate, etc. These monomers may be used singly or in a combination of two or more.

In view of stability of the resulting water-dispersible hydroxy-containing acrylic resin (C1) in an aqueous medium, the carboxy-containing polymerizable unsaturated monomer (c1-3) is preferably acrylic acid and/or methacrylic acid.

Polymerizable Unsaturated Monomer (c1-4) Other than Polymerizable Unsaturated Monomers (c1-1) to (c1-3)

The monomer component (c1) may comprise a polymerizable unsaturated monomer (c1-4) other than the hydrophobic polymerizable unsaturated monomer (c1-1), the hydroxy-containing polymerizable unsaturated monomer (c1-2), and the carboxy-containing polymerizable unsaturated monomer (c1-3), in addition to these polymerizable unsaturated monomers (c1-1) to (c1-3).

The polymerizable unsaturated monomer (c1-4) can be suitably selected according to the properties required of the water-dispersible hydroxy-containing acrylic resin (C1). Specific examples of the polymerizable unsaturated monomer (c1-4) are listed below. These may be used singly, or in a combination of two or more.

Examples of the polymerizable unsaturated monomer (c1-4) include alkyl(meth)acrylates of 3 carbon atoms or less, such as methyl (meth)acrylate, ethyl (meth)acrylate, n-propyl (meth)acrylate, isopropyl (meth)acrylate, etc.; nitrogen-containing polymerizable unsaturated monomers such as (meth) acrylonitrile, (meth)acrylamide, methylene bis(meth)acrylamide, ethylene bis(meth)acrylamide, 2-(methacryloyloxy) ethyl trimethyl ammonium chloride, and an adduct of glycidyl (meth)acrylate with amine compounds, etc.; polymerizable unsaturated monomers that contain at least two polymerizable unsaturated groups per molecule, such as allyl (meth)acrylate, 1,6-hexanediol di(meth)acrylate, etc.; epoxy-containing polymerizable unsaturated monomers such as glycidyl (meth)acrylate, β-methylglycidyl (meth)acrylate, 3,4-epoxycyclohexylmethyl (meth)acrylate, 3,4-epoxycyclohexylethyl (meth)acrylate, 3,4-epoxycyclohexylpropyl (meth)acrylate, allyl glycidyl ether, etc.; (meth)acrylates having alkoxy-terminated polyoxyethylene chains; and sulfonic-acid-group-containing polymerizable unsaturated monomers, such as 2-acrylamide-2-methylpropanesulfonic acid, 2-sulfoethyl (meth)acrylate, allyl sulfonic acid, 4-styrenesulfonic acid, etc., including sodium salts and ammonium salts of these sulfonic acids. These monomers may be used singly or in a combination of two or more.

In view of smoothness, DOI, luster, and water resistance of the resulting coating film, it is preferable that the hydrophobic polymerizable unsaturated monomer (c1-1), the hydroxy-containing polymerizable unsaturated monomer (c1-2), the carboxy-containing polymerizable unsaturated monomer (c1-3), and the polymerizable unsaturated monomer (c1-4) other than the polymerizable unsaturated monomers (c1-1) to (c1-3) be included in the monomer component (c1) in the following proportions, based on the total mass of the monomer component (c1).

Hydrophobic polymerizable unsaturated monomer (c1-1): 5 to 70 mass %, preferably 10 to 65 mass %, further preferably 15 to 60 mass %

Hydroxy-containing polymerizable unsaturated monomer (c1-2): 0.1 to 25 mass %, preferably 0.5 to 15 mass %, further preferably 1 to 10 mass %

Carboxy-containing polymerizable unsaturated monomer (c1-3): 0.1 to 20 mass %, preferably 0.5 to 15 mass %, further preferably 1 to 10 mass %

Polymerizable unsaturated monomer (c1-4) other than polymerizable unsaturated monomers (c1-1) to (c1-3): 0 to 94.8 mass %, preferably 10 to 89 mass %, further preferably 20 to 83 mass %

The water-dispersible hydroxy-containing acrylic resin (C1) can be produced by, for example, copolymerizing the monomer component (c1) comprising the hydrophobic polymerizable unsaturated monomer (c1-1), the hydroxy-containing polymerizable unsaturated monomer (c1-2), the carboxy-containing polymerizable unsaturated monomer (c1-3), and the polymerizable unsaturated monomer (c1-4) other than the polymerizable unsaturated monomers (c1-1) to (c1-3), by using methods known per se. Specifically, for example, a method can be used in which the copolymer after emulsion polymerization, or after solution polymerization in an organic solvent is dispersed in water using a surfactant. An emulsion polymerization method is preferable in terms of improving the stability of the resulting water-dispersible hydroxy-containing acrylic resin (C1) in an aqueous medium. The emulsion polymerization method is a method in which, generally, water-insoluble or poorly water-soluble polymerizable unsaturated monomers are polymerized by being dispersed in water using a surfactant.

The water-dispersible hydroxy-containing acrylic resin (C1) prepared from the starting materials (c1-1) to (c1-3) preferably has an acid value of 1 to 100 mg KOH/g and a hydroxy value of 1 to 100 mg KOH/g. In view of storage stability of the coating composition, and smoothness, distinctness of image, luster, and water resistance of the resulting coating film, the acid value is more preferably 2 to 50 mg KOH/g, and even more preferably 5 to 30 mg KOH/g. Further, in view of smoothness, distinctness of image, luster, and water resistance of the resulting coating film, the hydroxy value is more preferably 2 to 80 mg KOH/g, and even more preferably 5 to 60 mg KOH/g.

The water-dispersible hydroxy-containing acrylic resin (C1) is preferably a core-shell-type water-dispersible acrylic resin (C1'), which has a core-shell structure with a crosslinked core portion, in terms of improving the stability of the resulting water-dispersible hydroxy-containing acrylic resin (C1) in an aqueous medium.

In terms of improving the smoothness, distinctness of image, luster, and water resistance of the resulting coating film, it is preferable that the core-shell-type water-dispersible acrylic resin (C1') comprises, as the core portion, a copolymer (C1'-I) produced with monomer components comprising 0.1 to 30 mass % of a polymerizable unsaturated monomer having two or more polymerizable unsaturated groups per molecule and 70 to 99.9 mass % of a polymerizable unsaturated monomer having one polymerizable unsaturated group per molecule, based on the total mass of monomer components constituting the core portion. It is also preferable that the core-shell-type water-dispersible acrylic resin (C1') is produced with monomer components comprising 5 to 70 mass % of a hydrophobic polymerizable unsaturated monomer (c1-1), 0.1 to 25 mass % of a hydroxy-containing polymerizable unsaturated monomer (c1-2), 0.1 to 20 mass % of a carboxy-containing polymerizable unsaturated monomer (c1-3), and 0 to 94.8 mass % of a polymerizable unsaturated monomer (c1-4) other than the polymerizable unsaturated monomers (c1-1) to (c1-3), based on the total mass of the monomer components constituting the core portion and the shell portion.

Examples of a polymerizable unsaturated monomer that has two or more polymerizable unsaturated groups per molecule and that is used as a monomer for the core copolymer (C1'-I) in the core-shell-type water-dispersible acrylic resin (C1') include allyl (meth)acrylate, ethylene glycol di(meth) acrylate, triethylene glycol di(meth)acrylate, tetraethylene glycol di(meth)acrylate, 1,3-butylene glycol di(meth)acrylate, trimethylol propane tri(meth)acrylate, 1,4-butanediol di(meth)acrylate, neopentyl glycol di(meth)acrylate, 1,6-hexanediol di(meth)acrylate, methylenebis (meth)acrylamide, ethylenebis (meth)acrylamide, pentaerythritol di(meth)acrylate, pentaerythritol tetra(meth)acrylate, glycerol di(meth)acrylate, 1,1,1-tris-hydroxymethylethane di(meth)acrylate, 1,1,1-tris-hydroxymethylethane tri(meth) acrylate, 1,1,1-tris-hydroxymethylpropane tri(meth)acrylate, triallyl isocyanurate, diallyl terephthalate, divinylbenzene, etc. These monomers can be used singly or in a combination of two or more.

The polymerizable unsaturated monomer having two or more polymerizable unsaturated groups per molecule functions to provide a crosslinked structure to the core copolymer (C1'-I). The amount of the polymerizable unsaturated monomer having two or more polymerizable unsaturated groups per molecule can be suitably selected according to the desired degree of crosslinking of the core copolymer (C1'-I); the amount thereof is preferably about 0.1 to 30 mass %, more preferably about 0.5 to 10 mass %, and even more preferably about 1 to 7 mass %, based on the total mass of the polymerizable unsaturated monomer having two or more polymerizable unsaturated groups per molecule and the polymerizable unsaturated monomer having one polymerizable unsaturated group per molecule mentioned below.

To suppress metallic mottling of the resulting coating film, it is preferable to use an amide-containing monomer, such as methylene bis(meth)acrylamide, ethylene bis(meth)acrylamide, etc., in the polymerizable unsaturated monomer having two or more polymerizable unsaturated groups per molecule. The amount of amide-containing monomer, when used, is preferably about 0.1 to 25 parts by mass, more preferably about 0.5 to 8 parts by mass, and even more preferably about 1 to 4 parts by mass, based on the total amount of the polymerizable unsaturated monomer having two or more polymerizable unsaturated groups per molecule and the unsaturated monomer having one polymerizable unsaturated group per molecule.

The polymerizable unsaturated monomer having one polymerizable unsaturated group per molecule, which is used as a monomer for the core copolymer (C1'-I) of the core-shell-type water-dispersible acrylic resin (C1'), is a polymerizable unsaturated monomer copolymerizable with the polymerizable unsaturated monomer having two or more polymerizable unsaturated groups per molecule.

Specific examples of the polymerizable unsaturated monomer having one polymerizable unsaturated group per molecule include alkyl or cycloalkyl (meth)acrylates such as methyl (meth)acrylate, ethyl (meth)acrylate, n-propyl (meth) acrylate, isopropyl (meth)acrylate, n-butyl (meth)acrylate, isobutyl (meth)acrylate, tert-butyl (meth)acrylate, n-hexyl (meth)acrylate, n-octyl (meth)acrylate, 2-ethylhexyl (meth) acrylate, nonyl (meth)acrylate, tridecyl (meth)acrylate, lauryl (meth)acrylate, stearyl (meth)acrylate, isostearyl (meth)acrylate, cyclohexyl (meth)acrylate, methylcyclohexyl (meth) acrylate, tert-butylcyclohexyl (meth)acrylate, cyclododecyl (meth)acrylate, and tricyclodecanyl (meth)acrylate; isobornyl-containing polymerizable unsaturated monomers such as isobornyl (meth)acrylate; adamantyl-containing polymerizable unsaturated monomers such as adamantyl (meth)acrylate; tricyclodecenyl-containing polymerizable unsaturated monomers such as tricyclodecenyl (meth)acrylate; aromatic-ring-containing polymerizable unsaturated monomers such as benzyl (meth)acrylate, styrene, α-methylstyrene and vinyltoluene; alkoxysilyl-containing polymerizable unsaturated monomers such as vinyltrimethoxysilane, vinyltriethoxysilane, vinyltris(2-methoxyethoxy)silane, γ-(meth)acryloyloxypropyltrimethoxysilane and γ-(meth)acryloyloxypropyltriethoxysilane; perfluoroalkyl (meth)acrylates such as perfluorobutylethyl (meth)acrylate and perfluorooctylethyl (meth)acrylate; fluorinated alkyl-containing polymerizable unsaturated monomers such as fluoroolefins; polymerizable unsaturated monomers having photopolymerizable functional groups such as a maleimide group; vinyl compounds such as N-vinylpyrrolidone, ethylene, butadiene, chloroprene, vinyl propionate and vinyl acetate; hydroxy-containing polymerizable unsaturated monomers such as monoesterified products of (meth)acrylic acid with a dihydric alcohol having 2 to 8 carbon atoms (e.g., 2-hydroxyethyl (meth)acrylate, 2-hydroxypropyl (meth)acrylate, 3-hydroxypropyl (meth)acrylate, and 4-hydroxybutyl (meth)acrylate), ϵ-caprolactone-modified products of such monoesterified products, N-hydroxymethyl (meth)acrylamide, allyl alcohol, and (meth)acrylates that include hydroxy-terminated polyoxyethylene chains; carboxy-containing polymerizable unsaturated monomers such as (meth)acrylic acid, maleic acid, crotonic acid and β-carboxyethyl acrylate; nitrogen-containing polymerizable unsaturated monomers such as (meth)acrylonitrile, (meth)acrylamide, N,N-dimethylaminoethyl (meth)acrylate, N,N-diethylaminoethyl (meth)acrylate, N,N-dimethylaminopropyl (meth)acrylamide, and adducts of glycidyl (meth)acrylate with amine compounds; epoxy-containing polymerizable unsaturated monomers such as glycidyl (meth)acrylate, β-methylglycidyl (meth)acrylate, 3,4-epoxycyclohexylmethyl (meth)acrylate, 3,4-epoxycyclohexylethyl (meth)acrylate, 3,4-epoxycyclohexylpropyl (meth)acrylate, and allyl glycidyl ether; and (meth)acrylates having alkoxy-terminated polyoxyethylene chains. These monomers can be used singly or in a combination of two or more, according to the properties required of the core-shell-type water-dispersible acrylic resin (C1').

The polymerizable unsaturated monomer having one polymerizable unsaturated group per molecule preferably comprises, at least as a part thereof, a polymerizable unsaturated monomer having a $C_1$ or $C_2$ alkyl group.

Examples of the polymerizable unsaturated monomer having a $C_1$ or $C_2$ alkyl group include methyl acrylate, methyl methacrylate, ethyl acrylate, and ethyl methacrylate. These monomers can be used singly or in a combination of two or more.

When the polymerizable unsaturated monomer having one polymerizable unsaturated group per molecule comprises the polymerizable unsaturated monomer having a $C_1$ or $C_2$ alkyl group, the amount of the polymerizable unsaturated monomer having a $C_1$ or $C_2$ alkyl group is preferably about 20 to 99.9 mass %, more preferably about 30 to 99.5 mass %, and even more preferably about 40 to 99 mass %, based on the total mass of the polymerizable unsaturated monomer having one polymerizable unsaturated group per molecule and the polymerizable unsaturated monomer having two or more polymerizable unsaturated groups per molecule, in terms of improving the smoothness, DOI, and luster of the resulting coating film.

The core-shell-type water-dispersible acrylic resin (C1') generally has a mean particle diameter of about 10 to 1,000 nm, and particularly about 20 to 500 nm.

In this specification, the mean particle diameter of the core-shell-type water-dispersible acrylic resin (C1') refers to a value obtained by measurement at 20° C. using a dynamic light-scattering particle diameter distribution analyzer after dilution with deionized water according to a usual method. For example, an N5 Submicron Particle Size Analyzer (product name of Beckman Coulter, Inc.) can be used as the dynamic light-scattering particle diameter distribution analyzer.

To improve the mechanical stability of the particles of the core-shell-type water-dispersible acrylic resin (C1'), acid groups such as carboxy groups of the water-dispersible acrylic resin are preferably neutralized with a neutralizing agent. Any neutralizing agent that can neutralize acid groups can be used. Examples of the neutralizing agent include sodium hydroxide, potassium hydroxide, trimethylamine, 2-(dimethylamino)ethanol, 2-amino-2-methyl-1-propanol, triethylamine, aqueous ammonia, etc. The neutralizing agent is preferably used in an amount such that an aqueous dispersion of a water-dispersible acrylic resin after neutralization has a pH of about 6.5 to 9.0.

More preferably, to improve smoothness, DOI, luster, and water resistance of the resulting coating film, the core-shell-type water-dispersible acrylic resin (C1') is preferably a core-shell-type water-dispersible acrylic resin (C1"), which has as the core portion a copolymer (C1"-I) produced with monomer components comprising 0.1 to 30 mass % of a polymerizable unsaturated monomer having two or more polymerizable unsaturated groups per molecule and 70 to 99.9 mass % of a polymerizable unsaturated monomer having one polymerizable unsaturated group per molecule; and, as the shell portion, a copolymer (C1"-II) produced with monomer components comprising 5 to 80 mass % of a hydrophobic polymerizable unsaturated monomer (c1-1), 0.1 to 50 mass % of hydroxy-containing polymerizable unsaturated monomer (c1-2), 0.1 to 50 mass % of carboxy-containing polymerizable unsaturated monomer (c1-3), and 0 to 94.8 mass % of polymerizable unsaturated monomer (c1-4) other than the polymerizable unsaturated monomers (c1-1) to (c1-3). The ratio of copolymer (C1"-I) to copolymer (C1"-II) in solids content by mass i.e., copolymer (C1"-I)/copolymer (C1"-II), is 5/95 to 95/5. To improve the smoothness, DOI, luster, and water resistance of the resulting coating film, the ratio of copolymer (C1"-I) to copolymer (C1"-II) in solids content by mass is preferably about 50/50 to 85/15, more preferably about 65/35 to 80/20.

The amount of the polymerizable unsaturated monomer having two or more polymerizable unsaturated groups per molecule in the core-shell-type water-dispersible acrylic resin (C1") can be suitably selected according to the desired degree of crosslinking of the core copolymer (C1"-I); the amount is generally preferably 0.1 to 30 mass %, more preferably 0.5 to 10 mass %, and even more preferably 1 to 7 mass %, based on the total amount of the polymerizable unsaturated monomer having two or more polymerizable unsaturated groups per molecule and the unsaturated monomer having one polymerizable unsaturated group per molecule.

In the core-shell-type water-dispersible acrylic resin (C1"), the amounts of hydrophobic polymerizable unsaturated monomer (c1-1), hydroxy-containing polymerizable unsaturated monomer (c1-2), carboxy-containing polymerizable unsaturated monomer (c1-3) and polymerizable unsaturated monomer (c1-4) other than the polymerizable unsaturated monomers (c1-1) to (c1-3) in the shell preferably fall within the following ranges in terms of ensuring stability in an aqueous medium, and in terms of improving the smoothness, DOI, luster, and water resistance of the resulting coating film. The following ranges are based on the total mass of the monomer components constituting the shell.

Hydrophobic polymerizable unsaturated monomer (c1-1): 5 to 80 mass %, preferably 7 to 70 mass %, more preferably 8 to 65 mass %;

Hydroxy-containing polymerizable unsaturated monomer (c1-2): 0.1 to 50 mass %, preferably 4 to 25 mass %, more preferably 7 to 19 mass %;

Carboxy-containing polymerizable unsaturated monomer (c1-3): 0.1 to 50 mass %, preferably 5 to 25 mass %, more preferably 7 to 19 mass %;

Polymerizable unsaturated monomer (c1-4) other than polymerizable unsaturated monomers (c1-1) to (c1-3): 0 to 94.8 mass %, preferably 10 to 84 mass %, more preferably 15 to 78 mass %.

To improve the smoothness, DOI, and luster of the resulting coating film, it is preferable not to use the polymerizable unsaturated monomers having two or more polymerizable unsaturated groups per molecule as the other polymerizable unsaturated monomers for the shell copolymer (C1"-II), thus forming an uncrosslinked copolymer (C1"-II).

The core-shell-type water-dispersible acrylic resin (C1") can be prepared by a process comprising: subjecting to emulsion polymerization a monomer mixture of about 0.1 to about 30 mass % of a polymerizable unsaturated monomer having two or more polymerizable unsaturated groups per molecule, and about 70 to about 99.9 mass % of a polymerizable unsaturated monomer having one polymerizable unsaturated group per molecule to form an emulsion of a core copolymer (C1"-I); adding to this emulsion a monomer mixture of 5 to 80 mass % of a hydrophobic polymerizable unsaturated monomer (c1-1), 0.1 to 50 mass % of a hydroxy-containing polymerizable unsaturated monomer (c1-2), 0.1 to 50 mass % of a carboxy-containing polymerizable unsaturated monomer (c1-3), and about 0 to 94.8 mass % of a polymerizable unsaturated monomer (c1-4) other than the polymerizable unsaturated monomers (c1-1) to (c1-3); and further performing emulsion polymerization to form a shell copolymer (C1"-II).

The emulsion polymerization for preparing an emulsion of the core copolymer (C1"-I) can be performed according to known methods. For example, the emulsion can be prepared by subjecting the monomer mixture to emulsion polymerization in the presence of a surfactant using a polymerization initiator.

For the surfactant, anionic surfactants and nonionic surfactants are suitable. Examples of anionic surfactants include sodium salts and ammonium salts of alkylsulfonic acids, alkylbenzenesulfonic acids, alkylphosphoric acids, etc. Examples of nonionic surfactants include polyoxyethylene oleyl ether, polyoxyethylene stearyl ether, polyoxyethylene lauryl ether, polyoxyethylene tridecyl ether, polyoxyethylene phenyl ether, polyoxyethylene nonylphenyl ether, polyoxyethylene octylphenyl ether, polyoxyethylene monolaurate, polyoxyethylene monostearate, polyoxyethylene monooleate, sorbitan monolaurate, sorbitan monostearate, sorbitan trioleate, polyoxyethylene sorbitan monolaurate, etc.

Other examples of usable surfactants include polyoxyalkylene-containing anionic surfactants that have an anionic group and a polyoxyalkylene group, such as a polyoxyethylene group or a polyoxypropylene group, per molecule; and reactive anionic surfactants that have an anionic group and a radically polymerizable unsaturated group per molecule. Among these, reactive anionic surfactants are preferable.

Examples of reactive anionic surfactants include sodium salts of sulfonic acid compounds having a radically polymerizable unsaturated group, such as allyl, methallyl, (meth) acryloyl, propenyl, or butenyl; ammonium salts of such sulfonic acid compounds; and the like. Among these, ammonium salts of sulfonic acid compounds having a radically polymerizable unsaturated group are preferable in view of the excellent water resistance of the resulting coating film. Examples of commercially available ammonium salts of such sulfonic acid compounds include LATEMUL S-180A (product name of Kao Corporation).

Among the ammonium salts of sulfonic acid compounds having a radically polymerizable unsaturated group, ammonium salts of sulfonic acid compounds having a radically polymerizable unsaturated group and a polyoxyalkylene group are particularly preferable. Commercially available ammonium salts of sulfonic acid compounds having a radically polymerizable unsaturated group and a polyoxyalkylene group include Aqualon KH-10 (product name of Dai-Ichi Kogyo Seiyaku Co., Ltd.), LATEMUL PD-104 (product name of Kao Corporation), Adeka Reasoap SR-1025 (product name of ADEKA Co., Ltd.) etc.

The amount of surfactant is preferably 0.1 to 15 mass %, more preferably 0.5 to 10 mass %, and even more preferably 1 to 5 mass %, based on the total amount of all the monomers used.

Examples of polymerization initiators include organic peroxides such as benzoyl peroxide, octanoyl peroxide, lauroyl peroxide, stearoyl peroxide, cumene hydroperoxide, tert-butyl peroxide, di-tert-amyl peroxide, tert-butylperoxy-2-ethylhexanoate, tert-butyl peroxylaurate, tert-butyl peroxyisopropylcarbonate, tert-butyl peroxyacetate, and diisopropylbenzene hydroperoxide; azo compounds such as azobisisobutyronitrile, azobis(2,4-dimethylvaleronitrile), azobis(2-methylpropionenitrile), azobis(2-methylbutyronitrile), 4,4'-azobis(4-cyanobutanoic acid), dimethyl azobis(2-methyl propionate), and azobis[2-methyl-N-(2-hydroxyethyl)-propionamide], azobis{2-methyl-N-[2-(1-hydroxy butyl)]-propionamide}; persulfates such as potassium persulfate, ammonium persulfate, and sodium persulfate; etc. Such polymerization initiators can be used singly or in a combination of two or more. Redox initiators prepared by combining a polymerization initiator as mentioned above with a reducing agent such as sugar, sodium formaldehyde sulfoxylate, iron complex, etc., may also be used.

The amount of polymerization initiator is generally preferably about 0.1 to 5 mass %, and more preferably about 0.2 to 3 mass %, based on the total mass of the entire monomers used. The method of adding the polymerization initiator is not particularly limited, and can be suitably selected according to the type, amount, etc., of the polymerization initiator used. For example, the polymerization initiator may be incorporated into a monomer mixture or an aqueous medium beforehand, or may be added dropwise or all at once at the time of polymerization.

The core-shell-type water-dispersible acrylic resin (C1") can be obtained by adding to the above-obtained emulsion of the core copolymer (C1"-I) a monomer mixture of a hydrophobic polymerizable unsaturated monomer (c1-1), a hydroxy-containing polymerizable unsaturated monomer (c1-2), a carboxy-containing polymerizable unsaturated monomer (c1-3), and a polymerizable unsaturated monomer (c1-4) other than the polymerizable unsaturated monomers (c1-1) to (c1-3), and further performing polymerization to form a shell copolymer (C1"-II).

The monomer mixture for forming the shell copolymer (C1"-II) may optionally contain other components such as polymerization initiators as mentioned above, chain transfer agents, reducing agents, surfactants, etc. The monomer mixture is preferably added dropwise as a monomer emulsion that is obtained by dispersing the monomer mixture into an aqueous medium, although it may be added dropwise as is. If it is added dropwise as a monomer emulsion, the particle diameter of the monomer emulsion is not particularly limited.

The method for polymerizing the monomer mixture for forming the shell copolymer (C1"-II) comprises, for example, adding the monomer mixture or emulsion of the monomer mixture dropwise to the emulsion of the core copolymer (C1'-I) all at once or gradually, and heating to a suitable temperature while stirring.

The core-shell-type water-dispersible acrylic resin (C1") thus obtained has a multiple-layer structure having, as a core portion, a copolymer (C1"-I) comprising a monomer mixture of a polymerizable unsaturated monomer having two or more polymerizable unsaturated groups per molecule and a polymerizable unsaturated monomer having one polymerizable unsaturated group per molecule, and having, as a shell portion, a copolymer (C1"-II) of a monomer mixture of a hydrophobic polymerizable unsaturated monomer (c1-1), a hydroxy-containing polymerizable unsaturated monomer (c1-2), a carboxy-containing polymerizable unsaturated monomer (c1-3), and a polymerizable unsaturated monomer (c1-4) other than the polymerizable unsaturated monomers (c1-1) to (c1-3).

Hydroxy-Containing Polyester Resin (C2)

The use of a hydroxy-containing polyester resin (C2) as a film-forming resin (C) in the aqueous second colored coating composition (Y) can improve the properties of the resulting coating film such as smoothness, distinctness of image, and water resistance.

A hydroxy-containing polyester resin (C2) can generally be produced by an esterification or transesterification reaction of an acid component with an alcohol component.

As the acid component, components generally used as an acid component in the production of polyester resin can be used. Examples of the acid component include aliphatic polybasic acid, alicyclic polybasic acid, aromatic polybasic acid, etc. The acid components listed in the explanation of the hydroxy-containing polyester resin (A1) can be appropriately used.

As the alcohol component, those listed in the explanation of the hydroxy-containing polyester resin (A1) can be appropriately used.

The method for producing a hydroxy-containing polyester resin (C2) is not particularly limited, and can be used according to a general method. For example, the methods mentioned in the explanation of the hydroxy-containing polyester resin (A1) can be appropriately used.

In the hydroxy-containing polyester resin (C2), to obtain a coating film with excellent smoothness, distinctness of image, and water resistance, the amount of alicyclic polybasic acid in the acid components used as raw materials is preferably about 20 to 100 mol %, more preferably about 25 to 95 mol %, and even more preferably about 30 to 90 mol %, relative to the total amount of the acid components. In particular, it is preferable to use 1,2-cyclohexanedicarboxylic acid and/or 1,2-cyclohexanedicarboxylic anhydride as an alicyclic polybasic acid, in terms of providing a coating film with excellent smoothness and distinctness of images.

The hydroxy-containing polyester resin (C2) preferably has a hydroxy value of about 1 to 200 mg KOH/g, more preferably about 2 to 180 mg KOH/g, and even more preferably about 5 to 170 mg KOH/g. When the hydroxy-containing polyester resin (C2) also has a carboxy group, the acid value of the resin is preferably about 5 to 150 mg KOH/g, more preferably about 10 to 100 mg KOH/g, and even more preferably about 15 to 80 mg KOH/g. The hydroxy-containing polyester resin (C2) preferably has a number average molecular weight of about 500 to 50,000, more preferably about 1,000 to 30,000, and even more preferably about 1,200 to 10,000.

The above hydroxy-containing polyester resin (C2) can be neutralized using a basic compound. Examples of basic compounds include hydroxides of alkali metals or alkaline earth metals such as sodium hydroxide, potassium hydroxide, lithium hydroxide, calcium hydroxide, and barium hydroxide; ammonia; primary monoamines such as ethylamine, propylamine, butylamine, benzylamine, monoethanolamine, 2,2-dimethyl-3-amino-1-propanol, 2-aminopropanol, 2-amino-2-methyl-1-propanol, and 3-aminopropanol; secondary monoamines such as diethylamine, diethanolamine, di-n-propanolamine, di-iso-propanolamine, N-methylethanolamine, and N-ethylethanolamine; tertiary monoamines such as dimethylethanolamine, trimethylamine, triethylamine, triisopropylamine, methyldiethanolamine, and 2-(dimethylamino)ethanol; polyamines such as diethylenetriamine, hydroxyethylaminoethylamine, ethylaminoethylamine, and methylaminopropylamine; etc. Such basic compounds can be used singly or in a combination of two or more. It is preferable to use a water-soluble basic compound.

Examples of polyurethane resins include a polyurethane resin obtained by reacting an aliphatic and/or alicyclic diisocyanate, at least one diol selected from the group consisting of polyetherdiol, polyesterdiol and polycarbonatediol, a low molecular weight polyhydroxyl compound and a dimethylol alkanoic acid to form a urethane prepolymer; neutralizing the resulting urethane prepolymer with a tertiary amine; dispersing the neutralized urethane prepolymer to be emulsified; mixing the resulting emulsion with an aqueous medium containing a chain extension agent, a crosslinking agent and/or a quenching agent (e.g., polyamine) as required; and continuing the reaction until the isocyanate group is substantially removed. This method generally produces a self-emulsified polyurethane resin having a mean particle diameter of about 0.001 to 3 μm.

Copolymer (D)

The copolymer (D) can be obtained by copolymerization of monomer component (d) that includes:

(d1) a macromonomer having a backbone that comprises a polymer chain having a number average molecular weight of 1,000 to 10,000 obtainable by polymerizing monomer component (m), which contains 5 to 100 mass % of a $C_{4-24}$ alkyl-containing polymerizable unsaturated monomer (m1), and a polymerizable unsaturated group; and (d2) a polymerizable unsaturated monomer containing a hydrophilic group.

The copolymer (D) has the characteristic of easily developing viscosity and of lowering its viscosity with an increase in rate of shear. Specifically, the copolymer has the characteristic of developing viscosity and of lowering its viscosity with an increase in rate of shear even in an aqueous coating composition that contains a surfactant. With such a superior viscosity characteristic, the copolymer (D) is preferably used as a viscosity-controlling agent. Further, because of the ability to form a coating film having excellent smoothness, distinctness of image, and luster, the copolymer (D) is particularly suitable as a viscosity-controlling agent for coating compositions.

$C_{4-24}$ Alkyl-Containing Polymerizable Unsaturated Monomer (m1)

As the $C_{4-24}$ alkyl-containing polymerizable unsaturated monomer (m1), it is possible to use, for example, monoesterified products of (meth)acrylic acid with a monohydric alcohol having a $C_{4-24}$ alkyl group can be used. Specific examples include alkyl or cycloalkyl (meth)acrylates such as n-butyl (meth)acrylate, isobutyl (meth)acrylate, tert-butyl (meth)acrylate, pentyl (meth)acrylate, hexyl (meth)acrylate, octyl (meth)acrylate, 2-ethylhexyl (meth)acrylate, nonyl (meth)acrylate, dodecyl (meth)acrylate, lauryl (meth)acrylate, tridecyl (meth)acrylate, stearyl (meth)acrylate, isostearyl (meth)acrylate, cyclohexyl (meth)acrylate, methyl cyclohexyl (meth)acrylate, tert-butyl cyclohexyl (meth)acrylate, cyclododecyl (meth)acrylate, isobornyl (meth)acrylate, adamantyl (meth)acrylate, tricyclodecanyl (meth)acrylate, etc. These may be used singly or in a combination of two or more.

In terms of distinctness of image of the resulting coating film, the $C_{4-24}$ alkyl-containing polymerizable unsaturated monomer (m1) is preferably a polymerizable unsaturated monomer having a $C_{6-18}$ alkyl group, more preferably a polymerizable unsaturated monomer having a $C_{8-13}$ alkyl group. 2-Ethylhexyl methacrylate, dodecyl methacrylate, and tridecyl methacrylate are preferable, and 2-ethylhexyl methacrylate is particularly preferable.

Monomer Component (m)

The monomer component (m) contains 5 to 100 parts by mass of the $C_{4-24}$ alkyl-containing polymerizable unsaturated monomer (m1). In terms of distinctness of image of the resulting coating film, it is preferable that the content of the $C_{4-24}$ alkyl-containing polymerizable unsaturated monomer (m1) in the monomer component (m) be 30 to 95 mass %, preferably 45 to 90 mass %, further preferably 55 to 85 mass %.

The monomer component (m) may also contain a polymerizable unsaturated monomer (m2), in addition to the $C_{4-24}$ alkyl-containing polymerizable unsaturated monomer (m1). If it does, the monomer component (m) includes the $C_{4-24}$ alkyl-containing polymerizable unsaturated monomer (m1), and a polymerizable unsaturated monomer (m2) that is different from the $C_{4-24}$ alkyl-containing polymerizable unsaturated monomer (m1).

Examples of the polymerizable unsaturated monomer (m2) that is different from the $C_{4-24}$ alkyl-containing polymerizable unsaturated monomer (m1) include alkyl (meth)acrylates having a $C_{1-3}$ alkyl group, such as methyl (meth)acrylate, ethyl (meth)acrylate, n-propyl (meth)acrylate, isopropyl (meth)acrylate, etc.; aromatic ring-containing polymerizable unsaturated monomers such as benzyl (meth)acrylate, styrene, α-methyl styrene, vinyl toluene, etc.; polymerizable unsaturated monomers having an alkoxysilyl group, such as vinyltrimethoxysilane, vinyltriethoxysilane, vinyl tris(2-methoxyethoxy)silane, γ-(meth)acryloyloxypropyltrimethoxysilane, γ-(meth)acryloyloxypropyltriethoxysilane, etc.; perfluoroalkyl (meth)acrylates such as perfluorobutylethyl (meth)acrylate, perfluorooctylethyl (meth)acrylate, etc.; polymerizable unsaturated monomers having a fluorinated alkyl group, such as fluoroolefin, etc.; polymerizable unsaturated monomers having a photopolymerizable functional group, such as a maleimide group, etc.; vinyl compounds such as N-vinyl-2-pyrrolidone, ethylene, butadiene, chloroprene, vinyl propionate, vinyl acetate, etc.; hydroxy-containing polymerizable unsaturated monomers such as monoesterified products of (meth)acrylic acid with a dihydric alcohol having 2 to 8 carbon atoms (e.g., 2-hydroxyethyl (meth)acrylate, 2-hydroxypropyl (meth)acrylate, 3-hydroxypropyl (meth)acrylate, and 4-hydroxybutyl (meth)acrylate), ε-caprolactone modified products of the monoesterified products of (meth)acrylic acid with a dihydric alcohol having 2 to 8 carbon atoms, N-hydroxymethyl (meth)acrylamide, allyl alcohol, (meth)acrylates having hydroxy-terminated polyoxyethylene chains, etc.; carboxy-containing polymerizable unsaturated monomers such as (meth)acrylic acid, maleic acid, crotonic acid, β-carboxyethyl acrylate, etc.; polymerizable unsaturated monomers having at least two polymerizable unsaturated groups per molecule, such as allyl(meth) acrylate, ethylene glycol di(meth)acrylate, triethylene glycol di(meth)acrylate, tetraethylene glycol di(meth)acrylate, 1,3-butylene glycol di(meth)acrylate, trimethylolpropane tri (meth)acrylate, 1,4-butanediol di(meth)acrylate, neopentyl glycol di(meth)acrylate, 1,6-hexanediol di(meth)acrylate, pentaerythritol di(meth)acrylate, pentaerythritol tetra(meth) acrylate, glycerol di(meth)acrylate, 1,1,1-trishydroxymethylethane di(meth)acrylate, 1,1,1-trishydroxymethylethane tri (meth)acrylate, 1,1,1-trishydroxymethylpropane tri(meth) acrylate, triallyl isocyanurate, diallyl terephthalate, divinylbenzene, etc.; nitrogen-containing polymerizable unsaturated monomers such as (meth)acrylonitrile, (meth) acrylamide, N,N-dimethylaminoethyl (meth)acrylate, N,N-diethylaminoethyl (meth)acrylate, N,N-dimethylaminopropyl (meth)acrylamide, an adduct of glycidyl (meth)acrylate with amine compounds, etc.; epoxy-containing polymerizable unsaturated monomers such as glycidyl (meth)acrylate, β-methylglycidyl (meth)acrylate, 3,4-epoxycyclohexylmethyl (meth)acrylate, 3,4-epoxycyclohexylethyl (meth)acrylate, 3,4-epoxycyclohexylpropyl (meth)acrylate, allyl glycidyl ether, etc.; isocyanato-containing polymerizable unsaturated monomers such as 2-isocyanatoethyl (meth) acrylate, m-isopropenyl-α,α-dimethyl benzyl isocyanate, etc.; (meth)acrylates having alkoxy-terminated polyoxyethylene chains; and carbonyl-containing polymerizable unsaturated monomers such as acrolein, diacetone acrylamide, diacetone methacrylamide, acetoacetoxylethyl methacrylate, formyl styrol, vinyl alkyl ketone having 4 to 7 carbon atoms (for example, vinyl methyl ketone, vinyl ethyl ketone, and vinyl butyl ketone), etc. These polymerizable unsaturated monomers may be used singly or in a combination of two or more.

In terms of distinctness of image and water resistance of the resulting coating film, it is preferable that the monomer component (m) at least partially include a hydroxy-containing polymerizable unsaturated monomer (m3). Specifically, it is preferable that the polymerizable unsaturated monomer (m2) different from the $C_{4-24}$ alkyl-containing polymerizable unsaturated monomer (m1) at least partially include a hydroxy-containing polymerizable unsaturated monomer (m3).

The hydroxy-containing polymerizable unsaturated monomer (m3) may be, for example, those listed in the examples above in conjunction with the polymerizable unsaturated monomer (m2) that is different from the $C_{4-24}$ alkyl-containing polymerizable unsaturated monomer (m1). These monomers may be used singly or in a combination of two or more.

Preferable as the hydroxy-containing polymerizable unsaturated monomer (m3) are 2-hydroxyethyl (meth)acrylate, 2-hydroxypropyl (meth)acrylate, 3-hydroxypropyl (meth) acrylate, and 4-hydroxybutyl (meth)acrylate.

When contained in the monomer component (m), it is preferable that the hydroxy-containing polymerizable unsaturated monomer (m3) be used in 5 to 60 mass %, preferably 10 to 45 mass %, further preferably 15 to 30 mass %, based on the total mass of the monomer component (m), in terms of distinctness of image and water resistance of the resulting coating film.

Further, when the monomer component (m) contains the hydroxy-containing polymerizable unsaturated monomer (m3), it is preferable that the polymer obtained by polymerizing the monomer component (m) have a hydroxy value of 20 to 260 mg KOH/g, preferably 40 to 200 mg KOH/g, further preferably 60 to 130 mg KOH/g, in terms of distinctness of image and water resistance of the resulting coating film.

Macromonomer (d1)

The macromonomer (d1) includes a polymer chain and a polymerizable unsaturated group. The polymer chain is a polymer chain having a number average molecular weight of 1,000 to 10,000 obtainable by polymerizing the monomer component (m), which contains the $C_{4-24}$ alkyl-containing polymerizable unsaturated monomer (m1). In the present invention, the macromonomer is a high-molecular-weight monomer having a polymerizable unsaturated group, preferably at the polymer end. In other words, the macromonomer (d1) is structured to include a polymer chain backbone, and at least one, and preferably one, polymerizable unsaturated group, preferably at the end of the polymer chain.

As used herein, the polymerizable unsaturated group contained in the macromonomer (d1) means an unsaturated group that can undergo radical polymerization. Examples of such polymerizable unsaturated groups include vinyl groups, vinylidene groups, acryloyl groups, and methacryloyl groups.

The macromonomer (d1) preferably has a number average molecular weight of 1,000 to 10,100. In terms of distinctness of image of the resulting coating film, a number average molecular weight of 1,000 to 5,000, more preferably 1,000 to 3,000, is preferable. The number average molecular weight of the macromonomer (d1) can be adjusted by, for example, the amount of chain transfer agent, the amount of polymerization initiator, reaction temperature, and reaction time used for the polymerization of the monomer component (m).

The macromonomer (d1) can be obtained by methods known per se. Specifically, for example, the following methods (1), (2), and (3) can be used.

Method (1)

The monomer component (m) is polymerized in the presence of a chain transfer agent that contains a first chemically reactive group such as a carboxy group, a hydroxy group, an amino group, etc., so as to introduce the first chemically reactive group at the polymer end. The polymer is then allowed to react with a polymerizable unsaturated monomer that has a second chemically reactive group that can react with the first chemically reactive group of the polymer, so as to obtain the macromonomer (d1).

Mercaptoacetic acid, 2-mercaptopropionic acid, 3-mercaptopropionic acid, 2-mercaptoethanol, and 2-aminoethanethiol can be suitably used as the chain transfer agent that has the first chemically reactive group such as a carboxy group, a hydroxy group, an amino group, etc.

The polymerizable unsaturated monomer having a second chemically reactive group that reacts with the first chemically reactive group in the copolymer (D) to introduce the polymerizable unsaturated group may preferably be, for example, an epoxy-containing polymerizable unsaturated monomer when the first chemically reactive group is a carboxy group, an isocyanato-containing polymerizable unsaturated monomer when the first chemically reactive group is a hydroxy group, or an epoxy-containing polymerizable unsaturated monomer when the first chemically reactive group is an amino group.

Glycidyl acrylate and glycidyl methacrylate, for example, can be suitably used as the epoxy-containing polymerizable unsaturated monomer. Further, as the isocyanato-containing polymerizable unsaturated monomer, it is possible to suitably use, for example, isocyanatoethyl acrylate, isocyanatoethyl methacrylate, m-isopropenyl-α,α-dimethyl benzyl isocyanate, etc.

Method (2)

The macromonomer (d1) can be obtained by catalytic chain transfer polymerization (CCTP method) that uses a metal complex. The CCTP method is described in, for example, Japanese Unexamined Patent Publications No. 1994-23209, 1995-35411, 1997-501457, 1997-176256, and Macromolecules 1996, 29, 8083 to 8089. Specifically, the macromonomer (d1) can be produced by the catalytic chain transfer polymerization of the monomer component (m) in the presence of a metal complex. The catalytic chain transfer polymerization can be performed using, for example, a solution polymerization method in an organic solvent, or an emulsion polymerization method in water. As required, a radical polymerization initiator may be used for the polymerization, in addition to the metal complex.

Examples of the metal complex include a cobalt complex, an iron complex, a nickel complex, a ruthenium complex, a rhodium complex, a palladium complex, a rhenium complex, an iridium complex, etc. The cobalt complex efficiently exhibits the catalytic chain transfer effect. The amount of metal complex used is not particularly limited, and is generally $1\times10^{-6}$ to 1 mass %, preferably $1\times10^{-4}$ to 0.5 mass %, based on the total mass of the monomer component (m).

Examples of the radical polymerization initiator include organic peroxides such as benzoyl peroxide, octanoyl peroxide, lauroyl peroxide, stearoyl peroxide, cumene hydroperoxide, tert-butyl peroxide, di-tert-amylperoxide, tert-butylperoxy-2-ethylhexanoate, tert-butylperoxy laurate, tert-butylperoxy isopropyl carbonate, tert-butylperoxy acetate, diisopropylbenzene hydroperoxide, etc.; azo compounds such as azobisisobutyronitrile, azobis(2,4-dimethylvaleronitrile), azobis(2-methylpropionitrile), azobis(2-methylbutyronitrile), 4,4'-azobis(4-cyanobutanoic acid), dimethyl azobis(2-methyl propionate), azobis[2-methyl-N-(2-hydroxyethyl)-propionamide], azobis(2-methyl-N-[2-(1-hydroxybutyl)]-propionamide), etc.; and persulfates such as potassium persulfate, ammonium persulfate, sodium persulfate, etc. These polymerization initiators may be used singly or in a combination of two or more. The content of the radical polymerization initiator is not particularly limited, and is generally 0.1 to 10 mass %, preferably 0.1 to 8 mass %, further preferably 0.1 to 6 mass %, based on the total mass of the monomer component (m).

Method (3)

The macromonomer (d1) can be obtained by addition-fragmentation chain transfer polymerization that uses an addition-fragmentation chain transfer agent. Addition-fragmentation chain transfer polymerization is described in, for example, Japanese Unexamined Patent Publication No. 1995-2954. Specifically, the macromonomer (d1) can be produced by the addition-fragmentation chain transfer polymerization of the monomer component (m) in the presence of an addition-fragmentation chain transfer agent. The addition-fragmentation chain transfer polymerization can be performed using, for example, a solution polymerization method in an organic solvent, or an emulsion polymerization method in water. As required, a radical polymerization initiator may be used for the polymerization, in addition to the addition-fragmentation chain transfer agent.

2,4-Diphenyl-4-methyl-1-pentene ("α-methyl styrene dimer", also known as "MSD") can be suitably used as the addition-fragmentation chain transfer agent. The content of the addition-fragmentation chain transfer agent is not particularly limited, and is generally 1 to 20 mass %, preferably 2 to 15 mass %, further preferably 3 to 10 mass %, based on the total mass of the monomer component (m).

The radical polymerization initiator mentioned in method (2) above, for example, may be used as the radical polymerization initiator. The polymerization initiators may be used singly or in a combination of two or more. The content of the radical polymerization initiator is not particularly limited, and is generally 1 to 20 mass, preferably 2 to 15 mass, further preferably 3 to 10 mass %, based on the total mass of the monomer component (m).

In methods (1) to (3), although the polymerization temperature varies depending on the type of the radical polymerization initiator, the polymerization temperature is preferably in a range of from 60 to 200° C., more preferably from 80 to 180° C., further preferably from 90 to 170° C. Further, different temperatures may be used in the first half and the second half of polymerization, or polymerization may be performed with gradual changes in temperature.

Of methods (1) to (3) above, method (1) requires a step of polymerizing the monomer component (m) to obtain a polymer, and a step of reacting the polymer with a polymerizable unsaturated monomer to introduce a polymerizable unsaturated group into the polymer. Method (2) uses a metal complex, and thus catalytic chain transfer polymerization may occur during the production of the copolymer (D) (graft polymer) described later, or color may be imparted to the resulting copolymer (D).

Thus, in terms of reducing the number of reaction steps and suppressing the coloring of the resulting copolymer (D), it is preferable to obtain the macromonomer (d1) using method (3), which uses the addition-fragmentation chain transfer polymerization using an addition-fragmentation chain transfer agent.

The macromonomer (d1) can be used singly or in a combination of two or more.

Polymerizable Unsaturated Monomer (d2) Containing a Hydrophilic Group

In the present invention, examples of polymerizable unsaturated monomer (d2) containing a hydrophilic group include N-substituted (meth)acrylamide, polymerizable unsaturated monomer having a polyoxyalkylene chain, N-vinyl-2-pyrrolidone, 2-hydroxyethyl acrylate, carboxy-containing polymerizable unsaturated monomer, sulfonic acid group-containing polymerizable unsaturated monomer, and phosphoric acid group-containing polymerizable unsaturated monomer. These monomers can be used singly or in a combination of two or more. Note that a monomer corresponding to a polymerizable unsaturated monomer including an ultraviolet-absorbing functional group (xiv), which is described later, should be defined as an other polymerizable unsaturated monomer (d3) and excluded from a polymerizable unsaturated monomer (d2) containing a hydrophilic group.

Among these, the polymerizable unsaturated monomer (d2) containing a hydrophilic group may be, for example, at least one type of polymerizable unsaturated monomer selected from the group consisting of N-substituted (meth) acrylamide, a polymerizable unsaturated monomer having a polyoxyalkylene chain, N-vinyl-2-pyrrolidone, 2-hydroxyethyl acrylate, acrylic acid, and methacrylic acid. Of these, at least one polymerizable unsaturated monomer selected from the group consisting of N-substituted acrylamide, 2-hydroxyethyl acrylate, acrylic acid, and methacrylic acid is preferred. These monomers can be used singly or in a combination of two or more.

In terms of the smoothness, distinctness of image, luster, and water resistance of the resulting coating film, the contents of the macromonomer (d1) and the polymerizable unsaturated monomer (d2) containing a hydrophilic group in the monomer component (d) preferably fall within the ranges below, based on the total mass of the monomer component (d):

Macromonomer (d1): 1 to 40 mass, preferably 3 to 29 mass, further preferably 5 to 15 mass, Polymerizable unsaturated monomer (d2) containing a hydrophilic group: 5 to 99 mass, preferably 10 to 97 mass, further preferably 20 to 95 mass.

Examples of the N-substituted (meth)acrylamide include N-methyl acrylamide, N-methyl methacrylamide, N-methylol acrylamide butyl ether, N-methylol methacrylamide butyl ether, N-ethyl acrylamide, N-ethyl methacrylamide, N-n-propyl acrylamide, N-n-propyl methacrylamide, N-isopropylacrylamide, N-isopropyl methacrylamide, N-cyclopropyl acrylamide, N-cyclopropyl methacrylamide, diacetone acrylamide, diacetone methacrylamide, N-hydroxymethyl acrylamide, N-hydroxymethyl methacrylamide, N-hydroxyethyl acrylamide, N-hydroxyethyl methacrylamide, N,N-dimethyl acrylamide, N,N-dimethyl methacrylamide, N,N-diethyl acrylamide, N,N-diethyl methacrylamide, N-methyl,N-ethyl acrylamide, N-methyl,N-ethyl methacrylamide, N,N-dimethylaminopropyl acrylamide, N,N-dimethylaminopropyl methacrylamide, N-methylol acrylamide methyl ether, N-methylol methacrylamide methyl ether, N-methylol acrylamide ethyl ether, N-methylol methacrylamide ethyl ether, N-methylol acrylamide propyl ether, N-methylol methacrylamide propyl ether, acryloyl morpholine, and methacryloyl morpholine. These may be used singly or in a combination of two or more.

In terms of distinctness of image of the resulting coating film, N-n-propyl acrylamide, N-n-propyl methacrylamide, N-isopropyl acrylamide, N-isopropyl methacrylamide, N-hydroxyethyl acrylamide, N-hydroxyethyl methacrylamide, N,N-dimethyl acrylamide, N,N-dimethyl methacrylamide, N,N-diethyl acrylamide, and N,N-diethyl methacrylamide are preferred, and N,N-dimethyl acrylamide and N,N-dimethyl methacrylamide are further preferred.

The polymerizable unsaturated monomer having a polyoxyalkylene chain is a monomer that includes a polyoxyalkylene chain and a polymerizable unsaturated group per molecule.

Examples of the polyoxyalkylene chain include a polyoxyethylene chain, a polyoxypropylene chain, a chain that includes a polyoxyethylene block and a polyoxypropylene block, and a chain that includes randomly linked polyoxyethylene and polyoxypropylene. The polyoxyalkylene chain preferably has a molecular weight of generally about 100 to 5,000, preferably about 200 to 4,000, further preferably about 300 to 3,000.

A representative example of the polymerizable unsaturated monomer having such a polyoxyalkylene chain is, for example, a polymerizable unsaturated monomer of General Formula (1) below.

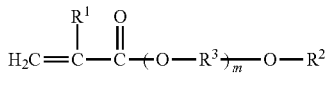

(1)

wherein $R^1$ represents a hydrogen atom or a methyl group; $R^2$ represents a hydrogen atom or a $C_{1-4}$ alkyl group, preferably a hydrogen atom, a methyl group, or an ethyl group, further preferably a hydrogen atom or a methyl group; $R^3$ represents a $C_{2-4}$ alkylene group, preferably a $C_2$ or $C_3$ alkylene group, further preferably a $C_2$ alkylene group; and m is an integer of 3 to 150, preferably 5 to 80, further preferably 8 to 50. In General Formula (1), m oxyalkylene units (O—$R^3$) may be the same or different.

Specific examples of the polymerizable unsaturated monomer represented by General Formula (1) include tetraethylene glycol (meth)acrylate, methoxytetraethylene glycol (meth)acrylate, ethoxytetraethylene glycol (meth)acrylate, n-butoxytriethylene glycol (meth)acrylate, n-butoxytetraethylene glycol (meth)acrylate, tetrapropylene glycol (meth) acrylate, methoxytetrapropylene glycol (meth)acrylate, ethoxytetrapropylene glycol (meth)acrylate, n-butoxytetrapropylene glycol (meth)acrylate, polyethylene glycol (meth) acrylate, polypropylene glycol (meth)acrylate, polyethylene (propylene)glycol (meth)acrylate, methoxypolyethylene glycol (meth)acrylate, ethoxypolyethylene glycol (meth) acrylate, methoxypolypropylene glycol (meth)acrylate, ethoxypolypropylene glycol (meth)acrylate, methoxypolyethylene(propylene)glycol (meth)acrylate, and ethoxypolyethylene(propylene)glycol (meth)acrylate. These may be used singly or in a combination of two or more. As used herein, "polyethylene(propylene)glycol" means a copolymer of ethylene glycol and propylene glycol, including both a block copolymer and a random copolymer.

Of these, polyethylene glycol (meth)acrylate, polyethylene(propylene)glycol (meth)acrylate, methoxypolyethylene glycol (meth)acrylate, and methoxypolyethylene(propylene) glycol (meth)acrylate are preferable, and polyethylene glycol (meth)acrylate and methoxypolyethylene glycol (meth)acrylate are further preferable in terms of distinctness of image of the resulting coating film.

The polymerizable unsaturated monomer having a polyoxyalkylene chain preferably has a molecular weight of generally about 300 to 6,000, preferably about 400 to 5,000, further preferably about 450 to 3,500.

Examples of the carboxy-containing polymerizable unsaturated monomer include (meth)acrylic acid, maleic acid, crotonic acid, and β-carboxy ethyl acrylate. They can be used singly or in a combination of two or more.

Examples of the sulfonic acid group-containing polymerizable unsaturated monomer include 2-acrylamide-2-methylpropanesulfonic acid, 2-sulfoethyl (meth)acrylate, allyl sulfonic acid, and 4-styrenesulfonic acid; and sodium salts and ammonium salts of these sulfonic acids. They can be used singly or in a combination of two or more.

Examples of the phosphoric acid group-containing polymerizable unsaturated monomer include 2-acryloyl oxyethyl acid phosphate, 2-methacryloyloxy ethyl acid phosphate, 2-acryloyloxy propyl acid phosphate, and 2-methacryloyloxy propyl acid phosphate. They can be used singly or in a combination of two or more.

In a preferred embodiment, the polymerizable unsaturated monomer (d2) containing a hydrophilic group may be, for example, at least one type of hydrophilic group-containing nonionic polymerizable unsaturated monomer selected from the group consisting of N-substituted (meth)acrylamide, a polymerizable unsaturated monomer having a polyoxyalkylene chain, and N-vinyl-2-pyrrolidone. These may be used singly or in a combination of two or more. In a preferred embodiment of the present invention, N-substituted (meth) acrylamide is preferable among these monomers, in terms of distinctness of image of the resulting coating film.

In a preferred embodiment of the present invention, the macromonomer (d1) and the nonionic polymerizable unsaturated monomer (d2) containing a hydrophilic group are preferably contained in the proportions below, based on the total mass of the monomer component (d), in terms of the viscosity of the copolymer (D), and distinctness of image of the coating film formed by using the copolymer (D)-containing coating composition.

Macromonomer (d1): 1 to 29 mass %, preferably 3 to 20 mass %, further preferably 5 to 15 mass %

Total Mass of the Nonionic Polymerizable Unsaturated Monomer (d2) Containing a Hydrophilic Group: 20 to 99 mass %, preferably 40 to 97 mass %, further preferably 55 to 95 mass %

In another preferred embodiment, the polymerizable unsaturated monomer (d2) containing a hydrophilic group may be at least one type of polymerizable unsaturated monomer selected from acrylic acid and methacrylic acid. These may be used singly or in a combination of two or more. In another preferred embodiment of the present invention, acrylic acid is preferable among these monomers, in terms of distinctness of image of the resulting coating film.

In another preferred embodiment of the present invention, the macromonomer (d1) and the polymerizable unsaturated monomer (d2) containing a hydrophilic group are preferably contained in the proportions below, based on the total mass of the monomer component (d), in terms of the viscosity of the copolymer (D), distinctness of image of the coating film formed by using the copolymer (D)-containing coating composition, the improvement of the flip-flop property and water resistance, and the suppression of metallic mottling.

Macromonomer (d1): 1 to 40 mass %, preferably 3 to 29 mass %, further preferably 5 to 15 mass %

Total mass of polymerizable unsaturated monomer (d2) containing a hydrophilic group: 5 to 75 mass %, preferably 10 to 60 mass %, further preferably 20 to 50 mass %

Other Polymerizable Unsaturated Monomers (d3)

Other polymerizable unsaturated monomers (d3) are polymerizable unsaturated monomers other than the macromonomer (d1) and the polymerizable unsaturated monomer (d2) containing a hydrophilic group. Other polymerizable unsaturated monomers (d3) can be suitably selected according to the properties required of the copolymer (D).

Specific examples of other polymerizable unsaturated monomers (d3) are listed below. These may be used singly or in a combination of two or more.

(i) Alkyl or cycloalkyl (meth)acrylates: methyl (meth)acrylate, ethyl (meth)acrylate, n-propyl (meth)acrylate, iso-propyl (meth)acrylate, n-butyl (meth)acrylate, iso-butyl (meth) acrylate, tert-butyl (meth)acrylate, n-hexyl (meth)acrylate, n-octyl (meth)acrylate, 2-ethylhexyl (meth)acrylate, nonyl (meth)acrylate, tridecyl (meth)acrylate, lauryl (meth)acrylate, stearyl (meth)acrylate, isostearyl (meth)acrylate, cyclohexyl (meth)acrylate, methylcyclohexyl (meth)acrylate, tert-butylcyclohexyl (meth)acrylate, cyclododecyl (meth) acrylate, tricyclodecanyl (meth)acrylate, etc.

(ii) Polymerizable unsaturated monomers having an isobornyl group: isobornyl (meth)acrylate, etc.

(iii) Polymerizable unsaturated monomers having an adamantyl group: adamantyl (meth)acrylate, etc.

(iv) Polymerizable unsaturated monomer having a tricyclodecenyl group: tricyclodecenyl (meth)acrylate, etc.

(v) Aromatic ring-containing polymerizable unsaturated monomers: benzyl (meth)acrylate, styrene, α-methyl styrene, vinyl toluene, etc.

(vi) Polymerizable unsaturated monomers having an alkoxysilyl group: vinyltrimethoxysilane, vinyltriethoxysilane, vinyltris(2-methoxyethoxy)silane, γ-(meth)acryloyl oxypropyltrimethoxysilane, γ-(meth)acryloyl oxypropyltriethoxysilane, etc.

(vii) Polymerizable unsaturated monomers having a fluorinated alkyl group: perfluoroalkyl (meth)acrylates such as perfluorobutylethyl (meth)acrylate and perfluorooctylethyl (meth)acrylate; fluoroolefin; etc.

(viii) Polymerizable unsaturated monomer having a photopolymerizable functional group, such as a maleimide group, etc.

(ix) Vinyl compounds: ethylene, butadiene, chloroprene, vinyl propionate, vinyl acetate, etc.

(x) Hydroxy-containing polymerizable unsaturated monomers: monoesterified products of (meth)acrylic acid with a dihydric alcohol having 2 to 8 carbon atoms (e.g., 2-hydroxyethyl methacrylate, 2-hydroxypropyl (meth)acrylate, 3-hydroxypropyl (meth)acrylate, and 4-hydroxybutyl (meth)acrylate); ϵ-caprolactone modified products of the monoesterified products of (meth)acrylic acid with a dihydric alcohol having 2 to 8 carbon atoms; and allyl alcohol, etc.

(xi) Nitrogen-containing polymerizable unsaturated monomers: (meth)acrylonitrile, (meth)acrylamide, methylene bis (meth)acrylamide, ethylene bis(meth)acrylamide, 2-(methacryloyloxy)ethyl trimethyl ammonium chloride, and adducts of glycidyl (meth)acrylate with amine compounds, etc.

(xii) Polymerizable unsaturated monomers including at least two polymerizable unsaturated groups per molecule: allyl (meth)acrylate, 1,6-hexanediol di(meth)acrylate, etc.

(xiii) Epoxy-containing polymerizable unsaturated monomers: glycidyl (meth)acrylate, β-methylglycidyl (meth)acrylate, 3,4-epoxycyclohexylmethyl (meth)acrylate, 3,4-epoxycyclohexylethyl (meth)acrylate, 3,4-epoxycyclohexylpropyl (meth)acrylate, allyl glycidyl ether, etc.

(xiv) Polymerizable unsaturated monomers including a ultraviolet-absorbing functional group: 2-hydroxy-4-(3-methacryloyloxy-2-hydroxypropoxy)benzophenone, 2-hydroxy-4-(3-acryloyloxy-2-hydroxypropoxy)benzophenone, 2,2'-dihydroxy-4-(3-methacryloyloxy-2-hydroxypropoxy) benzophenone, 2,2'-dihydroxy-4-(3-acryloyloxy-2-hydroxypropoxy)benzophenone, 2-(2'-hydroxy-5'-methacryloyloxyethylphenyl)-2H-benzotriazole, etc.

(xv) Light-stable polymerizable unsaturated monomers: 4-(meth)acryloyloxy-1,2,2,6,6-pentamethylpiperidine, 4-(meth)acryloyloxy-2,2,6,6-tetramethylpiperidine, 4-cyano-4-(meth)acryloylamino-2,2,6,6-tetramethylpiperidine, 1-(meth)acryloyl-4-(meth)acryloylamino-2,2,6,6-tetramethylpiperidine, 1-(meth)acryloyl-4-cyano-4-(meth)acryloylamino-2,2,6,6-tetramethylpiperidine, 4-crotonoyloxy-2,2,6,6-tetramethylpiperidine, 4-crotonoylamino-2,2,6,6-tetramethylpiperidine, 1-crotonoyl-4-crotonoyloxy-2,2,6,6-tetramethylpiperidine, etc.

(xvi) Polymerizable unsaturated monomers having a carbonyl group: acrolein, diacetone acrylamide, diacetone methacrylamide, acetoacetoxylethyl methacrylate, formylstyrol, vinyl alkyl ketone having 4 to 7 carbon atoms (for example, vinyl methyl ketone, vinyl ethyl ketone, and vinyl butyl ketone), etc.

(xvii) Polymerizable unsaturated monomers having an acid anhydride group: maleic anhydride, itaconic anhydride, citraconic anhydride, etc.

When the polymerizable unsaturated monomer (d2) having a hydrophilic group does not contain 2-hydroxyethyl acrylate, it is preferable that the polymerizable unsaturated monomer (d3) at least partially include the hydroxy-containing polymerizable unsaturated monomer (x), in terms of the water resistance of the resulting coating film. Preferable examples of the hydroxy-containing polymerizable unsaturated monomer (x) include 2-hydroxyethyl methacrylate, 2-hydroxypropyl (meth)acrylate, 3-hydroxypropyl (meth) acrylate, and 4-hydroxybutyl (meth)acrylate; of which 2-hydroxyethyl methacrylate is preferred.

When the polymerizable unsaturated monomer (d3) contains the hydroxy-containing polymerizable unsaturated monomer (x), it is preferable that the content of the hydroxy-containing polymerizable unsaturated monomer (x) be 5 to 79 mass, preferably 10 to 57 mass, further preferably 15 to 40 mass, based on the total mass of the monomer component (d).

The content of the polymerizable unsaturated monomer (d3) can be suitably set so as to make the total weight of the (d1) component and the (d2) component in monomer component (d) 100 mass.

The copolymer (D) is generally a graft polymer having a main chain and a side chain. The side chain portion is formed by the polymer chain in the macromonomer (d1). The main chain portion is formed by the polymerizable unsaturated monomer (d2) containing a hydrophilic group, and the polymerizable unsaturated monomer (d3).

Production Process of Copolymer (D)

The copolymer (D) can be produced by copolymerizing monomer component (d), which includes the macromonomer (d1), the polymerizable unsaturated monomer (d2) containing a hydrophilic group, and, optionally, the polymerizable unsaturated monomer (d3); and by using methods known per se, such as a solution polymerization method in an organic solvent, an emulsion polymerization method in water, etc. Among these, the solution polymerization method is preferable because of the relatively easy procedures it offers.

Examples of the polymerization initiator used for the copolymerization of the monomer component (d) include organic peroxides such as benzoyl peroxide, octanoyl peroxide, lauroyl peroxide, stearoyl peroxide, cumene hydroperoxide, tert-butyl peroxide, di-tert-amylperoxide, tert-butylperoxy-2-ethylhexanoate, tert-butylperoxy laurate, tert-butylperoxy isopropylcarbonate, tert-butylperoxy acetate, diisopropylbenzene hydroperoxide, etc.; azo compounds such as azobisisobutyronitrile, azobis(2,4-dimethylvaleronitrile), azobis (2-methylpropionitrile), azobis(2-methyl butyronitrile), 4,4'-azobis(4-cyano butanoic acid), dimethyl azobis(2-methyl propionate), azobis[2-methyl-N-(2-hydroxyethyl)-propionamide], azobis{2-methyl-N-[2-(1-hydroxybutyl)]-propionamide}, etc.; and persulfates such as potassium persulfate, ammonium persulfate, sodium persulfate, etc. These polymerization initiators may be used singly or in a combination of two or more. Redox initiators prepared by combining a polymerization initiator as mentioned above with a reducing agent such as sugar, sodium formaldehyde sulfoxylate, and iron complex may also be used, as required.

The amount of the polymerization initiator used may be generally 0.01 to 5 mass, preferably 0.1 to 3 mass, based on the total mass of the monomer component (d). The method of adding the polymerization initiator is not particularly limited, and can be suitably selected according to the type and amount of the polymerization initiator used. For example, the polymerization initiator may be incorporated into a monomer mixture or a reaction solvent beforehand, or may be added dropwise or all at once at the time of polymerization.

Water-soluble organic solvents that do not easily cause chain transfer into the solvent are preferably used as the solvent for the solution polymerization method. Examples of such solvents include ester-based solvents such as ethylene glycol monomethyl ether acetate, diethylene glycol monobutyl ether acetate; ketone-based solvents such as acetone or methyl ethyl ketone; alcoholic solvents such as methanol, ethanol, isopropanol, n-butanol, sec-butanol, or isobutanol; ether-based solvents such as 1,4-dioxane, tetrahydrofuran, ethylene glycol dimethyl ether, diethylene glycol dimethyl ether, propylene glycol dimethyl ether, or dipropylene glycol dimethyl ether; and glycol ether-based solvents such as ethylene glycol monomethyl ether, ethylene glycol monoethyl ether, or ethylene glycol monobutyl ether. These may be used singly or in a combination of two or more. Ether-based solvents and glycol ether-based solvents are preferable.

It is preferable that the amount of the organic solvent used for the polymerization reaction be generally 500 mass % or less, preferably 50 to 400 mass, further preferably 100 to 200 mass, based on the total mass of the monomer component (d).

It is preferable that the copolymer (D) has a weight average molecular weight of 20,000 to 1,000,000, preferably 50,000 to 600,000, further preferably 100,000 to 400,000, in terms of the thickening property of the resulting copolymer (D), and smoothness, distinctness of image, and luster of the coating film formed of the coating composition containing the copolymer (D).

In this specification, the number average molecular weight of the macromonomer (d1), and the weight average molecular weight of the copolymer (D), are converted values relative to the molecular weights of polystyrene, obtainable by converting the measured gel permeation chromatograph (GPC) retention time (retention volume) using the retention time (retention volume) of the standard polystyrene of a known molecular weight measured under the same conditions.

The number average molecular weight of the macromonomer (d1) can be measured using an HLC8120GPC gel permeation chromatography apparatus (name of product produced by Tosoh Corporation) together with the four columns TSKgel G-4000 HXL, TSKgel G-3000 HXL, TSKgel G-2500 HXL and TSKgel G-2000 HXL (names of products produced by Tosoh Corporation), and a differential refractometer as a detector under the following conditions: mobile phase: tetrahydrofuran; measurement temperature: 40° C.; flow rate: 1 mL/min.

The weight average molecular weight of the copolymer (D) can be measured using an HLC-8120GPC gel permeation chromatography apparatus (name of product produced by Tosoh Corporation) with a TSKgel GMHHR-L column (name of product produced by Tosoh Corporation), and a differential refractometer as a detector under the following conditions: mobile phase: N,N-dimethylformamide (containing 10 mM lithium bromide and 10 mM phosphate); measurement temperature: 25° C.; flow rate: 1 mL/min.

Curing Agent

In addition to the film-forming resin (C) and the copolymer (D), a curing agent can be used in the aqueous second colored coating composition (Y). The curing agent is a compound that reacts with hydroxy groups, carboxy groups, epoxy groups, etc., in the film-forming resin (C), to thereby cure the aqueous second colored coating composition (Y).

The curing agent can be appropriately selected from the examples of the curing agent for the aqueous first colored coating composition (X) as described above. Of these, an amino resin and a blocked polyisocyanate compound are preferred, and an amino resin is more preferred. The curing agents can be used alone or in a combination of two or more.

As an amino resin, a melamine resin is preferred, and a methyl-butyl mixed etherified melamine resin is more preferred.

In the aqueous second colored coating composition (Y), it is preferable to use a hydroxy-containing acrylic resin, preferably a water-dispersible hydroxy-containing acrylic resin (C1) and/or a core-shell-type water-dispersible hydroxy-containing acrylic resin (C1' or C1"), as the film-forming resin (C), and to use a melamine resin with a weight average molecular weight of about 1,000 to 4,000, and more preferably about 1,200 to 3,000, as the curing agent, to obtain a coating film with an excellent flip-flop property and excellent water resistance. When the melamine resin is used as a curing agent, the catalyst listed in the section regarding the aqueous first colored coating composition (X) can be used.

To improve the smoothness, distinctness of image, and water resistance of the coating film, it is preferable that the proportion of the aqueous film-forming resin (C) in the aqueous second colored coating composition (Y) be about 30 to 95 mass %, preferably about 50 to 90 mass %, and more preferably about 60 to 80 mass %; and the proportion of the curing agent in the aqueous second colored coating composition (Y) be about 5 to 70 mass %, preferably about 10 to 50 mass %, and more preferably about 20 to 40 mass %, with the proportions being based on the total amount of these components.

The amount of the curing agent in the aqueous second colored coating composition (Y) is generally 5 to 60 parts by mass, preferably 10 to 50 parts by mass, more preferably 20 to 40 parts by mass, based on 100 parts by mass of the resin solids in the coating composition.

When the aqueous second colored coating composition (Y) comprises a hydroxy-containing acrylic resin (C1), the proportion of the hydroxy-containing acrylic resin (C1) is, based on the total solids of the film-forming resin (C) and the curing agent, preferably about 2 to 70 parts by mass, more preferably about 5 to 55 parts by mass, and even more preferably about 10 to 50 parts by mass, to improve the smoothness, distinctness of image, and water resistance of the coating film.

When the aqueous second colored coating composition (Y) comprises a core-shell-type water-dispersible hydroxy-containing acrylic resin (C1'), the proportion of the core-shell-type water-dispersible hydroxy-containing acrylic resin (C1') is, based on the total solids of the film-forming resin (C) and the curing agent, preferably about 2 to 70 parts by mass, more preferably about 5 to 55 parts by mass, and even more preferably about 10 to 40 parts by mass, to improve the smoothness, distinctness of image, and water resistance of the coating film.

When the aqueous second colored coating, composition (Y) comprises a hydroxy-containing polyester resin (C2), the proportion of the hydroxy-containing polyester resin (C2) is, based on the total solids of the film-forming resin (C) and the curing agent, preferably about 2 to 70 parts by mass, more preferably about 5 to 55 parts by mass, and even more preferably about 10 to 40 parts by mass, to improve the smoothness, distinctness of image, and water resistance of the coating film.

When the aqueous second colored coating composition (Y) comprises a polyurethane resin, the proportion of the polyurethane resin is, based on the total solids of the film-forming resin (C) and the curing agent, preferably about 2 to 70 parts by mass, more preferably about 5 to 50 parts by mass, and even more preferably about 8 to 30 parts by mass, to improve the smoothness, distinctness of image, and water resistance of the coating film.

The aqueous second colored coating composition (Y) can be prepared by, for example, mixing the film-forming resin (C) and the copolymer (D), together with, if necessary, the curing agent, etc., in an aqueous medium using a known method; and by dissolving or dispersing the components in the medium.

Examples of usable aqueous media include water and water-organic-solvent-mixed solutions obtained by dissolving hydrophilic organic solvents in water. Examples of usable hydrophilic organic solvents include methyl alcohol, ethyl alcohol, isopropyl alcohol, propylene glycol monopropyl ether, ethylene glycol monobutyl ether, propylene glycol monomethyl ether, propylene glycol monobutyl ether, dipropylene glycol monomethyl ether, dipropylene glycol monobutyl ether, tripropylene glycol monomethyl ether, 3-methyl-3-methoxybutanol etc. Such media can be used singly or in a combination of two or more. The proportion of the water and the organic solvent in the water and organic-solvent-mixed solution is not particularly limited. However, the preferable amount of the organic solvent is about 1 to 50 mass %, more preferably about 5 to 35 mass % of the mixed solution.

The "aqueous coating composition" refers to a composition contrasted with the organic solvent coating composition, and generally represents a coating composition obtainable by dissolving and/or dispersing the film-forming resin, a pigment, etc., in water or an aqueous medium that mainly contains water. When the coating composition is an aqueous coating composition, the water content of the coating composition is preferably in a range of from 10 to 90 mass %, more preferably 20 to 80 mass %, further preferably 30 to 70 mass %.

The proportion between the film-forming resin (C) and the copolymer (D) in the aqueous second colored coating composition (Y) is determined according to storage stability of the aqueous second colored coating composition (Y), and the smoothness, distinctness of image, water resistance, etc., of the coating film. The proportion of the copolymer (D) is preferably not less than 0.05 parts by mass, more preferably not less than 0.1 parts by mass, further preferably not less than 0.2 parts by mass, and not more than 30 parts by mass, more preferably not more than 20 parts by mass, further preferably not more than 10 parts by mass, most preferably not more than 5 parts by mass, based on 100 parts by mass of the solids of the film-forming resin (C).

Further, in terms of storage stability of the aqueous coating composition, and the smoothness, distinctness of image, water resistance, etc., of the coating film, the proportion of the copolymer (D) in the aqueous second colored coating composition (Y) is preferably in a range of from 0.01 to 15 parts by mass, more preferably 0.05 to 10 parts by mass, further preferably 0.1 to 5 parts by mass, based on 100 parts by mass of the aqueous coating composition.

Furthermore, when using, as the film-forming resin (C), the water-dispersible hydroxy-containing acrylic resin (C1) having an acid value of 1 to 100 mg KOH/g and a hydroxy value of 1 to 100 mg KOH/g obtainable through copolymerization of components (c1-1) to (c1-3) and also component (c1-4) as necessary, the aqueous second colored coating composition (Y) contains the copolymer (D) and the water-dispersible hydroxy containing acrylic resin (C1) at the following ratio based on 100 parts by mass of the resin solids content of the aqueous second colored coating composition.

Copolymer (D): 0.05 to 20 parts by mass, preferably 0.1 to 10 parts by mass, more preferably 0.2 to 5 parts by mass;

Water-dispersible hydroxy-containing acrylic resin (C1): 2 to 70 parts by mass, preferably 5 to 55 parts by mass, more preferably 10 to 40 parts by mass.

Here, "the resin solids content of the aqueous second colored coating composition" generally refers to the total content of the resin solids content of the copolymer (D) and the water-dispersible hydroxy-containing acrylic resin (C1), and the resin solids content of other resin(s) and the curing agent added to the aqueous second colored coating composition (Y) as required.

If necessary, the aqueous second colored coating composition (Y) may contain additives for coating compositions, such as effect pigments, coloring pigments, extender pigments, hydrophobic organic solvents, curing catalysts, UV absorbers, light stabilizers, pigment dispersants, antifoaming agents, plasticizers, surface control agents, antisettling agents, etc.

Examples of the effect pigments include aluminium (including evaporated aluminium), copper, zinc, brass, nickel, aluminium oxide, mica, aluminium oxide coated with titanium oxide or iron oxide, mica coated with titanium oxide or iron oxide, etc. Such effect pigments can be used singly or in a combination of two or more. These pigments preferably have a scale-like shape. Among these pigments, aluminium, mica, aluminium oxide coated with titanium oxide and iron oxide, and mica coated with titanium oxide or iron oxide are preferable, and aluminium is even more preferable.

Preferably used scaly effect pigments have a length in the longitudinal direction of about 1 to 100 μm, preferably about 5 to 40 μm, and a thickness of about 0.001 to 5 μm, preferably about 0.01 to 2 μm.

When the aqueous second colored coating composition (Y) contains the effect pigment mentioned above, it is possible to form an advantageous coating film having excellent luster with a superior flip-flop property and reduced metallic mottling.

When the aqueous second colored coating composition (Y) contains the effect pigment, the content of the effect pigment is generally preferably about 1 to 100 parts by mass, more preferably about 2 to 50 parts by mass, further preferably about 3 to 30 parts by mass, based on 100 parts by mass of the total solids content of the film-forming resin (C) and the curing agent.

The aqueous second colored coating composition (Y) may further contain a phosphoric-acid-group-containing resin as a resin component, in addition to the film-forming resin (C). In particular, when the aqueous second colored coating composition (Y) contains the effect pigment mentioned above, especially an aluminium pigment, it is preferable that the aqueous second colored coating composition (Y) contain the phosphoric-acid-group-containing resin, in view of the smoothness, distinctness of image, reduction in metallic mottling, and water resistance of the resulting coating film.

The above phosphoric-acid-group-containing resin can be produced, for example, by copolymerizing the phosphoric-acid-group-containing polymerizable unsaturated monomer and other polymerizable unsaturated monomer(s) by solution polymerization or other known methods. Examples of the above phosphoric-acid-group-containing polymerizable unsaturated monomer include acid phosphoxyethyl (meth) acrylate, acid phosphoxypropyl (meth)acrylate, reaction products of glycidyl (meth)acrylate and alkyl phosphoric acid, etc. These can be used singly or in a combination of two or more.

In the above phosphoric-acid-group-containing resin, the mass ratio of the above phosphoric-acid-group-containing polymerizable unsaturated monomer to the other polymerizable unsaturated monomer(s) in their copolymerization is preferably about 1/99 to 40/60, more preferably about 5/95 to 35/65, and even more preferably about 10/90 to 30/70.

When the aqueous second colored coating composition (Y) contains the above phosphoric-acid-group-containing resin, the amount of the phosphoric-acid-group-containing resin is preferably about 0.5 to 15 parts by mass, more preferably about 0.75 to 10 parts by mass, and even more preferably about 1 to 5 parts by mass, based on 100 parts by mass of the total solids of the film-forming resin (C) and the curing agent.

Examples of the coloring pigments include titanium oxide, Chinese white, carbon black, molybdenum red, Prussian blue, cobalt blue, azo pigments, phthalocyanine pigments, quinacridone pigments, isoindoline pigments, threne pigments, perylene pigments, dioxadine pigments, diketopyrrolopyrrole pigments, etc. These pigments can be used singly or in a combination of two or more.

When the aqueous second colored coating composition (Y) contains the coloring pigment mentioned above, the amount of the coloring pigment as a solids content is preferably about 1 to 200 parts by mass, more preferably about 2 to 50 parts by mass, and even more preferably about 3 to 30 parts by mass, based on 100 parts by mass of the total solids of the film-forming resin (C) and the curing agent.

Examples of the extender pigments include talc, clay, kaolin, baryta, barium sulfate, barium carbonate, calcium carbonate, silica, alumina white, etc.

When the aqueous second colored coating composition (Y) contains the extender pigment mentioned above, the amount of the extender pigment as a solids content is preferably about 1 to 200 parts by mass, more preferably about 2 to 50 parts by mass, and even more preferably about 3 to 30 parts by mass, based on 100 parts by mass of the total solids content of the film-forming resin (C) and the curing agent.

The hydrophobic solvent is preferably an organic solvent having a solubility such that its soluble mass at 20° C. in 100 g of water is 10 g or less, preferably 5 g or less, and more preferably 1 g or less. Examples of such organic solvents include rubber solvents, mineral spirits, toluene, xylene, solvent naphtha, and like hydrocarbon solvents; 1-hexanol, 1-octanol, 2-octanol, 2-ethylhexanol, 1-decanol, benzyl alcohol, ethylene glycol mono-2-ethylhexyl ether, propylene glycol mono-n-butyl ether, dipropylene glycol mono-n-butyl ether, tripropylene glycol mono-n-butyl ether, propylene glycol mono-2-ethylhexyl ether, propylene glycol monophenyl ether, and like alcohol solvents; n-butyl acetate, isobutyl acetate, isoamyl acetate, methylamyl acetate, ethylene glycol monobutyl ether acetate, and like ester solvents; and methyl isobutyl ketone, cyclohexanone, ethyl n-amyl ketone, diisobutyl ketone, and like ketone solvents. These organic solvents can be used singly or in a combination of two or more.

To ensure excellent luster of the resulting coating film, it is preferable to use an alcoholic hydrophobic organic solvent, more preferably an alcoholic hydrophobic organic solvent having a carbon number of 7 to 14 as the hydrophobic organic solvent. Among the above alcoholic hydrophobic organic solvents, it is preferable to use at least one member selected from the group consisting of 1-octanol, 2-octanol, 2-ethyl-1-hexanol, ethylene glycol mono-2-ethylhexyl ether, propylene glycol mono-n-butyl ether, and dipropylene glycol mono-n-butyl ether. 2-ethyl-1-hexanol and/or ethylene glycol mono-2-ethylhexyl ether is particularly preferable.

When the aqueous second colored coating composition (Y) contains the hydrophobic organic solvent mentioned above, the amount of the hydrophobic organic solvent is preferably about 10 to 100 parts by mass, more preferably about 15 to 80 parts by mass, and even more preferably about 20 to 60 parts by mass, based on 100 parts by mass of the solids content of the aqueous coating composition.

The solids content of the aqueous second colored coating composition (Y) is generally about 5 to 70 mass %, preferably about 15 to 45 mass %, and more preferably about 20 to 35 mass %.

To ensure excellent smoothness, distinctness of image and luster of the resulting coating film, the viscosity $V_1$ of the aqueous second colored coating composition (Y) at 1,000 $sec^{-1}$ and at 20° C. is preferably not more than 0.1 Pa·sec, more preferably in a range of 0.01 to 0.1 Pa·sec when the rate of shear is changed from 0.0001 $sec^{-1}$ to 10,000 $sec^{-1}$.

To ensure excellent smoothness, distinctness of image, and luster of the resulting coating film, the viscosity $V_2$ of the aqueous second colored coating composition (Y) at 0.1 $sec^{-1}$ and at 20° C. is preferably in a range of 30 to 100 Pa·sec, preferably 35 to 70 Pa·sec, when the rate of shear is changed from 0.0001 $sec^{-1}$ to 10,000 $sec^{-1}$.

The viscosities $V_1$ and $V_2$ can be measured using a viscoelastometer, such as a Haake RheoStress RS150 (product of Haake).

Examples of the coating method of the aqueous second colored coating composition (Y) include known methods such as air spray coating, airless spray coating, rotary atomization coating, curtain coating, etc. Among these, air spray coating or rotary atomization coating is preferable in terms of improved smoothness, distinctness of image, and flip-flop property of the resulting coating film as well as suppressed metallic mottling thereof. Further, if necessary, static electricity may be used during coating.

The aqueous second colored coating composition (Y) is usually applied to a cured film thickness of about 3 to 40 μm, preferably about 5 to 30 μm, more preferably about 8 to 25 μm, further preferably about 10 to 18 μm in terms of smoothness and distinctness of image of the formed multilayered coating film.

Step (3)

In the method for forming a multilayer coating film of the present invention, a clear coating composition (Z) is applied to the coating film formed of the aqueous second colored coating composition (Y) (hereinafter, sometimes referred to as an "second colored coating film") formed in step (2) above.

Before application of the clear coating composition (Z), the second colored coating film is preferably subjected to preheating, air blowing, or the like, under conditions in which the coating film is not substantially cured. The preheating temperature is preferably 40 to 100° C., more preferably 50 to 90° C., and still more preferably 60 to 80° C. The preheating time is preferably 30 seconds to 15 minutes, more preferably 1 to 10 minutes, and still more preferably 2 to 5 minutes. Air blowing can be typically performed by blowing either ordinary-temperature air, or air heated to 25 to 80° C., over the coated surface of the substrate for 30 seconds to 15 minutes.

It is preferable to adjust the solids content concentration of the coating film to generally 70 to 100 mass %, preferably 80 to 100 mass %, and more preferably 90 to 100 mass %, by subjecting, if necessary, the second colored coating film to preheating, air blowing, or the like before application of the clear coating composition (Z).

As the clear coating composition (Z), any known thermosetting clear coating composition for coating automobile bodies, etc., can be used. Examples of such thermosetting clear coating compositions include organic-solvent-type thermosetting coating compositions, aqueous thermosetting coating compositions, and powder thermosetting coating compositions, all of which contain a curing agent and a base resin having a crosslinkable functional group.

Examples of the crosslinkable functional group contained in the base resin include carboxy, hydroxy, epoxy, and silanol. Examples of the base resin include acrylic resins, polyester resins, alkyd resins, urethane resins, epoxy resins, and fluororesins. Examples of the curing agent include polyisocyanate compounds, blocked polyisocyanate compounds, melamine resins, urea resins, carboxy-containing compounds, carboxy-containing resins, epoxy-containing resins, and epoxy-containing compounds.

Examples of preferable combinations of the base resin/curing agent for the clear coating composition (Z) are carboxy-containing resin/epoxy-containing resin, hydroxy-containing resin/polyisocyanate compound, hydroxy-containing resin/blocked polyisocyanate compound, and hydroxy-containing resin/melamine resin.

The clear coating composition (Z) may be a single-liquid-type coating composition or a multi-liquid-type coating composition such as a two-liquid-type urethane resin coating composition.

The clear coating composition (Z) may contain, if necessary, color pigments, effect pigments, dyes, etc., in such amounts that the transparency is not impaired; and may further appropriately contain extender pigments, UV absorbers, light stabilizers, antifoaming agents, thickeners, anticorrosives, surface control agents, etc.

The clear coating composition (Z) can be applied to the surface of a coating film formed of the aqueous second colored coating composition (Y), by a known method, such as airless spray coating, air spray coating, or rotary atomization coating. An electrostatic charge may be applied during the coating.

The clear coating composition (Z) can typically be applied to obtain a film thickness of 10 to 80 μm, preferably 15 to 60 μm, and more preferably 20 to 50 μm when cured.

After the application of the clear coating composition (Z), it is possible, if necessary, to have an interval of about 1 to 60 minutes at room temperature, or to perform preheating at about 40 to 80° C. for about 1 to 60 minutes.

Step (4)

In the method for forming a multilayer coating film of the present invention, the uncured first colored coating film, uncured second colored coating film, and uncured clear coating film formed in steps (1) to (3) above are simultaneously cured by heating.

The first colored coating film, second colored coating film, and clear coating film are cured by a usual method for baking coating films, such as hot air blowing, infrared heating, or high frequency heating.

The heating temperature is preferably 80 to 180° C., more preferably 100 to 170° C., and still more preferably 120 to 160° C.

The heating time is preferably 10 to 60 minutes, and more preferably 15 to 40 minutes. This heating allows three layers of a multilayer coating film, i.e., the first colored coating film, second colored coating film, and clear coating film, to be simultaneously cured.

In the method for forming a multilayer coating film of the present invention, the formation of a mixed layer from the aqueous first colored coating composition (X) and the aqueous second colored coating composition (Y) rarely occurs; accordingly, a multilayer coating film having excellent smoothness and distinctness of image can be formed even without preheating. Therefore, the method for forming a multilayer coating film of the present invention is preferably used in a 3-coat-1-bake process in which an aqueous first colored coating composition (X) is applied in an intermediate coating booth, an aqueous second colored coating composition (Y) is applied in a base coating booth without preheating, and a clear coating composition (Z) is applied in a clear coating booth. The method for forming a multilayer coating film in this case may be performed, for example, by using Method I described below.

Method I

A method for forming a multilayer coating film by sequentially performing the following steps (1) to (5):

(1) applying an electrodeposition coating material to the surface of a steel plate, followed by heat-curing, to form a cured electrodeposition coating film;

(2) applying an aqueous first colored coating composition (X) to the cured electrodeposition coating film obtained in step (1) in an intermediate coating booth to form an uncured intermediate coating film;

(3) applying an aqueous second colored coating composition (Y) to the uncured intermediate coating film obtained in step (2) in a base coating booth without preheating the uncured intermediate coating film, to form an uncured base coating film;

(4) applying a clear coating composition (Z) to the uncured base coating film obtained in step (3) in a clear coating booth to form an uncured clear coating film; and (5) heating the uncured intermediate coating film, uncured base coating film, and uncured clear coating film formed respectively in steps (2) to (4) to simultaneously cure these three coating films.

Note that the booths described above are facilities that maintain coating environment conditions such as temperature, humidity, etc., within certain ranges in order to ensure uniform coating quality. Generally, different booths are used according to the types of coating materials to be applied. Additionally, in order to prevent sagging, unevenness, and the like, of the coating material applied to a substrate, the same coating material is sometimes applied to the substrate two separate times in the same booth. If this is done, the first coating is referred to as a first-stage coating, and the second coating is referred to as a second-stage coating.

In Method I, the aqueous first colored coating composition (X) is applied to obtain a film thickness of 5 to 40 μm, preferably 10 to 30 μm, and more preferably 15 to 25 μm when cured. The aqueous second colored coating composition (Y) is typically applied to obtain a film thickness of 3 to 40 μm, preferably 5 to 30 μm, more preferably 8 to 25 μm, and particularly preferably 10 to 18 μm when cured. The clear coating composition (Z) is typically applied to obtain a film thickness of 10 to 80 μm, preferably 15 to 60 μm, and more preferably 20 to 50 μm when cured.

The method for forming a multilayer coating film of the present invention is preferably used in a 3-coat-1-bake process in which an aqueous first colored coating composition (X) is applied as the first-stage coating performed in a base coating booth, an aqueous second colored coating composition (Y) is applied as the second-stage coating performed in a base coating booth, and a clear coating composition (Z) is applied in a clear coating booth. If this application is performed, Method II described below may, for example, be used to form the coating film.

Method II

A method for forming a multilayer coating film by sequentially performing the following steps (1) to (5):

(1) applying an electrodeposition coating material to the surface of a steel plate, followed by heat-curing, to form a cured electrodeposition coating film;

(2) applying an aqueous first colored coating composition (X) to the cured electrodeposition coating film obtained in step (1) in a base coating booth, as a first-stage coating, to form an uncured first base coating film;

(3) applying an aqueous second colored coating composition (Y) to the uncured first base coating film in a base coating booth, as a second-stage coating obtained in step (2), to form an uncured second base coating film;

(4) applying a clear coating composition (Z) to the uncured second base coating film obtained in step (3) in a clear coating booth to form an uncured clear coating film; and (5) heating the uncured first base coating film, uncured second base coating film, and uncured clear coating film formed respectively in steps (2) to (4) to simultaneously cure these three coating films.

Unlike an ordinary 2-stage coating in which the same coating composition is used in the first-stage coating and the second-stage coating in a base coating booth, different coating compositions are used in the first-stage coating and the second-stage coating in Method II.

Method II is the more preferable of the two methods, i.e., Method I and Method II, described above, because it does not require an intermediate coating booth, and it can therefore reduce the amount of energy used to adjust the temperature and humidity of the intermediate coating booth.

In the method for forming a multilayer coating film of the present invention, the formation of a mixed layer from the aqueous first colored coating composition (X) and the aqueous second colored coating composition (Y) rarely occurs; accordingly, a multilayer coating film having excellent smoothness and distinctness of image can be formed even without preheating after application of the aqueous first colored coating composition (X) and before application of the aqueous second colored coating composition (Y). Therefore, the method for forming a multilayer coating film of the present invention is preferably used in Method II described above, in which it is difficult to introduce equipment for preheating because the coating of the aqueous first colored coating composition (X) and the aqueous second colored coating composition (Y) are performed in the same coating booth.

In step (4) of Method II described above, preheating, air blowing, and the like, may be performed on the base coating film formed in steps (2) and (3).

In Method II described above, the aqueous first colored coating composition (X) is typically applied to obtain a film thickness of 5 to 40 μm, preferably 10 to 30 μm, and more preferably 15 to 25 μm when cured. The aqueous second colored coating composition (Y) is typically applied to obtain a film thickness of 3 to 40 μm, preferably 5 to 30 μm, more preferably 8 to 25 μm, and particularly preferably 10 to 18 μm when cured. The clear coating composition is typically applied to obtain a film thickness of 10 to 80 μm, preferably 15 to 60 μm, and more preferably 20 to 50 μm when cured.

In the method for forming a multilayer coating film of the present invention, use of the aqueous first colored coating composition (X) comprising a hydroxy-containing polyester with an acid value of 30 mg KOH/g and a pigment, and the aqueous second colored coating composition (Y) comprising the film-forming resin (C) and the copolymer (D), can provide a multilayer coating film having excellent smoothness and distinctness of image presumably because of the following reasons.

Specifically, presumably because the first colored coating film obtained by applying the aqueous first colored coating composition (X) comprising a hydroxy group-containing polyester resin (A1) having an acid value of 30 mg KOH/g or less has a relatively hydrophobic property, water in the aqueous second colored coating composition (Y) applied on the first colored coating film is not likely to penetrate the first colored coating film, and the mixed layer between the first colored coating film and the second colored coating film is suppressed.

Further, presumably because the aqueous second colored coating composition (Y) containing the copolymer (D) has the characteristic of easily developing viscosity, and lowering its viscosity with an increase in shear rate, a coating film having a relatively low viscosity and excellent smoothness is formed when the second colored coating composition (Y) is applied by atomization coating, and the coating film has a relatively high viscosity after the application to the first colored coating film, and the mixed layer between the first colored coating film and the second colored coating film is suppressed.

EXAMPLES

Hereinbelow, the present invention is described in further detail with reference to Examples and Comparative Examples. However, the present invention is not limited thereto. The parts ("part(s)") and percentage ("%") are based on mass unless otherwise specified. Additionally, the film thickness of a coating film is on a cured basis.

Production of Polyester Resin (A1)

Production Example 1

109 parts trimethylolpropane, 141 parts 1,6-hexanediol, 126 parts 1,2-cyclohexanedicarboxylic acid anhydride, and 120 parts adipic acid were placed in a reaction vessel equipped with a thermometer, a thermostat, a stirring device, a reflux condenser, and a water separator. The mixture was heated to a range of 160 to 230° C. for 3 hours, followed by a condensation reaction at 230° C. for 4 hours while distilling off the resulting condensation water by using the water separator. Subsequently, to introduce a carboxy group to the obtained condensation reaction product, 25.9 parts trimellitic anhydride was added to the product, followed by a reaction at 170° C. for 30 minutes. Thereafter, the product was diluted with ethylene glycol monobutyl ether, thereby obtaining a hydroxy-containing polyester resin solution (A1-1) having a solids content concentration of 70%. The obtained hydroxy-containing polyester resin had an acid value of 20 mg KOH/g, a hydroxy value of 150 mg KOH/g, and a number average molecular weight of 1,400. In the composition of raw materials, the total content of alicyclic polybasic acid in the acid component was 47 mol % based on the total amount of the acid component.

Production Example 2

109 parts trimethylolpropane, 141 parts 1,6-hexanediol, 126 parts 1,2-cyclohexanedicarboxylic acid anhydride, and 120 parts adipic acid were placed in a reaction vessel equipped with a thermometer, a thermostat, a stirring device, a reflux condenser, and a water separator. The mixture was heated to a range of 160 to 230° C. for 3 hours, followed by a condensation reaction at 230° C. for 4 hours while distilling off the resulting condensation water by using the water separator. Subsequently, to introduce a carboxy group to the obtained condensation reaction product, 29.7 parts trimellitic anhydride was added to the product, followed by a reaction at 170° C. for 30 minutes. Thereafter, the product was diluted with ethylene glycol monobutyl ether, thereby obtaining a hydroxy-containing polyester resin solution (A1-2) having a solids content concentration of 70%. The obtained hydroxy-containing polyester resin had an acid value of 28 mg KOH/g, a hydroxy value of 150 mg KOH/g, and a number average molecular weight of 1,400. In the composition of raw materials, the total content of alicyclic polybasic acid in the acid component was 46 mol % based on the total amount of the acid component.

Production Example 3

109 parts trimethylolpropane, 141 parts 1,6-hexanediol, 126 parts 1,2-cyclohexanedicarboxylic acid anhydride, and 120 parts adipic acid were placed in a reaction vessel equipped with a thermometer, a thermostat, a stirring device, a reflux condenser, and a water separator. The mixture was heated to a range of 160 to 230° C. for 3 hours, followed by a condensation reaction at 230° C. for 4 hours while distilling off the resulting condensation water by using the water separator. Subsequently, to introduce a carboxy group to the obtained condensation reaction product, 33.0 parts trimellitic anhydride was added to the product, followed by a reaction at 170° C. for 30 minutes. Thereafter, the product was diluted with ethylene glycol monobutyl ether, thereby obtaining a hydroxy-containing polyester resin solution (A1-3) having a solids content concentration of 70%. The obtained hydroxy-containing polyester resin had an acid value of 35 mg KOH/g, a hydroxy value of 150 mg KOH/g, and a number average molecular weight of 1,400. In the composition of raw materials, the total content of alicyclic polybasic acid in the acid component was 46 mol % based on the total amount of the acid component.

Production of Water-Dispersible Hydroxy-Containing Acrylic Resin (A2)

Production Example 4

120 parts deionized water and 0.8 parts Adekaria Soap SR-1025 (name of product manufactured by ADEKA; emulsifier; active ingredient: 25%) were placed in a reaction vessel equipped with a thermometer, a thermostat, a stirring device, a reflux condenser, a nitrogen gas introducing pipe, and a dropping funnel. The mixture was stirred and mixed in nitrogen flow, and heated to 80° C.

Subsequently, 5% of the entire amount of monomer emulsion (1), which is described below, and 2.5 parts of a 6% ammonium persulfate aqueous solution were introduced into the reaction vessel and kept therein at 80° C. for 15 minutes. Thereafter, the remaining monomer emulsion (1) was added dropwise for 3 hours to the reaction vessel kept at the same temperature. After completion of the dropwise addition, the mixture was aged for 1 hour. Subsequently, the monomer emulsion (2) described below was added dropwise to the reaction vessel for 1 hour, followed by aging for 1 hour. Thereafter, the mixture was cooled to 30° C. while gradually adding 3.8 parts of a 5% 2-(dimethylamino)ethanol aqueous solution thereto, and filtered through a 100-mesh nylon cloth, thereby obtaining a hydroxy-containing acrylic resin emulsion (A2-1) having a mean particle diameter of 100 nm and a solids content of 30%. The obtained hydroxy-containing acrylic resin emulsion had an acid value of 10 mg KOH/g, and a hydroxy value of 10.5 mg KOH/g.

Monomer emulsion (1): 54.0 parts deionized water, 3.1 parts Adekaria Soap SR-1025, 31.2 parts n-butyl acrylate, 31.2 parts methyl methacrylate, 12.3 parts styrene, and 2.3 parts allyl methacrylate were mixed and stirred, thereby obtaining monomer emulsion (1).

Monomer emulsion (2): 50.0 parts deionized water, 1.8 parts Adekaria Soap SR-1025, 0.04 parts ammonium persulfate, 9.2 parts n-butyl acrylate, 6.1 parts methyl methacrylate, 3.7 parts styrene, 2.3 parts 2-hydroxyethylacrylate, and 1.6 parts methacrylate were mixed and stirred, thereby obtaining monomer emulsion (2).

Production Example 5

35 parts propylene glycol monopropyl ether was placed in a reaction vessel equipped with a thermometer, a thermostat, a stirring device, a reflux condenser, a nitrogen gas introducing pipe, and a dropping funnel, and heated to 85° C. Subsequently, a mixture comprising 30 parts methyl methacrylate, 20 parts 2-ethylhexyl acrylate, 29 parts n-butyl acrylate, 15 parts 2-hydroxyethyl acrylate, 6 parts acrylic acid, 15 parts propylene glycol monopropyl ether, and 2.3 parts 2,2'-azobis (2,4-dimethylvaleronitrile) was added dropwise thereto for 4 hours. After completion of the dropwise addition, the mixture was aged for 1 hour. Subsequently, a mixture of 10 parts propylene glycol monopropyl ether and 1 part of 2,2'-azobis (2,4-dimethylvaleronitrile) was further added dropwise thereto for 1 hour. After completion of the dropwise addition, the mixture was aged for 1 hour. 7.4 parts diethanolamine was further added thereto, thereby obtaining a hydroxy-containing acrylic resin solution (AC-1) having a solids content of 55%. The obtained hydroxy-containing acrylic resin had an acid value of 47 mg KOH/g, and a hydroxy value of 72 mg KOH/g.

Production of Pigment Dispersion

Production Example 6

18 parts (solids content: 10 parts) of the hydroxy-containing acrylic resin solution (AC-1) obtained in Production Example 5, 50 parts JR-806 (name of product produced by Tayca Corp., rutile titanium dioxide), and 30 parts deionized water were placed in a stirring and mixing container, and uniformly mixed. Further, 2-(dimethylamino)ethanol was added thereto, and the pH was adjusted to 8.0. Subsequently, the obtained mixed solution was placed in a wide-mouthed glass bottle. Glass beads having a diameter of about 1.3 mm were added to the bottle as a dispersion medium, and the bottle was hermetically sealed. The mixture was dispersed for 4 hours using a paint shaker, thereby obtaining a pigment dispersion (B-1).

Production Example 7

18 parts (solids content: 10 parts) of the hydroxy-containing acrylic resin solution (AC-1) obtained in Production Example 5, 10 parts Mitsubishi Carbon Black MA-100 (name of product produced by Mitsubishi Chemical Corporation, carbon black), and 50 parts deionized water were placed in a stirring and mixing container, and uniformly mixed. Further, 2-(dimethylamino)ethanol was added thereto, and the pH was adjusted to 8.0. Subsequently, the obtained mixed solution was placed in a wide-mouthed glass bottle. Glass beads having a diameter of about 1.3 mm were added to the bottle as a dispersion medium, and the bottle was hermetically sealed. The mixture was dispersed for 4 hours by using a paint shaker, thereby obtaining a pigment dispersion (B-2).

Production of Aqueous First Colored Coating Composition (X)

Production Example 8

100 parts Super Flex 150 (name of product produced by Daiichi Kogyo Seiyaku Co., Ltd.; urethane resin emulsion; solids content: 30%), 80 parts the hydroxy-containing acrylic resin emulsion (A2-1) obtained in Production Example 4, 20 parts of the hydroxy-containing polyester resin solution (A1-1) obtained in Production Example 1, 25 parts Cymel 325 (name of product produced by Japan Cytec Industries, Inc.; melamine resin; solids content: 80%), 157 parts of the pigment dispersion (B-1) obtained in Production Example 6, and 4 parts of the pigment dispersion (B-2) obtained in Production Example 7 were uniformly mixed. Further, ACRYSOL ASE-60 (name of product produced by Rohm & Haas Co., polyacrylic acid thickener), 2-(dimethylamino)ethanol, and deionized water were added thereto, thereby obtaining an aqueous colored coating composition (X-1) having a pH of 8.0, a solids content concentration of 45%, and a viscosity of 40 seconds as measured using a No. 4 Ford cup at 20° C.

Production Examples 9 and 10

Aqueous colored coating compositions (X-2) and (X-3) were obtained in the same manner as in Production Example 8, except that (A1-2) and (A1-3) were used in place of hydroxy-containing polyester resin (A1-1).

Production of Hydroxy-Containing Acrylic Resin (C1)

Production Example 11

128 parts deionized water and 3 parts Adekaria Soap SR-1025 (name of product manufactured by ADEKA; emulsifier; active ingredient: 25%) were placed in a reaction vessel equipped with a thermometer, a thermostat, a stirring device, a reflux condenser, a nitrogen gas introducing pipe, and a dropping funnel. The mixture was stirred and mixed in nitrogen flow, and heated to 80° C.

Subsequently, 1% of the entire amount of monomer emulsion for the core portion, which is described below, and 5.3 parts of a 6% ammonium persulfate aqueous solution were introduced into the reaction vessel, and kept therein at 80° C. for 15 minutes. Thereafter, the remaining monomer emulsion for the core portion was added dropwise for 3 hours to the reaction vessel kept at the same temperature. After completion of the dropwise addition, the mixture was aged for 1 hour. Subsequently, the monomer emulsion, described below, for the shell portion was added dropwise to the reaction vessel for 1 hour, followed by aging for 1 hour. Thereafter, the mixture was cooled to 30° C. while gradually adding 40 parts of a 5% 2-(dimethylamino)ethanol aqueous solution thereto, and filtered through a 100-mesh nylon cloth, thereby obtaining a water-dispersible hydroxy-containing acrylic resin water dispersion (C1-1) having a solids content of 30%. The obtained water-dispersible hydroxy-containing acrylic resin had an acid value of 13 mg KOH/g and a hydroxy value of 9 mg KOH/g.

Monomer emulsion for the core portion: 40 parts deionized water, 2.8 parts Adekaria Soap SR-1025, 2 parts ethylene glycol dimethacrylate, 1 part allyl methacrylate, 9 parts n-butylacrylate, 54 parts methyl methacrylate, and 11 parts ethyl acrylate were mixed and stirred, thereby obtaining a monomer emulsion for the core portion.

Monomer emulsion for the shell portion: 17 parts deionized water, 1.2 parts Adekaria Soap SR-1025, 0.03 parts ammonium persulfate, 3 parts n-butyl acrylate, 2 parts 2-hydroxyethyl acrylate, 2 parts methacrylic acid, 11 parts methyl methacrylate, and 5 parts ethyl acrylate were mixed and stirred, thereby obtaining a monomer emulsion for the shell portion.

Production Examples 12 to 24

Water-dispersible hydroxy-containing acrylic resin water dispersions (C1-2) to (C1-14) were obtained in the same manner as in Production Example 11, except that the formulations shown in Table 1 below were used.

Table 1 shows the raw material composition (part), solids (%), acid value (mgKOH/g), and hydroxy value (mgKOH/g) of water-dispersible hydroxy-containing acrylic resin water dispersions (C1-1) to (C1-14).

TABLE 1

| | | | | | Production Example | | | | | | |
|---|---|---|---|---|---|---|---|---|---|---|---|
| | | | | | 11 | 12 | 13 | 14 | 15 | 16 | 17 |
| Water-dispersible hydroxy-containing acrylic resin water dispersion | | | | | C1-1 | C1-2 | C1-3 | C1-4 | C1-5 | C1-6 | C1-7 |
| Monomer emulsion for core portion | | Deionized water | | | 40 | 40 | 40 | 40 | 40 | 40 | 40 |
| | | Adekaria soap SR-1025 | | | 2.8 | 2.8 | 2.8 | 2.8 | 2.8 | 2.8 | 2.8 |
| | Monomer component (c1) | Polymerizable unsaturated monomer having at least two polymerizable unsaturated groups per molecule | | Ethylene glycol dimethacrylate | 2 | 2 | 2 | 2 | | | 2 |
| | | | | Methylene bis acrylamide | | | | | | 2 | |
| | | | | Allyl methacrylate | 1 | 1 | 1 | 1 | 3 | 1 | 1 |
| | | Polymerizable unsaturated monomer having one polymerizable unsaturated group per molecule | Hydrophobic polymerizable unsaturated monomer (c1-1) | n-Butyl acrylate | 9 | 6 | 10 | 10 | 10 | 10 | 47 |
| | | | | Methyl methacrylate | 54 | 55 | 52 | 52 | 48 | 52 | 22 |
| | | | Polymerizable unsaturated monomer having a $C_1$ or $C_2$ alkyl group | Ethyl acrylate | 11 | 13 | 12 | 12 | 12 | 12 | 5 |
| Monomer emulsion for shell portion | | Deionized water | | | 17 | 17 | 17 | 17 | 17 | 17 | 17 |
| | | Adekaria soap SR-1025 | | | 1.2 | 1.2 | 1.2 | 1.2 | 1.2 | 1.2 | 1.2 |
| | | Ammonium persulfate | | | 0.03 | 0.03 | 0.03 | 0.03 | 0.03 | 0.03 | 0.03 |
| | Monomer component (c1) | Hydrophobic polymerizable unsaturated monomer (c1-1) | | Styrene | | 1 | 3 | | 3 | | 3 |
| | | | | n-Butyl acrylate | 3 | 4 | 11 | 11 | 11 | 11 | 15 |
| | | | | 2-Ethylhexyl acrylate | | | | 3 | | 3 | |
| | | Hydroxy-containing polymerizable unsaturated monomer (c1-2) | | 2-Hydroxyethyl methacrylate | 2 | 2 | 2 | 2 | 4 | 2 | 2 |

TABLE 1-continued

| | | | | | | | | | |
|---|---|---|---|---|---|---|---|---|---|
| | Carboxy-containing polymerizable unsaturated monomer (c1-3) | | Methacrylic acid | 2 | 2 | 2 | 2 | 4 | 2 | 2 |
| | Polymerizable unsaturated monomer (c1-4) | Polymerizable unsaturated monomer having a $C_1$ or $C_2$ alkyl group | Methyl methacrylate | 11 | 9 | 4 | 4 | 4 | 4 | 1 |
| | | | Ethyl acrylate | 5 | 5 | 1 | 1 | 1 | 1 | |
| 5% 2-(Dimethylamino)ethanol aqueous solution | | | | 40 | 40 | 40 | 40 | 40 | 40 | 40 |
| Total amount of polymerizable unsaturated monomer (amount of monomer component (c1)) (part) | | | | 100 | 100 | 100 | 100 | 100 | 100 | 100 |
| Total amount of monomer component for forming core portion (part) | | | | 77 | 77 | 77 | 77 | 73 | 77 | 77 |
| Total amount of monomer component for forming shell portion (part) | | | | 23 | 23 | 23 | 23 | 27 | 23 | 23 |
| Proportion of each monomer based on the total amount of polymerizable unsaturated monomer (amount of monomer component (c1)) (mass %) | | Hydrophobic polymerizable unsaturated monomer (c1-1) | | 12 | 11 | 24 | 24 | 24 | 24 | 65 |
| | | Hydroxy-containing polymerizable unsaturated monomer (c1-2) | | 2 | 2 | 2 | 2 | 4 | 2 | 2 |
| | | Carboxy-containing polymerizable unsaturated monomer (c1-3) | | 2 | 2 | 2 | 2 | 4 | 2 | 2 |
| | | Polymerizable unsaturated monomer (c1-4) other than monomers (c1-1) to (c1-3) | | 84 | 85 | 72 | 72 | 68 | 72 | 31 |
| Proportion of monomer for forming core portion based on the total amount of monomer component for forming core portion (mass %) | | Polymerizable unsaturated monomer having at least two polymerizable unsaturated monomers per molecule | | 4 | 4 | 4 | 4 | 4 | 4 | 4 |
| | | Polymerizable unsaturated monomer having one polymerizable unsaturated monomer per molecule | | 96 | 96 | 96 | 96 | 96 | 96 | 96 |
| | | Polymerizable unsaturated monomer having $C_1$ or $C_2$ alkyl group | | 84 | 88 | 83 | 83 | 82 | 83 | 35 |
| Proportion of monomer for forming shell portion based on the total amount of monomer component for forming shell portion (mass %) | | Hydrophobic polymerizable unsaturated monomer (c1-1) | | 13 | 22 | 61 | 61 | 52 | 61 | 78 |
| | | Hydroxy-containing polymerizable unsaturated monomer (c1-2) | | 9 | 9 | 9 | 9 | 15 | 9 | 9 |
| | | Carboxy-containing polymerizable unsaturated monomer (c1-3) | | 9 | 9 | 9 | 9 | 15 | 9 | 9 |
| | | Polymerizable unsaturated monomer (c1-4) other than monomer (c1-1) to (c1-3) | | 70 | 61 | 22 | 22 | 19 | 22 | 4 |
| Solids (%) | | | | 30 | 30 | 30 | 30 | 30 | 30 | 30 |
| Acid value (mgKOH/g) | | | | 13 | 13 | 13 | 13 | 26 | 13 | 13 |
| Hydroxy value (mgKOH/g) | | | | 9 | 9 | 9 | 9 | 17 | 9 | 9 |

| | | | | Production Example | | | | | | |
|---|---|---|---|---|---|---|---|---|---|---|
| | | | | 18 | 19 | 20 | 21 | 22 | 23 | 24 |
| Water-dispersible hydroxy-containing acrylic resin water dispersion | | | | C1-8 | C1-9 | C1-10 | C1-11 | C1-12 | C1-13 | C1-14 |
| Monomer emulsion for core portion | Deionized water | | | 40 | 40 | 40 | 40 | 40 | 40 | 57 |
| | Adekaria soap SR-1025 | | | 2.8 | 2.8 | 2.8 | 2.8 | 2.8 | 2.8 | 4 |
| | Monomer component (c1) | Polymerizable unsaturated monomer having at least two polymerizable unsaturated groups per molecule | Ethylene glycol di(meth)acrylate | 2 | 2 | 2 | 2 | | 2 | 2 |
| | | | Allyl methacrylate | 1 | 1 | 1 | 1 | | 1 | 1 |
| | | Polymerizable unsaturated monomer having one polymerizable unsaturated group per molecule | Hydrophobic polymerizable unsaturated monomer (c1-1) | Styrene | | | | | 3 | 3 |
| | | | | n-Butyl acrylate | 10 | 10 | 10 | 14 | 10 | 21 | 21 |
| | | | Hydroxy-containing polymerizable unsaturated monomer (c1-2) | 2-Hydroxyethyl methacrylate | | 12 | | | | | 2 |
| | | | Carboxy-containing polymerizable unsaturated monomer (c1-3) | Methacrylic acid | | | | 8 | | | 2 |

TABLE 1-continued

| | | | | | | | | | | | |
|---|---|---|---|---|---|---|---|---|---|---|---|
| | | | Polymerizable unsaturated monomer having a $C_1$ or $C_2$ alkyl group | Methyl methacrylate | 52 | 43 | 52 | 43 | 54 | 56 | 56 |
| | | | | Ethyl acrylate | 12 | 9 | 12 | 9 | 13 | 13 | 13 |
| Monomer emulsion for shell portion | | Deionized water | | | 17 | 17 | 17 | 17 | 17 | 17 | |
| | | Adekaria soap SR-1025 | | | 1.2 | 1.2 | 1.2 | 1.2 | 1.2 | 1.2 | |
| | | Ammonium persulfate | | | 0.03 | 0.03 | 0.03 | 0.03 | 0.03 | 0.03 | |
| | Monomer component | Hydrophobic polymerizable unsaturated monomer (c1-1) | | Styrene | 3 | 1 | 3 | 1 | 3 | | |
| | | | | n-Butyl acrylate | 11 | 4 | 11 | 4 | 11 | | |
| | | Hydroxy-containing polymerizable unsaturated monomer (c1-2) | | 2-hydroxyethyl methacrylate | 0.5 | 9 | 2 | 9 | 2 | 2 | |
| | | Carboxy-containing polymerizable unsaturated monomer (c1-3) | | Methacrylic acid | 2 | 6 | 0.5 | 6 | 2 | 2 | |
| | | Polymerizable unsaturated monomer (c1-4) | Polymerizable unsaturated monomer having a $C_1$ or $C_2$ alkyl group | Methyl methacrylate | 5 | 3 | 5 | 3 | 4 | | |
| | | | | Ethyl acrylate | 1.5 | | 1.5 | | 1 | | |
| 5% 2-(Dimethylamino)ethanol aqueous solution | | | | | 40 | 40 | 40 | 40 | 40 | 40 | 40 |
| Total amount of polymerizable unsaturated monomer (amount of monomer component (c1)) (part) | | | | | 100 | 100 | 100 | 100 | 100 | 100 | 100 |
| Total amount of monomer component for forming core portion (part) | | | | | 77 | 77 | 77 | 77 | 77 | 96 | 100 |
| Total amount of monomer component for forming shell portion (part) | | | | | 23 | 23 | 23 | 23 | 23 | 4 | 0 |
| Proportion of each monomer based on the total amount of polymerizable unsaturated monomer (amount of monomer component (c1)) (mass %) | | | Hydrophobic polymerizable unsaturated monomer (c1-1) | | 24 | 15 | 24 | 19 | 24 | 24 | 24 |
| | | | Hydroxy-containing polymerizable unsaturated monomer (c1-2) | | 1 | 21 | 2 | 9 | 2 | 2 | 2 |
| | | | Carboxy-containing polymerizable unsaturated monomer (c1-3) | | 2 | 6 | 1 | 14 | 2 | 2 | 2 |
| | | | Polymerizable unsaturated monomer (c1-4) other than monomers (c1-1) to (c1-3) | | 74 | 58 | 74 | 58 | 72 | 72 | 72 |
| Proportion of monomer for forming core portion based on the total amount of monomer component for forming core portion (mass %) | | | Polymerizable unsaturated monomer having at least two polymerizable unsaturated groups per molecule | | 4 | 4 | 4 | 4 | 0 | 3 | 3 |
| | | | Polymerizable unsaturated monomer having one polymerizable unsaturated group per molecule | | 96 | 96 | 96 | 96 | 100 | 97 | 97 |
| | | | Polymerizable unsaturated monomer having $C_1$ or $C_2$ alkyl group | | 83 | 68 | 83 | 68 | 87 | 72 | 69 |
| Proportion of monomer for forming shell portion based on the total amount of monomer component for forming shell portion (mass %) | | | Hydrophobic polymerizable unsaturated monomer (c1-1) | | 61 | 22 | 61 | 22 | 61 | 0 | |
| | | | Hydroxy-containing polymerizable unsaturated monomer (c1-2) | | 2 | 39 | 9 | 39 | 9 | 50 | |
| | | | Carboxy-containing polymerizable unsaturated monome r(c1-3) | | 9 | 26 | 2 | 26 | 9 | 50 | |
| | | | Polymerizable unsaturated monomer (c1-4) other than monomers (c1-1) to (c1-3) | | 28 | 13 | 28 | 13 | 22 | 0 | |
| Solids (%) | | | | | 30 | 30 | 30 | 30 | 30 | 30 | 30 |
| Acid value (mgKOH/g) | | | | | 13 | 39 | 3 | 91 | 13 | 13 | 13 |
| Hydroxy value (mgKOH/g) | | | | | 2 | 91 | 9 | 39 | 9 | 9 | 9 |

Production of Hydroxy-Containing Polyester Resin (C2)

Production Example 25

109 parts trimethylolpropane, 141 parts 1,6-hexanediol, 126 parts 1,2-cyclohexanedicarboxylic acid anhydride, and 120 parts adipic acid were placed in a reaction vessel equipped with a thermometer, a thermostat, a stirring device, a reflux condenser, a nitrogen gas introducing pipe and a water separator. The mixture was heated to a range of 160 to 230° C. for 3 hours, followed by a condensation reaction at 230° C. for 4 hours. Subsequently, to introduce a carboxy group to the obtained condensation reaction product, 38.3 parts trimellitic anhydride was added to the product, followed by a reaction at 170° C. for 30 minutes. Thereafter, the product was diluted with 2-ethyl-1-hexanol (the amount of mass dissolved in 100 g of water at 20° C.: 0.1 g), thereby obtaining a hydroxy-containing polyester resin solution (C2-1) having a solids content of 70%. The obtained hydroxy-containing polyester resin had an acid value of 46 mg KOH/g, a hydroxy value of 150 mg KOH/g, and a number average molecular weight of 1,400. In the composition of raw materials, the total content of alicyclic polybasic acid in the acid component was 46 mol % relative to the total amount of the acid component.

Production Example 26

113 parts trimethylolpropane, 131 parts neopentyl glycol, 80 parts 1,2-cyclohexanedicarboxylic acid anhydride, 93 parts isophthalic acid, and 91 parts adipic acid were placed in a reaction vessel equipped with a thermometer, a thermostat, a stirring device, a reflux condenser, a nitrogen gas introducing pipe, and a water separator. The mixture was heated to a range of 160 to 230° C. for 3 hours, followed by a condensation reaction at 230° C. for 4 hours. Subsequently, to introduce a carboxy group to the obtained condensation reaction product, 33.5 parts trimellitic anhydride was added to the product, followed by a reaction at 170° C. for 30 minutes. Thereafter, the product was diluted with 2-ethyl-1-hexanol, thereby obtaining a hydroxy-containing polyester resin solution (C2-2) having a solids content of 70%. The obtained hydroxy-containing polyester resin had an acid value of 40 mg KOH/g, a hydroxy value of 161 mg KOH/g, and a number average molecular weight of 1,300. In the composition of raw materials, the total content of alicyclic polybasic acid in the acid component was 28 mol % relative to the total amount of the acid component.

Production Example 27

The hydroxy-group containing polyester resin solution (C2-3) was obtained in the same manner as in Production Example 25 except that ethylene glycol mono-n-butyl ether was used in place of 2-ethyl-1-hexanol of a diluting solvent (amount of mass dissolved in 100 g of water at 20° C.: infinite).

Production of Macromonomer (d1)

Production Example 28

16 parts ethylene glycol monobutyl ether and 3.5 parts 2,4-diphenyl-4-methyl-1-pentene (hereinbelow, sometimes abbreviated as "MSD") were placed in a reaction vessel equipped with a thermometer, a thermostat, a stirring device, a reflux condenser, a nitrogen gas introducing pipe, and a dropping funnel. The mixture was heated to 160° C. under stirring while nitrogen gas was blown into the vapor space of the vessel. When the temperature reached 160° C., a mixture comprising 30 parts n-butyl methacrylate, 40 parts 2-ethylhexyl methacrylate, 30 parts 2-hydroxyethyl methacrylate, and 7 parts di-tert-amyl peroxide was added dropwise thereinto for 3 hours; the resulting mixture was stirred at the same temperature for 2 hours. Subsequently, the resulting mixture was cooled to 30° C., and diluted with ethylene glycol monobutyl ether, thus obtaining a macromonomer solution (d1-1) having a solids content of 65%. The hydroxy value of the obtained macromonomer was 125 mg KOH/g, and the number average molecular weight thereof was 2,300. In addition, according to analysis by proton NMR, 97% or more of the ethylene unsaturated groups derived from MSD were located at the ends of a polymer chain, and 2% thereof disappeared.

Note that the above analysis by proton NMR was performed in the following manner. Using heavy chloroform as a solvent, the following peaks before and after the polymerization reaction were measured: peaks based on protons of unsaturated groups in MSD (4.8 ppm, 5.1 ppm), peaks based on protons of ethylene unsaturated groups at the ends of a macromonomer chain (5.0 ppm, 5.2 ppm), and a peak of aromatic protons derived from MSD (7.2 ppm). The aromatic protons (7.2 ppm) derived from the MSD described above were assumed to remain the same before and after the polymerization reaction. Using this value as a reference, each unsaturated group (unreacted, macromonomer chain end, and disappeared) was quantified.

Production Examples 29 to 44

Synthesis was performed in the same manner as in Production Example 29, except that the formulation shown in Table 2 was used, thereby obtaining macromonomer solutions (d1-1) to (d1-17) having a solids content of 65%.

Table 2 shows the composition of raw materials (parts), proportion of a polymerizable unsaturated monomer (m1) having a $C_{4-24}$ alkyl group in monomer component (m), hydroxy value (mg KOH/g), and number average molecular weight of the macromonomer solutions (d1-1) to (d1-17).

TABLE 2

| | | | Production Example | | | | | | | | |
|---|---|---|---|---|---|---|---|---|---|---|---|
| | | | 28 | 29 | 30 | 31 | 32 | 33 | 34 | 35 | 36 |
| Macromonomer solution | | | d1-1 | d1-2 | d1-3 | d1-4 | d1-5 | d1-6 | d1-7 | d1-8 | d1-9 |
| Ethylene glycol monobutyl ether | | | 16 | 16 | 16 | 16 | 16 | 16 | 16 | 16 | 16 |
| 2,4-Diphenyl-4-methyl-1-pentene | | | 3.5 | 3.5 | 3.5 | 3.5 | 3.5 | 3.5 | 7 | 1.6 | 1.2 |
| Monomer component (m) | Polymerizable unsaturated monomer (m1) having $C_{4-24}$ alkyl group | n-Butyl methacrylate | 30 | | | | | | | | |
| | | 2-Ethylhexyl methacrylate | 40 | 80 | 75 | | 20 | 10 | 50 | 75 | 75 |
| | | Acryester SL (See note 1.) | | | | 40 | | | | | |
| | | Stearyl methacrylate | | | | | | | 25 | | |

TABLE 2-continued

| | | | | | | | | | | |
|---|---|---|---|---|---|---|---|---|---|---|
| Hydroxy-containing polymerizable unsaturated monomer | 2-Hydroxyethyl methacrylate | 30 | 20 | 25 | 40 | 40 | 40 | 25 | 25 | 25 |
| | 2-Hydroxypropyl methacrylate | | | | | | | | | |
| | Methyl methacrylate | | | | 20 | 40 | 50 | | | |
| Di-tert-amylperoxide | | 7 | 7 | 7 | | | | 7 | 7 | 7 |
| azobisisobutyronitrile | | | | | 7 | 7 | 7 | | | |
| Reaction temperature (° C.) | | 160 | 160 | 160 | 120 | 120 | 120 | 160 | 160 | 160 |
| Proportion of polymerizable unsaturated monomer (m1) in monomer component (m) (parts by mass) | | 70 | 80 | 75 | 40 | 20 | 10 | 75 | 75 | 75 |
| Hydroxy value (mgKOH/g) | | 125 | 83 | 104 | 167 | 167 | 167 | 101 | 106 | 107 |
| Number average molecular weight | | 2,300 | 2,200 | 2,200 | 2,100 | 2,400 | 2,400 | 1,200 | 4,000 | 7,000 |

| | | | Production Example | | | | | | | |
|---|---|---|---|---|---|---|---|---|---|---|
| | | | 37 | 38 | 39 | 40 | 41 | 42 | 43 | 44 |
| Macromonomer solution | | | d1-10 | d1-11 | d1-12 | d1-13 | d1-14 | d1-15 | d1-16 | d1-17 |
| Ethylene glycol monobutyl ether | | | 16 | 16 | 16 | 16 | 16 | 16 | 16 | 16 |
| 2,4-Diphenyl-4-methyl-1-pentene | | | 1.0 | 3.5 | 3.5 | 3.5 | 3.5 | 3.5 | 8 | 0.7 |
| Monomer component (m) | Polymerizable unsaturated monomer (m1) having $C_{4-24}$ alkyl group | n-Butyl methacrylate | | 50 | 43 | | 13 | | | |
| | | 2-Ethylhexyl methacrylate | 75 | 50 | 50 | 45 | 75 | | 75 | 75 |
| | | Acryester SL (See note 1.) | | | | | | | | |
| | | Stearyl methacrylate | | | | | | | | |
| | Hydroxy-containing polymerizable unsaturated monomer | 2-Hydroxyethyl methacrylate | 25 | | 7 | 20 | 12 | | 25 | 25 |
| | | 2-Hydroxypropyl methacrylate | | | | 35 | | | | |
| | | Methyl methacrylate | | | | | | 100 | | |
| Di-tert-amylperoxide | | | 7 | 7 | 7 | 7 | 7 | | 7 | 7 |
| Azobisisobutyronitrile | | | | | | | | 7 | | |
| Reaction temperature (° C.) | | | 160 | 160 | 160 | 160 | 160 | 120 | 160 | 160 |
| Proportion of polymerizable unsaturated monomer (m1) in monomer component (m) (parts by mass) | | | 75 | 100 | 93 | 45 | 88 | 0 | 75 | 75 |
| Hydroxy value (mgKOH/g) | | | 107 | 0 | 29 | 215 | 50 | 0 | 100 | 107 |
| Number average molecular weight | | | 9,000 | 2,300 | 2,300 | 2,300 | 2,300 | 2,300 | 800 | 11,000 |

note 1: Acryester SL: name of product manufactured by Mitsubishi Rayon Co., Ltd.; a mixture of dodecyl methacrylate and tridecyl methacrylate.

Production of Copolymer

Production Example 45

15.4 parts (solids content: 10 parts) of the macromonomer solution (d1-1) obtained in Production Example 28, parts ethylene glycol monobutyl ether, and 30 parts diethylene glycol monoethyl ether acetate were placed in a reaction vessel equipped with a thermometer, a thermostat, a stirring device, a reflux condenser, a nitrogen gas introducing pipe, and two dropping funnels; and heated to 85° C. while nitrogen gas was blown into the liquid. Subsequently, the following mixtures were simultaneously added dropwise for 4 hours to the reaction vessel kept at the same temperature: a mixture comprising 31.5 parts N,N-dimethyl acrylamide, 31.5 parts N-isopropylacrylamide, 27 parts 2-hydroxyethyl acrylate, 10 parts ethylene glycol monobutyl ether, and 40 parts diethylene glycol monoethyl ether acetate; and a mixture comprising 0.15 parts Perbutyl 0 (name of product manufactured by NOF Corporation; polymerization initiator; tert-butylperoxy-2-ethylhexanoate), and 20 parts ethylene glycol monobutyl ether. After completion of the dropwise addition, the mixture was stirred at the same temperature for 2 hours for aging. Subsequently, a mixture comprising 0.3 parts 2,2'-azobis(2,4-dimethylvaleronitrile) and 15 parts ethylene glycol monobutyl ether was added dropwise for 1 hour to the reaction vessel kept at the same temperature. After completion of the dropwise addition, the mixture was stirred at the same temperature for 1 hour for aging. Subsequently, the resulting mixture was cooled to 30° C. while adding ethylene glycol monobutyl ether thereto, thereby obtaining a copolymer solution having a solids content of 35%. The weight average molecular weight of the obtained copolymer was $31\times10^4$. 215 parts deionized water was added to the obtained copolymer solution, thereby obtaining a Copolymer diluted solution (D-1) having a solids content of 20%.

Production Examples 46 to 90

Synthesis was performed in the same manner as in Production Example 45, except that the formulation shown in Table 3 was used, thereby obtaining Copolymer diluted solutions (D-2) to (D-46) having a solids content of 20%.

Table 3 below shows the composition of raw materials (parts) and weight average molecular weight of the Copolymer diluted solutions (D-1) to (D-46).

TABLE 3

| | | | | Production Example | | | | | | | | | |
|---|---|---|---|---|---|---|---|---|---|---|---|---|---|
| | | | | 45 | 46 | 47 | 48 | 49 | 50 | 51 | 52 | 53 | 54 |
| Copolymer diluted solution | | | | D-1 | D-2 | D-3 | D-4 | D-5 | D-6 | D-7 | D-8 | D-9 | D-10 |
| Monomer component (d) | Macromonomer (d1) solution | | Type | d1-1 | d1-2 | d1-3 | d1-4 | d1-5 | d1-6 | d1-7 | d1-8 | d1-9 | d1-10 |
| | | | Amount | 15.4 | 15.4 | 15.4 | 15.4 | 7.7 | 15.4 | 15.4 | 15.4 | 15.4 | 15.4 |
| | Polymerizable unsaturated monomer (d2) having a hydroxy group | N-substituted (meth)acrylamide | N,N-dimethyl acrylamide | 31.5 | 31.5 | 31.5 | 31.5 | 33.3 | 31.5 | 18 | 27 | 45 | 63 |
| | | | N-isopropyl acrylamide | 31.5 | 31.5 | 31.5 | 31.5 | 33.3 | 31.5 | 45 | 36 | 18 | |
| | | Polymerizable unsaturated monomer having a polyoxyalkylene chain | NK-ester Ad90G (See note 2.) | | | | | | | | | | |
| | | | PLEX 6954-0 (See note 3.) | | | | | | | | | | |
| | | N-vinyl-2-pyrrolidone | | | | | | | | | | | |
| | | 2-Hydroxy ethyl acrylate | | 27 | 27 | 27 | 27 | 29 | 27 | 27 | 27 | 27 | 27 |
| | | Acrylic acid | | | | | | | | | | | |
| | | Methacrylic acid | | | | | | | | | | | |
| | Other polymerizable unsaturated monomer(s) (d3) | | Methyl methacrylate | | | | | | | | | | |
| | | | Ethyl acrylate | | | | | | | | | | |
| | | | isobutyl methacrylate | | | | | | | | | | |
| Perbutyl O | | | | 0.15 | 0.15 | 0.15 | 0.15 | 0.15 | 0.15 | 0.15 | 0.15 | 0.15 | 0.15 |
| Proportion of macromonomer (d1) (parts by mass) | | | | 10 | 10 | 10 | 10 | 5 | 10 | 10 | 10 | 10 | 10 |
| Proportion of polymerizable unsaturated monomer (d2) having a hydroxy group (Parts by mass) | | | | 90 | 90 | 90 | 90 | 95 | 90 | 90 | 90 | 90 | 90 |
| Proportion of polymerizable unsaturated monomers (d3) (Parts by mass) | | | | 0 | 0 | 0 | 0 | 0 | 0 | 0 | 0 | 0 | 0 |
| Weight average molecular weight ($\times 10^4$) | | | | 31 | 31 | 31 | 31 | 31 | 31 | 25 | 32 | 34 | 36 |

| | | | | Production Example | | | | | | | | | |
|---|---|---|---|---|---|---|---|---|---|---|---|---|---|
| | | | | 55 | 56 | 57 | 58 | 59 | 60 | 61 | 62 | 63 | 64 |
| Copolymer diluted solution | | | | D-11 | D-12 | D-13 | D-14 | D-15 | D-16 | D-17 | D-18 | D-19 | D-20 |
| Monomer component (d) | Macromonomer (d1) solution | | Type | d1-11 | d1-12 | d1-13 | d1-3 | d1-3 | d1-3 | d1-2 | d1-2 | d1-3 | d1-3 |
| | | | Amount | 15.4 | 15.4 | 15.4 | 15.4 | 15.4 | 15.4 | 15.4 | 15.4 | 15.4 | 15.4 |
| | Polymerizable unsaturated monomer (d2) having a hydroxy group | N-substituted (meth)acrylamide | N,N-dimethyl acrylamide | 31.5 | 27 | 27 | | | | | | 8.1 | |
| | | | N-isopropyl acrylamide | 31.5 | 27 | 27 | | | | | | 8.1 | |
| | | Polymerizable unsaturated monomer having a polyoxyalkylene chain | NK-ester Ad90G (See note 2.) | | | | 63 | | | | | | 13.5 |
| | | | PLEX 6954-0 (See note 3.) | | | | | | | | | | |
| | | N-Vinyl-2-pyrrolidone | | | | | | 63 | | | | | |
| | | 2-Hydroxy ethyl acrylate | | 27 | 36 | 36 | 27 | 27 | 72 | | | | |
| | | Acrylic acid | | | | | | | | 27 | | 7.2 | 13.5 |
| | | Methacrylic acid | | | | | | | | | 45 | | |
| | Other polymerizable unsaturated monomer(s) (d3) | | Methyl methacrylate | | | | | | | | | | 18 |
| | | | Ethyl acrylate | | | | | | 18 | 63 | 45 | 66.6 | 45 |
| | | | Isobutyl methacrylate | | | | | | | | | | |
| Perbutyl O | | | | 0.15 | 0.15 | 0.15 | 0.15 | 0.15 | 0.15 | 0.15 | 0.15 | 0.15 | 0.15 |
| Proportion of macromonomer (d1) (parts by mass) | | | | 10 | 10 | 10 | 10 | 10 | 10 | 10 | 10 | 10 | 10 |
| Proportion of polymerizable unsaturated monomer (d2) having a hydroxy group (parts by mass) | | | | 90 | 90 | 90 | 90 | 90 | 72 | 27 | 45 | 23.4 | 27 |
| Proportion of other polymerizable unsaturated monomer(s) (d3) (parts by mass) | | | | 0 | 0 | 0 | 0 | 0 | 18 | 63 | 45 | 66.6 | 63 |
| Weight average molecular weight ($\times 10^4$) | | | | 31 | 31 | 31 | 31 | 31 | 31 | 31 | 20 | 30 | 25 |

TABLE 3-continued

| | | | | Production Example | | | | | | | | | |
|---|---|---|---|---|---|---|---|---|---|---|---|---|---|
| | | | | 65 | 66 | 67 | 68 | 69 | 70 | 71 | 72 | 73 | 74 |
| Copolymer diluted solution | | | | D-21 | D-22 | D-23 | D-24 | D-25 | D-26 | D-27 | D-28 | D-29 | D-30 |
| Monomer component (d) | Macromonomer (d1) solution | | Type | d1-3 | d1-3 | d1-3 | d1-2 | d1-2 | d1-3 | d1-3 | d1-3 | d1-2 | d1-2 |
| | | | Amount | 15.4 | 15.4 | 15.4 | 15.4 | 15.4 | 15.4 | 15.4 | 15.4 | 15.4 | 15.4 |
| | Polymerizable unsaturated monomer (d2) having a hydroxy group | N-substituted (meth)acrylamide | N,N-dimethyl acrylamide | | | | 36 | 63 | | 13.5 | 13.5 | 36 | 31.5 |
| | | | N-isopropyl acrylamide | | | | 31.5 | | | | | 36 | |
| | | Polymerizable unsaturated monomer having a polyoxyalkylene chain | NK-ester Ad90G (See note 2.) | | | | | | | | | | |
| | | | PLEX 6954-0 (See note 3.) | | | | | | | | | | |
| | | N-Vinyl-2-pyrrolidone | | | | | | | 4.5 | | | | |
| | | 2-Hydroxy ethyl acrylate | | | | | 18 | | 7.2 | 13.5 | 27 | | 27 |
| | | Acrylic acid | | 18 | 54 | 63 | 4.5 | 27 | 22.5 | 36 | 31.5 | 18 | 31.5 |
| | | Methacrylic acid | | | | | | | | | | | |
| | Other polymerizable unsaturated monomer(s) (d3) | | Methyl methacrylate | 18 | | | | | | 27 | 18 | | |
| | | | Ethyl acrylate | 54 | 36 | 27 | | | 55.8 | | | | |
| | | | Isobutyl methacrylate | | | | | | | | | | |
| Perbutyl O | | | | 0.15 | 0.15 | 0.15 | 0.15 | 0.15 | 0.15 | 0.15 | 0.15 | 0.15 | 0.15 |
| Proportion of macromonomer (d1) (parts by mass) | | | | 10 | 10 | 10 | 10 | 10 | 10 | 10 | 10 | 10 | 10 |
| Proportion of polymerizable unsaturated monomer (d2) having a hydroxy group (parts by mass) | | | | 18 | 54 | 63 | 90 | 90 | 34.2 | 63 | 72 | 90 | 90 |
| Proportion of other polymerizable unsaturated monomer(s) (d3) (parts by mass) | | | | 72 | 36 | 27 | 0 | 0 | 55.8 | 27 | 18 | 0 | 0 |
| Weight average molecular weight ($\times 10^4$) | | | | 31 | 30 | 30 | 31 | 31 | 30 | 25 | 25 | 20 | 31 |

| | | | | Production Example | | | | | | | | | |
|---|---|---|---|---|---|---|---|---|---|---|---|---|---|
| | | | | 75 | 76 | 77 | 78 | 79 | 80 | 81 | 82 | 83 | 84 |
| Copolymer diluted solution | | | | D-31 | D-32 | D-33 | D-34 | D-35 | D-36 | D-37 | D-38 | D-39 | D-40 |
| Monomer component (d) | Macromonomer (d1) solution | | Type | d1-2 | d1-3 | d1-3 | d1-3 | d1-14 | d1-3 | d1-3 | d1-3 | d1-3 | d1-3 |
| | | | Amount | 15.4 | 3.08 | 6.16 | 12.3 | 27.7 | 38.5 | 53.8 | 15.4 | 15.4 | 15.4 |
| | Polymerizable unsaturated monomer (d2) having a hydroxy group | N-substituted (meth)acrylamide | N,N-dimethyl acrylamide | 58.5 | | | | 28.7 | 26.3 | | 31.5 | 31.5 | 31.5 |
| | | | N-isopropyl acrylamide | | | | | 28.7 | 26.3 | | 31.5 | 31.5 | 31.5 |
| | | Polymerizable unsaturated monomer having a polyoxyalkylene chain | NK-ester Ad90G (See note 2.) | | | | | | | | | | |
| | | | PLEX 6954-0 (See note 3.) | | | | | | | | | | |
| | | N-Vinyl-2-pyrrolidone | | | | | | | | | | | |
| | | 2-Hydroxy ethyl acrylate | | 27 | | | | 24.6 | 22.5 | | 27 | 27 | 27 |
| | | Acrylic acid | | | 9.8 | 14.4 | 18.4 | | | 29.3 | | | |
| | | Methacrylic acid | | | | | | | | | | | |
| | Other polymerizable unsaturated monomer(s) (d3) | | Methyl methacrylate | 2.7 | | | | | | | | | |
| | | | Ethyl acrylate | | 88.2 | 81.6 | 73.6 | | | 35.8 | | | |
| | | | isobutyl methacrylate | 1.8 | | | | | | | | | |
| Perbutyl O | | | | 0.15 | | | | 0.15 | 0.15 | 0.15 | 2 | 0.5 | 0.12 |
| Proportion of macromonomer (d1) (parts by mass) | | | | 10 | 2 | 4 | 8 | 18 | 25 | 35 | 10 | 10 | 10 |
| Proportion of polymerizable unsaturated monomer (d2) having a hydroxy group (parts by mass) | | | | 85.5 | 9.8 | 14.4 | 18.4 | 82 | 75 | 29.3 | 90 | 90 | 90 |
| Proportion of other polymerizable unsaturated monomer(s) (d3) (parts by mass) | | | | 4.5 | 88.2 | 81.6 | 73.6 | 0 | 0 | 35.8 | 0 | 0 | 0 |
| Weight average molecular weight ($\times 10^4$) | | | | 31 | 24 | 24 | 24 | 23 | 20 | 20 | 8 | 12 | 38 |

TABLE 3-continued

| | | | | Production Example | | | | | |
|---|---|---|---|---|---|---|---|---|---|
| | | | | 85 | 86 | 87 | 88 | 89 | 90 |
| Copolymer diluted solution | | | | D-41 | D-42 | D-43 | D-44 | D-45 | D-46 |
| Monomer component (d) | Macromonomer (d1) solution | | Type | d1-3 | d1-15 | | d1-16 | d1-17 | |
| | | | Amount | 15.4 | 15.4 | | 15.4 | 15.4 | |
| | Polymerizable unsaturated monomer (d2) having a hydroxy group | N-substituted (meth)acrylamide | N,N-dimethyl acrylamide | 31.5 | 31.5 | 35 | 31.5 | 31.5 | |
| | | | N-isopropyl acrylamide | 31.5 | 31.5 | 35 | 31.5 | 31.5 | |
| | | Polymerizable unsaturated monomer having a polyoxyalkylene chain | NK-ester Ad90G (See note 2.) | | | | | | |
| | | | PLEX 6954-0 (See note 3.) | | | | | | 50 |
| | | N-Vinyl-2-pyrrolidone | | | | | | | |
| | | 2-Hydroxy ethyl acrylate | | 27 | 27 | 30 | 27 | 18 | |
| | | Acrylic acid | | | | | | | |
| | | Methacrylic acid | | | | | | | 20 |
| | Other polymerizable unsaturated monomer(s) (d3) | | Methyl methacrylate | | | | | | 30 |
| | | | Ethyl acrylate | | | | | | 10 |
| | | | Isobutyl methacrylate | | | | | | |
| Perbutyl O | | | | 0.1 | 0.15 | 0.15 | 0.15 | 0.15 | 0.15 |
| Proportion of macromonomer (d1) (parts by mass) | | | | 10 | 10 | 0 | 10 | 40 | 0 |
| Polymerizable unsaturated monomer (d2) having a hydroxy group (parts by mass) | | | | 90 | 90 | 100 | 90 | 60 | 60 |
| Proportion of other polymerizable unsaturated monomer(s) (d3) (parts by mass) | | | | 0 | 0 | 0 | 0 | 0 | 40 |
| Weight average molecular weight ($\times 10^4$) | | | | 42 | 31 | 31 | 28 | 26 | 31 |

Note 2: NK-ester AM-90G: name of product manufactured by Shin-Nakamura Chemical Co., Ltd.; a polymerizable unsaturated monomer having a polyoxyalkylene chain; in the General Formula (1), $R^1$ is a hydrogen atom, $R^2$ is methyl, $R^3$ is ethylene, and m is 9; the molecular weight is 454.
Note 3: PLEX 6954-0: name of product manufactured by Degussa; a mixture comprising 20% deionized water, 20% methacrylic acid, and 60% polymerizable unsaturated monomer having an alkyl group and a polyoxyalkylene chain (in the General Formula (1), $R^1$ is methyl, $R^2$ is $C_{16-18}$ alkyl, $R^3$ is ethylene, and m is 25; the molecular weight is about 1,422).

Production of Aluminium Pigment Dispersion

Production Example 91

In a stirring and mixing container, 19 parts (solids content: 14 parts) GX-180C (name of product manufactured by Asahi Kasei Metals, Ltd., aluminium pigment paste, aluminum content: 74%), 35 parts 2-ethyl-1-hexanol, 8 parts (solids content: 4 parts) of the phosphoric-acid-group-containing resin solution described below, and 0.2 parts 2-(dimethylamino) ethanol were uniformly mixed, thereby obtaining an aluminium pigment dispersion (P-1).

Phosphoric-acid-group-containing resin solution: a mixture solvent of 27.5 parts methoxypropanol and 27.5 parts isobutanol was placed in a reaction vessel equipped with a thermometer, a thermostat, a stirring device, a reflux condenser, a nitrogen gas introducing pipe, and a dropping funnel, and the mixture solvent was heated to 110° C. Subsequently, 121.5 parts of a mixture comprising 25 parts styrene, 27.5 parts n-butyl methacrylate, 20 parts Isostearyl Acrylate (name of product manufactured by Osaka Organic Chemical Industry, Ltd., branched higher alkyl acrylate), 7.5 parts 4-hydroxybutyl acrylate, 15 parts the phosphoric acid group-containing polymerizable monomer described below, 12.5 parts 2-methacryloyloxy ethyl acid phosphate, 10 parts isobutanol, and 4 parts t-butyl peroxyoctanoate was added to the mixture solvent for 4 hours. Further, a mixture comprising 0.5 parts t-butyl peroxyoctanoate and 20 parts isopropanol was added dropwise thereinto for 1 hour, followed by stirring for 1 hour for aging, thereby obtaining a phosphoric-acid-group-containing resin solution having a solids content concentration of 50%. The phosphoric-acid-group-containing resin had an acid value of 83 mg KOH/g, a hydroxy value of 29 mg KOH/g and a weight average molecular weight of 10,000.

Phosphoric acid group-containing polymerizable monomer: 57.5 parts monobutyl phosphate and 41 parts isobutanol were placed in a reaction vessel equipped with a thermometer, a thermostat, a stirring device, a reflux condenser, a nitrogen gas introducing pipe, and a dropping funnel. After the mixture was heated to 90° C., 42.5 parts glycidyl methacrylate was added dropwise thereinto for 2 hours, and further stirred for 1 hour for aging. Subsequently, 59 parts isopropanol was added thereto, thereby obtaining a phosphoric acid group-containing polymerizable monomer solution having a solids content concentration of 50%. The obtained monomer had an acid value of 285 mg KOH/g.

Production Example 32

An aluminium pigment dispersion (P-2) was obtained in the same manner as in Production Example 91, except that 35 parts ethylene glycol mono-n-butyl ether was used in place of 35 parts 2-ethyl-1-hexanol.

Production of Aqueous Second Colored Coating Composition (Y)

Production Example 93

The following were added to a stirring and mixing container: 100 parts (solids content: 30 parts) of the water-dispersible hydroxy-containing acrylic resin water dispersion (C1-3) obtained in Production Example 13, 18 parts (solids content: 10 parts) of the hydroxy-containing acrylic resin solution (AC-1) obtained in Production Example 5, 43 parts (solids content: 30 parts) of the hydroxy-containing polyester resin solution (C2-1) obtained in Production Example 25, 62 parts of the aluminium pigment dispersion (P-1) obtained in Production Example 91, and 50 parts (solids content: 30 parts) of the melamine resin (F-1) (methyl-butyl mixed etherified melamine resin; the solids content was 60%, the weight average molecular weight was 2,000); and the mixture was uniformly mixed. Further, 6 parts (solids content: 1.2 parts) of the copolymer diluted solution (D-1) obtained in Production Example 45, 2-(dimethylamino)ethanol, and deionized water were added to the mixture, thereby obtaining an aqueous second colored coating composition (Y-1) having a pH of 8.0 and a solids content of 25%.

Further, regarding the obtained aqueous second colored coating composition (Y-1), a viscosity $V_1$ at a shear rate of 1,000 $sec^{-1}$ and a viscosity $V_2$ at a shear rate of 0.1 $sec^{-1}$, when the shear rate was varied from 0.0001 $sec^{-1}$ to 10,000 $sec^{-1}$, were measured using a Haake RheoStress RS150 (name of product manufactured by Haake) viscoelasticity meter at a measurement temperature of 20° C.

Production Examples 94 to 155

Aqueous second colored coating compositions (Y-2) to (Y-63), which had a pH of 8.0 and a solids content of 25%, were obtained in the same manner as in Production Example 93, except that the formulation composition shown in Table 4 was used.

TABLE 4

| | | | Production Example | | | | | | | | | |
|---|---|---|---|---|---|---|---|---|---|---|---|---|
| | | | 93 | 94 | 95 | 96 | 97 | 98 | 99 | 100 | 101 | 102 |
| Aqueous coating composition | | | Y-1 | Y-2 | Y-3 | Y-4 | Y-5 | Y-6 | Y-7 | Y-8 | Y-9 | Y-10 |
| Copolymer (D) | Copolymer dilution | Type | D-1 | D-2 | D-3 | D-4 | D-5 | D-6 | D-7 | D-8 | D-9 | D-10 |
| | | Amount | 6 | 6 | 6 | 6 | 6 | 6 | 6 | 6 | 6 | 6 |
| Hydroxy-containing acrylic resin (C1) | Water-dispersible acrylic resin water dispersion | Type | C1-3 | C1-3 | C1-3 | C1-3 | C1-3 | C1-3 | C1-3 | C1-3 | C1-3 | C1-3 |
| | | Amount | 100 | 100 | 100 | 100 | 100 | 100 | 100 | 100 | 100 | 100 |
| Curing agent | Melamine resin (F-1) | | 50 | 50 | 50 | 50 | 50 | 50 | 50 | 50 | 50 | 50 |
| | Melamine resin (F-2) (See note 4.) | | | | | | | | | | | |
| | Bayhydur VPLS2310 (See note 5.) | | | | | | | | | | | |
| Polyester resin | Hydroxy-containing polyester resin solution | Type | C2-1 | C2-1 | C2-1 | C2-1 | C2-1 | C2-1 | C2-1 | C2-1 | C2-1 | C2-1 |
| | | Amount | 43 | 43 | 43 | 43 | 43 | 43 | 43 | 43 | 43 | 43 |
| Acrylic resin | Hydroxy-containing acrylic resin solution (AC-1) | | 18 | 18 | 18 | 18 | 18 | 18 | 18 | 18 | 18 | 18 |
| Aluminium pigment dispersion | | Type | P-1 | P-1 | P-1 | P-1 | P-1 | P-1 | P-1 | P-1 | P-1 | P-1 |
| | | Amount | 62 | 62 | 62 | 62 | 62 | 62 | 62 | 62 | 62 | 62 |
| Viscosity-controlling agent | ACRYSOL RM-825 (See note 6.) | | | | | | | | | | | |
| Viscosity $V_1$ at a shear rate of 1000 $sec^{-1}$ (Pa · sec) | | | 0.04 | 0.04 | 0.04 | 0.03 | 0.03 | 0.03 | 0.03 | 0.046 | 0.051 | 0.06 |
| Viscosity $V_2$ at a shear rate of 0.1 $sec^{-1}$ (Pa · sec) | | | 39 | 46 | 44 | 37 | 34 | 31 | 35 | 54 | 58 | 63 |
| $V_2/V_1$ | | | 975 | 1150 | 1100 | 1233 | 1133 | 1033 | 1167 | 1174 | 1137 | 1050 |

| | | | Production Example | | | | | | | | | |
|---|---|---|---|---|---|---|---|---|---|---|---|---|
| | | | 103 | 104 | 105 | 106 | 107 | 108 | 109 | 110 | 111 | 112 |
| Aqueous coating composition | | | Y-11 | Y-12 | Y-13 | Y-14 | Y-15 | Y-16 | Y-17 | Y-18 | Y-19 | Y-20 |
| Copolymer (D) | Copolymer diluted solution | Type | D-11 | D-12 | D-13 | D-14 | D-15 | D-16 | D-17 | D-18 | D-19 | D-20 |
| | | Amount | 6 | 6 | 6 | 6 | 6 | 6 | 6 | 6 | 6 | 6 |
| Hydroxy-containing acrylic resin (C1) | Water-dispersible acrylic resin water dispersion | Type | C1-3 | C1-3 | C1-3 | C1-3 | C1-3 | C1-3 | C1-3 | C1-3 | C1-3 | C1-3 |
| | | Amount | 100 | 100 | 100 | 100 | 100 | 100 | 100 | 100 | 100 | 100 |
| Curing agent | Melamine resin (F-1) | | 50 | 50 | 50 | 50 | 50 | 50 | 50 | 50 | 50 | 50 |
| | Melamine resin (F-2) (See note 4.) | | | | | | | | | | | |
| | Bayhydur VPLS2310 (See note 5.) | | | | | | | | | | | |

TABLE 4-continued

| | | | | | | | | | | | | |
|---|---|---|---|---|---|---|---|---|---|---|---|---|
| Polyester resin | Hydroxy-containing polyester resin solution | Type | C2-1 | C2-1 | C2-1 | C2-1 | C2-1 | C2-1 | C2-1 | C2-1 | C2-1 | C2-1 |
| | | Amount | 43 | 43 | 43 | 43 | 43 | 43 | 43 | 43 | 43 | 43 |
| Acrylic resin | Hydroxy-containing acrylic resin solution (AC-1) | | 18 | 18 | 18 | 18 | 18 | 18 | 18 | 18 | 18 | 18 |
| Aluminium pigment dispersion | | Type | P-1 | P-1 | P-1 | P-1 | P-1 | P-1 | P-1 | P-1 | P-1 | P-1 |
| | | Amount | 62 | 62 | 62 | 62 | 62 | 62 | 62 | 62 | 62 | 62 |
| Viscosity-controlling agent | ACRYSOL RM-825 (See note 6.) | | | | | | | | | | | |
| Viscosity $V_1$ at a shear rate of 1000 $sec^{-1}$(Pa · sec) | | | 0.06 | 0.06 | 0.06 | 0.04 | 0.04 | 0.04 | 0.05 | 0.06 | 0.05 | 0.05 |
| Viscosity $V_2$ at a shear rate of 0.1 $sec^{-1}$ (Pa · sec) | | | 49 | 49 | 48 | 44 | 41 | 31 | 48 | 44 | 47 | 46 |
| $V_2/V_1$ | | | 817 | 817 | 800 | 1100 | 1025 | 775 | 960 | 733 | 940 | 920 |

| | | | Production Example | | | | | | | | | |
|---|---|---|---|---|---|---|---|---|---|---|---|---|
| | | | 113 | 114 | 115 | 116 | 117 | 118 | 119 | 120 | 121 | 122 |
| Aqueous coating composition | | | Y-21 | Y-22 | Y-23 | Y-24 | Y-25 | Y-26 | Y-27 | Y-28 | Y-29 | Y-30 |
| Copolymer (D) | Copolymer diluted solution | Type | D-21 | D-22 | D-23 | D-24 | D-25 | D-26 | D-27 | D-28 | D-29 | D-30 |
| | | Amount | 6 | 6 | 6 | 6 | 6 | 6 | 6 | 6 | 6 | 6 |
| Hydroxy-containing acrylic resin (C1) | Water-dispersible acrylic resin water dispersion | Type | C1-3 | C1-3 | C1-3 | C1-3 | C1-3 | C1-3 | C1-3 | C1-3 | C1-3 | C1-4 |
| | | Amount | 100 | 100 | 100 | 100 | 100 | 100 | 100 | 100 | 100 | 100 |
| Curing agent | Melamine resin (F-1) | | 50 | 50 | 50 | 50 | | | 50 | 50 | 50 | 50 |
| | Melamine resin (F-2) (See note 4.) | | | | | | 38 | 38 | | | | |
| | Bayhydur VPLS2310 (See note 5.) | | | | | | | | | | | |
| Polyester resin | Hydroxy-containing polyester resin solution | Type | C2-1 | C2-1 | C2-1 | C2-1 | C2-1 | C2-1 | C2-1 | C2-1 | C2-1 | C2-1 |
| | | Amount | 43 | 43 | 43 | 43 | 43 | 43 | 43 | 43 | 43 | 43 |
| Acrylic resin | Hydroxy-containing acrylic resin solution (AC-1) | | 18 | 18 | 18 | 18 | 18 | 18 | 18 | 18 | 18 | 18 |
| Aluminium pigment dispersion | | Type | P-1 | P-1 | P-1 | P-1 | P-1 | P-1 | P-1 | P-1 | P-1 | P-1 |
| | | Amount | 62 | 62 | 62 | 62 | 62 | 62 | 62 | 62 | 62 | 62 |
| Viscosity-controlling agent | ACRYSOL RM-825 (See note 6.) | | | | | | | | | | | |
| Viscosity $V_1$ at a shear rate of 1000 $sec^{-1}$ (Pa · sec) | | | 0.04 | 0.06 | 0.07 | 0.04 | 0.05 | 0.05 | 0.05 | 0.06 | 0.06 | 0.04 |
| Viscosity $V_2$ at a shear rate of 0.1 $sec^{-1}$ (Pa · sec) | | | 31 | 44 | 42 | 43 | 49 | 47 | 45 | 48 | 45 | 49 |
| $V_2/V_1$ | | | 775 | 733 | 600 | 1075 | 980 | 940 | 900 | 800 | 750 | 1225 |

| | | | Production Example | | | | | | | | | |
|---|---|---|---|---|---|---|---|---|---|---|---|---|
| | | | 123 | 124 | 125 | 126 | 127 | 128 | 129 | 130 | 131 | 132 |
| Aqueous coating composition | | | Y-31 | Y-32 | Y-33 | Y-34 | Y-35 | Y-36 | Y-37 | Y-38 | Y-39 | Y-40 |
| Copolymer (D) | Copolymer diluted solution | Type | D-31 | D-32 | D-33 | D-34 | D-35 | D-36 | D-37 | D-38 | D-39 | D-40 |
| | | Amount | 6 | 6 | 6 | 6 | 6 | 6 | 6 | 6 | 6 | 6 |
| Hydroxy-containing acrylic resin (C1) | Water-dispersible acrylic resin water dispersion | Type | C1-4 | C1-3 | C1-3 | C1-3 | C1-3 | C1-3 | C1-3 | C1-3 | C1-3 | C1-3 |
| | | Amount | 100 | 100 | 100 | 100 | 100 | 100 | 100 | 100 | 100 | 100 |
| Curing agent | melamine resin (F-1) | | | 50 | 50 | 50 | 50 | 50 | 50 | 50 | 50 | 50 |
| | melamine resin (F-2) (See note 4.) | | 38 | | | | | | | | | |
| | Bayhydur VPLS2310 (See note 5.) | | | | | | | | | | | |

TABLE 4-continued

| | | | | | | | | | | | | |
|---|---|---|---|---|---|---|---|---|---|---|---|---|
| Polyester resin | Hydroxy-containing polyester resin solution | Type | C2-1 | C2-1 | C2-1 | C2-1 | C2-1 | C2-1 | C2-1 | C2-1 | C2-1 | C2-1 |
| | | Amount | 43 | 43 | 43 | 43 | 43 | 43 | 43 | 43 | 43 | 43 |
| Acrylic resin | Hydroxy-containing acrylic resin solution (AC-1) | | 18 | 18 | 18 | 18 | 18 | 18 | 18 | 18 | 18 | 18 |
| Aluminium pigment dispersion | | Type | P-1 | P-1 | P-1 | P-1 | P-1 | P-1 | P-1 | P-1 | P-1 | P-1 |
| | | Amount | 62 | 62 | 62 | 62 | 62 | 62 | 62 | 62 | 62 | 62 |
| Viscosity-controlling agent | ACRYSOL RM-825 (See note 6.) | | | | | | | | | | | |
| Viscosity $V_1$ at a shear rate of 1000 $sec^{-1}$ (Pa · sec) | | | 0.04 | 0.06 | 0.06 | 0.05 | 0.05 | 0.07 | 0.07 | 0.03 | 0.033 | 0.05 |
| Viscosity $V_2$ at a shear rate of 0.1 $sec^{-1}$ (Pa · sec) | | | 49 | 41 | 43 | 46 | 49 | 49 | 45 | 30 | 31 | 65 |
| $V_2/V_1$ | | | 1225 | 683 | 717 | 920 | 980 | 700 | 643 | 1000 | 939 | 1300 |

| | | | Production Example | | | | | | | | | |
|---|---|---|---|---|---|---|---|---|---|---|---|---|
| | | | 133 | 134 | 135 | 136 | 137 | 138 | 139 | 140 | 141 | 142 |
| Aqueous coating composition | | | Y-41 | Y-42 | Y-43 | Y-44 | Y-45 | Y-46 | Y-47 | Y-48 | Y-49 | Y-50 |
| Copolymer (D) | Copolymer diluted solution | Type | D-41 | D-3 | D-3 | D-3 | D-3 | D-3 | D-3 | D-3 | D-3 | D-3 |
| | | Amount | 6 | 6 | 6 | 6 | 6 | 6 | 6 | 6 | 6 | 6 |
| Hydroxy-containing resin (C1) | Water-dispersible acrylic resin water dispersion | Type | C1-3 | C1-1 | C1-2 | C1-4 | C1-5 | C1-6 | C1-7 | C1-8 | C1-9 | C1-10 |
| | | Amount | 100 | 100 | 100 | 100 | 100 | 117 | 100 | 100 | 100 | 100 |
| Curing agent | Melamine resin (F-1) | | 50 | 50 | 50 | 50 | 50 | 50 | 50 | 50 | 50 | 50 |
| | Melamine resin (F-2)(See note 4.) | | | | | | | | | | | |
| | Bayhydur VPLS2310 (See note 5.) | | | | | | | 13 | | | | |
| Polyester resin | Hydroxy-containing polyester resin solution | Type | C2-1 | C2-1 | C2-1 | C2-1 | C2-1 | C2-1 | C2-1 | C2-1 | C2-1 | C2-1 |
| | | Amount | 43 | 43 | 43 | 43 | 43 | 43 | 43 | 43 | 43 | 43 |
| Acrylic resin | Hydroxy-containing acrylic resin solution (AC-1) | | 18 | 18 | 18 | 18 | 18 | | 18 | 18 | 18 | 18 |
| Aluminium pigment dispersion | | Type | P-1 | P-1 | P-1 | P-1 | P-1 | P-1 | P-1 | P-1 | P-1 | P-1 |
| | | Amount | 62 | 62 | 62 | 62 | 62 | 62 | 62 | 62 | 62 | 62 |
| Viscosity-controlling agent | ACRYSOL RM-825 (See note 6.) | | | | | | | | | | | |
| Viscosity $V_1$ at a shear rate of 1000 $sec^{-1}$ (Pa · sec) | | | 0.06 | 0.05 | 0.05 | 0.05 | 0.06 | 0.05 | 0.06 | 0.05 | 0.07 | 0.04 |
| Viscosity $V_2$ at a shear rate of 0.1 $sec^{-1}$ (Pa · sec) | | | 66 | 38 | 41 | 45 | 48 | 45 | 55 | 44 | 42 | 43 |
| $V_2/V_1$ | | | 1100 | 760 | 820 | 900 | 800 | 900 | 917 | 880 | 600 | 1075 |

| | | | Production Example | | | | | | | | | |
|---|---|---|---|---|---|---|---|---|---|---|---|---|
| | | | 143 | 144 | 145 | 146 | 147 | 148 | 149 | 150 | 151 | 152 |
| Aqueous coating composition | | | Y-51 | Y-52 | Y-53 | Y-54 | Y-55 | Y-56 | Y-57 | Y-58 | Y-59 | Y-60 |
| Copolymer (D) | Copolymer diluted solution | Type | D-3 | D-3 | D-3 | D-3 | D-3 | D-3 | D-42 | D-43 | D-44 | D-45 |
| | | Amount | 6 | 6 | 6 | 6 | 6 | 6 | 6 | 6 | 6 | 6 |
| Hydroxy-containing acrylic resin (C1) | Water-dispersible acrylic resin water dispersion | Type | C1-11 | C1-12 | C1-13 | C1-14 | C1-3 | C1-3 | C1-3 | C1-3 | C1-3 | C1-3 |
| | | Amount | 100 | 100 | 100 | 100 | 100 | 100 | 100 | 100 | 100 | 100 |
| Curing agent | Melamine resin (F-1) | | 50 | 50 | 50 | 50 | 50 | 50 | 50 | 50 | 50 | 50 |
| | Melamine resin (F-2) (See note 4.) | | | | | | | | | | | |
| | Bayhydur VPLS2310 (See note 5.) | | | | | | | | | | | |

TABLE 4-continued

| | | | | | | | | | | | | |
|---|---|---|---|---|---|---|---|---|---|---|---|---|
| Polyester resin | Hydroxy-containing polyester resin solution | Type | C2-1 | C2-1 | C2-1 | C2-1 | C2-2 | C2-3 | C2-1 | C2-1 | C2-1 | C2-1 |
| | | Amount | 43 | 43 | 43 | 43 | 43 | 43 | 43 | 43 | 43 | 43 |
| Acrylic resin | Hydroxy-containing acrylic resin solution (AC-1) | | 18 | 18 | 18 | 18 | 18 | 18 | 18 | 18 | 18 | 18 |
| Aluminium pigment dispersion | | Type | P-1 | P-1 | P-1 | P-1 | P-1 | P-2 | P-1 | P-1 | P-1 | P-1 |
| | | Amount | 62 | 62 | 62 | 62 | 62 | 62 | 62 | 62 | 62 | 62 |
| Viscosity-controlling agent | ACRYSOL RM-825 (See note 6.) | | | | | | | | | | | |
| Viscosity $V_1$ at a shear rate of 1000 $sec^{-1}$ (Pa · sec) | | | 0.06 | 0.08 | 0.05 | 0.05 | 0.03 | 0.03 | 0.02 | 0.01 | 0.02 | 0.05 |
| Viscosity $V_2$ at a shear rate of 0.1 $sec^{-1}$ (Pa · sec) | | | 64 | 57 | 47 | 38 | 40 | 32 | 4 | 2 | 14 | 19 |
| $V_2/V_1$ | | | 1067 | 713 | 940 | 760 | 1333 | 1067 | 200 | 200 | 700 | 380 |

| | | | Production Example | | |
|---|---|---|---|---|---|
| | | | 153 | 154 | 155 |
| Aqueous coating composition | | | Y-61 | Y-62 | Y-63 |
| Copolymer (D) | Copolymer diluted solution | Type | D-46 | | |
| | | Amount | 6 | | |
| Hydroxy-containing acrylic resin (C1) | Water-dispersible acrylic resin water dispersion | Type | C1-3 | C1-3 | C1-3 |
| | | Amount | 100 | 100 | 100 |
| Curing agent | Melamine resin (F-1) | | 50 | 50 | 50 |
| | Melamine resin (F-2) (See note 4.) | | | | |
| | Bayhydur VPLS2310 (See note 5.) | | | | |
| Polyester resin | Hydroxy-containing polyester resin solution | Type | C2-1 | C2-1 | C2-1 |
| | | Amount | 43 | 43 | 43 |
| Acrylic resin | Hydroxy-containing acrylic resin solution (AC-1) | | 18 | 18 | 18 |
| Aluminium pigment dispersion | | Type | P-1 | P-1 | P-1 |
| | | Amount | 62 | 62 | 62 |
| Viscosity-controlling agent | ACRYSOL RM-825 (See note 6.) | | | 4.8 | |
| Viscosity $V_1$ at a shear rate of 1000 $sec^{-1}$ (Pa · sec) | | | 0.03 | 0.04 | 0.02 |
| Viscosity $V_2$ at a shear rate of 0.1 $sec^{-1}$ (Pa · sec) | | | 14 | 4 | 1 |
| $V_2/V_1$ | | | 467 | 100 | 50 |

Note 4: Melamine resin (F-2): methyl etherified melamine resin. The solids content is 80%, and the weight average molecular weight is 800.

Note 5: Bayhydur VP LS-231: name of product manufactured by Sumitomo Bayer Urethane Co. Ltd., blocked polyisocyanate compound. The solids content is 38%.

Note 6: ACRYSOL RM-825: name of product manufactured by Rohm and Haas Company, urethane-associated thickener. The solids content is 25%.

Preparation of Test Plate

The aqueous first colored coating compositions (X-1) to (X-3) obtained in Production Examples 8 to 10, and the aqueous second colored coating compositions (Y-1) to (Y-63) obtained in Production Examples 93 to 155 were used in the following manner to prepare test plates. Evaluation tests were then performed.

Preparation of Test Substrate to be Coated

A cationic electrodeposition coating composition (Electron GT-10, name of product produced by Kansai Paint Co., Ltd.) was applied to a cold-rolled steel plate treated with zinc phosphate by electrodeposition to a film thickness of 20 μm when cured, and cured by heating at 170° C. for 30 minutes, thereby preparing a test substrate to be coated.

Example 1

The aqueous first colored coating composition (X-1) obtained in Production Example 8 was electrostatically applied to the test substrate to a film thickness of 20 μm when cured using a rotary atomizing electrostatic coating machine, and then allowed to stand for 3 minutes. Next, the aqueous second colored coating composition (Y-1) obtained in Production Example 93 was electrostatically applied to the uncured colored coating film to a film thickness of 12 μm when cured using a rotary atomizing electrostatic coating machine, then allowed to stand for 2 minutes, and preheated at 80° C. for 3 minutes. Next, an acrylic resin solvent-based top clear coating composition (Magicron KINO-1210, name of product produced by Kansai Paint Co., Ltd.; hereinafter sometimes referred to as "clear coating composition (Z-1)") was electrostatically applied to the uncured second colored coating film to a film thickness of 35 μm when cured, then allowed to stand for 7 minutes, and heated at 140° C. for 30 minutes to simultaneously cure the first colored coating film, second colored coating film and clear coating film, thereby preparing a test plate.

Examples 2 to 57 and Comparative Examples 1 to 8

Test plates were prepared in the same manner as in Example 1, except that any one of the aqueous colored coating compositions (X-1) to (X-3) shown in Table 5 below was used in place of the aqueous first colored coating composition (X-1) obtained in Production Example 8, and any one of the aqueous second colored coating compositions (Y-1) to (Y-60), (Y-62), and (Y-63) shown in Table 5 below was used in place of the aqueous second colored coating composition (Y-1) obtained in Production Example 93.

Example 58

A test plate was obtained in the same manner as in Example 1 except that the aqueous first colored coating composition (X-1) obtained in Production Example 8 was applied, allowed to stand for 3 minutes, and preheated at 80° C. for 3 minutes, after which the aqueous second colored coating composition (Y-1) obtained in Production Example 93 was applied thereto.

Comparative Example 9

A test plate was obtained in the same manner as in Comparative Example 5 except that the aqueous first colored coating composition (X-1) obtained in Production Example 8 was applied, allowed to stand for 3 minutes, and preheated at 80° C. for 3 minutes, after which the aqueous second colored coating composition (Y-61) obtained in Production Example 153 was applied thereto.

Evaluation Test

The test plates obtained in Examples 1 to 58 and Comparative Examples 1 to 9 were evaluated according to the following test method. Table 5 shows the evaluation results.

Test Method

Smoothness: The smoothness of each test plate was evaluated based on the long wave (LW) values measured by using a Wave Scan (name of product produced by BYK Gardner). The smaller the LW value, the higher the smoothness of the coating surface.

Distinctness of image: Distinctness of image of each test plate was evaluated based on the short wave (SW) values measured by using the Wave Scan (name of product produced by BYK Gardner). The smaller the SW value, the higher the distinctness of image on the coating surface.

Flip-flop property: Each test plate was observed visually from various angles, and the flip-flop property was rated according to the following criteria:

S: Variation in brightness depending on the angle of viewing was significantly high (extremely excellent flip-flop property).

A: Variation in brightness depending on the angle of viewing was high (excellent flip-flop property).

B: Variation in brightness depending on the angle of viewing was slightly low (slightly poor flip-flop property).

C: Variation in brightness depending on the angle of viewing was low (poor flip-flop property).

Metallic mottling: Each test plate was visually observed, and the degree of occurrence of metallic mottling was evaluated according to the following criteria:

S: Substantially no metallic mottling was observed, and the coating film had an extremely excellent appearance.

A: A small amount of metallic mottling was observed, but the coated film had an excellent appearance.

B: Metallic mottling was observed, and the coating film had a slightly poor appearance.

C: A considerable amount of metallic mottling was observed, and the coating film had a poor appearance.

Water resistance: The test plates were immersed in water at 40° C. for 240 hours, removed, and dried at 20° C. for 12 hours. Subsequently, cross-cuts reaching the substrate were made in the multilayer coating film on the test plate by using a utility knife to form a grid of 100 squares (2 mm×2 mm). Afterwards, adhesive cellophane tape was applied to the surface of the grid portion and abruptly peeled off at 20° C. The condition of the remaining coating film squares was then checked. The water resistance was rated according to the following criteria:

S: 100 squares remained, and no small edge chipping of the coating film occurred at the edge of the cut made with the utility knife.

A: 100 squares remained, but small edge chipping of the coating film occurred at the edge of the cut made with the utility knife.

B: 90 to 99 squares remained.

C: The number of remaining squares was 89 or less.

Comprehensive Evaluation

For coating vehicles and the like in the field to which the present invention pertains, the smoothness, distinctness of image, flip-flop property, water resistance, and inhibition of metallic mottling are all expected to be excellent. Accordingly, comprehensive evaluation was conducted according to the following criteria:

S: The smoothness ((LW) value) was 10 or lower, the distinctness of image ((SW) value) was 15 or lower, and the flip-flop property, metallic mottling, and water resistance were all S.

A: The LW value was 10 or lower, the SW value was 15 or lower, and the flip-flop property, metallic mottling, and water resistance were each either S or A, with at least one of them being A.

B: The LW value was 10 or lower, the SW value was 15 or lower, and the flip-flop property, metallic mottling, and water resistance were each S, A or B, with at least one of them being B.

C: The LW value exceeded 10, the SW value exceeded 15, or at least one of the flip-flop property, metallic mottling, and water resistance was C.

TABLE 5

| | | Aqueous first colored coating composition | Aqueous second colored coating composition | Smoothness | Distinctness of image | Luster: Flip-flop property | Luster: Metallic mottling | Water resistance | Comprehensive evaluation |
|---|---|---|---|---|---|---|---|---|---|
| Example | 1 | X-1 | Y-1 | 7 | 12 | S | S | S | S |
| | 2 | X-1 | Y-2 | 8 | 12 | S | S | S | S |
| | 3 | X-1 | Y-3 | 7 | 11 | S | S | S | S |
| | 4 | X-1 | Y-4 | 7 | 12 | S | S | S | S |
| | 5 | X-1 | Y-5 | 7 | 12 | S | S | S | S |
| | 6 | X-1 | Y-6 | 7 | 13 | S | S | S | S |
| | 7 | X-1 | Y-7 | 7 | 12 | S | S | S | S |
| | 8 | X-1 | Y-8 | 7 | 13 | S | S | S | S |
| | 9 | X-1 | Y-9 | 8 | 12 | S | S | S | S |
| | 10 | X-1 | Y-10 | 8 | 12 | S | S | S | S |
| | 11 | X-1 | Y-11 | 8 | 12 | A | S | A | A |
| | 12 | X-1 | Y-12 | 9 | 13 | A | S | S | A |
| | 13 | X-1 | Y-13 | 8 | 13 | A | S | S | A |
| | 14 | X-1 | Y-14 | 7 | 12 | S | A | S | A |
| | 15 | X-1 | Y-15 | 8 | 12 | S | A | S | A |
| | 16 | X-1 | Y-16 | 8 | 14 | A | A | S | A |
| | 17 | X-1 | Y-17 | 7 | 13 | S | S | S | S |
| | 18 | X-1 | Y-18 | 9 | 13 | A | S | S | A |
| | 19 | X-1 | Y-19 | 8 | 12 | S | S | S | S |
| | 20 | X-1 | Y-20 | 8 | 13 | S | S | S | S |
| | 21 | X-1 | Y-21 | 9 | 13 | A | S | S | A |
| | 22 | X-1 | Y-22 | 9 | 13 | A | S | S | A |
| | 23 | X-1 | Y-23 | 9 | 14 | A | S | S | A |
| | 24 | X-1 | Y-24 | 7 | 13 | S | S | S | S |
| | 25 | X-1 | Y-25 | 8 | 13 | S | S | A | A |
| | 26 | X-1 | Y-26 | 8 | 13 | S | S | S | S |
| | 27 | X-1 | Y-27 | 9 | 12 | S | S | S | S |
| | 28 | X-1 | Y-28 | 8 | 12 | S | S | S | S |
| | 29 | X-1 | Y-29 | 8 | 12 | A | S | S | A |
| | 30 | X-1 | Y-30 | 7 | 12 | S | S | S | S |
| | 31 | X-1 | Y-31 | 7 | 12 | S | S | A | A |
| | 32 | X-1 | Y-32 | 9 | 14 | A | A | A | A |
| | 33 | X-1 | Y-33 | 8 | 13 | A | A | A | A |
| | 34 | X-1 | Y-34 | 8 | 12 | S | S | A | A |
| | 35 | X-1 | Y-35 | 9 | 13 | S | S | S | S |
| | 36 | X-1 | Y-36 | 9 | 14 | A | S | S | A |
| | 37 | X-1 | Y-37 | 9 | 14 | A | S | A | A |
| | 38 | X-1 | Y-38 | 7 | 13 | A | A | S | A |
| | 39 | X-1 | Y-39 | 6 | 12 | S | S | S | S |
| | 40 | X-1 | Y-40 | 8 | 12 | S | A | S | A |
| | 41 | X-1 | Y-41 | 8 | 12 | A | A | S | A |
| | 42 | X-1 | Y-42 | 8 | 13 | A | A | A | A |
| | 43 | X-1 | Y-43 | 9 | 12 | A | S | A | A |
| | 44 | X-1 | Y-44 | 9 | 12 | S | A | S | A |
| | 45 | X-1 | Y-45 | 8 | 12 | S | A | A | A |
| | 46 | X-1 | Y-46 | 8 | 12 | S | A | S | A |
| | 47 | X-1 | Y-47 | 8 | 13 | S | A | S | A |
| | 48 | X-1 | Y-48 | 9 | 13 | S | S | A | A |
| | 49 | X-1 | Y-49 | 9 | 12 | A | A | A | A |
| | 50 | X-1 | Y-50 | 7 | 12 | S | A | S | A |
| | 51 | X-1 | Y-51 | 9 | 14 | A | S | A | A |
| | 52 | X-1 | Y-52 | 9 | 13 | A | A | A | A |
| | 53 | X-1 | Y-53 | 8 | 12 | S | A | A | A |
| | 54 | X-1 | Y-54 | 7 | 14 | A | A | A | A |
| | 55 | X-1 | Y-55 | 6 | 13 | S | S | A | A |
| | 56 | X-1 | Y-56 | 6 | 14 | A | A | S | A |
| | 57 | X-2 | Y-3 | 9 | 14 | A | A | A | A |
| | 58 | X-1 | Y-3 | 6 | 10 | S | S | S | S |
| Comparative Example | 1 | X-1 | Y-57 | 27 | 29 | C | C | S | C |
| | 2 | X-1 | Y-58 | 28 | 30 | C | C | S | C |
| | 3 | X-1 | Y-59 | 24 | 21 | C | C | S | C |
| | 4 | X-1 | Y-60 | 25 | 21 | C | C | S | C |
| | 5 | X-1 | Y-61 | 19 | 20 | B | B | S | C |

TABLE 5-continued

| | Aqueous first colored coating composition | Aqueous second colored coating composition | Smoothness | Distinctness of image | Luster: Flip-flop property | Luster: Metallic mottling | Water resistance | Comprehensive evaluation |
|---|---|---|---|---|---|---|---|---|
| 6 | X-1 | Y-62 | 28 | 29 | C | C | S | C |
| 7 | X-1 | Y-63 | 29 | 32 | C | C | S | C |
| 8 | X-3 | Y-3 | 10 | 20 | A | B | B | C |
| 9 | X-1 | Y-61 | 17 | 17 | B | B | S | C |

The invention claimed is:

1. A method for forming a multilayer coating film by sequentially performing the following steps (1) to (4):

(1) applying an aqueous first colored coating composition (X) comprising a film-forming resin (A) and a pigment (B) to a substrate to form an uncured first colored coating film, the film-forming resin (A) comprising a hydroxy-containing polyester resin (A1), the hydroxy-containing polyester resin (A1) having an acid value of 30 mg KOH/g or less;

(2) applying an aqueous second colored coating composition (Y) comprising a film-forming resin (C) and a copolymer (D) to the uncured colored coating film obtained in step (1) to form an uncured second colored coating film, the copolymer (D) being obtainable by copolymerizing monomer component (d) comprising a macromonomer (dl) and a polymerizable unsaturated monomer (d2), the macromonomer (dl) having a polymerizable unsaturated group and a backbone that comprises a polymer chain having a number average molecular weight of 1,000 to 10,000, the macromonomer (d1) being obtainable by polymerizing monomer component (m) comprising 5 to 100 mass % of a polymerizable unsaturated monomer (m1), the polymerizable unsaturated monomer (m1) containing a $C_{4-24}$ alkyl group, and the polymerizable unsaturated monomer (d2) having a hydrophilic group;

(3) applying a clear coating composition (Z) to the uncured second colored coating film obtained in step (2) to form an uncured clear coating film; and (4) heating the uncured first colored coating film, the uncured second colored coating film, and the uncured clear coating film formed respectively in steps (1) to (3) for 10 to 60 minutes at 80° to 180° C. to simultaneously cure these three coating films, wherein the clear coating composition (Z) is an organic-solvent-type thermosetting coating composition which contains a curing agent and a base resin having a crosslinkable functional group, an aqueous thermosetting coating composition which contains a curing agent and a base resin having a crosslinkable functional group, or a powder thermosetting coating composition which contains a curing agent and a base resin having a crosslinkable functional group.

2. The method for forming a multilayer coating film according to claim 1, wherein the aqueous first colored coating composition (X) further comprises a water-dispersible hydroxy-containing acrylic resin (A2) having an acid value of 30 mg KOH/g or less as the film-forming resin (A).

3. The method for forming a multilayer coating film according to claim 1, wherein the aqueous first colored coating composition (X) further comprises a hydroxy-containing polyurethane resin (A3) as the film-forming resin (A).

4. The method for forming a multilayer coating film according to claim 1, wherein the film-forming resin (C) is a water-dispersible hydroxy-containing acrylic resin (C1) having an acid value of 1 to 100 mg KOH/g and a hydroxy value of 1 to 100 mg KOH/g, the film-forming resin (C) being obtainable by copolymerization of monomer component (c1) comprising 5 to 70 mass % of a hydrophobic polymerizable unsaturated monomer (c1-1), 0.1 to 25 mass % of a hydroxy-containing polymerizable unsaturated monomer (c1-2), 0.1 to 20 mass % of a carboxy-containing polymerizable unsaturated monomer (c1-3), and 0 to 94.8 mass % of a polymerizable unsaturated monomer (c1-4) other than the polymerizable unsaturated monomers (c1-1) to (c1-3).

5. The method for forming a multilayer coating film according to claim 1, wherein the film-forming resin (C) is a core-shell-type water-dispersible hydroxy-containing acrylic resin (C1'), which has a core-shell structure having, as a core portion, a copolymer (C1'-I) produced with monomer components comprising 0.1 to 30 mass % of a polymerizable unsaturated monomer having two or more polymerizable unsaturated groups per molecule and 70 to 99.9 mass % of a polymerizable unsaturated monomer having one polymerizable unsaturated group per molecule, based on the total mass of the monomer components constituting the core portion, and wherein the core-shell-type water-dispersible hydroxy-containing acrylic resin (C1') is produced with monomer components comprising 5 to 70 mass % of a hydrophobic polymerizable unsaturated monomer (c1-1), 0.1 to 25 mass % of a hydroxy-containing polymerizable unsaturated monomer (c1-2), 0.1 to 20 mass % of a carboxy-containing polymerizable unsaturated monomer (c1-3), and 0 to 94.8 mass % of a polymerizable unsaturated monomer (c1-4) other than the polymerizable unsaturated monomers (c1-1) to (c1-3), based on the total mass of the monomer components constituting the core and shell portions.

6. The method for forming a multilayer coating film according to claim 1, wherein the monomer component (m) comprises, at least as a part thereof, 5 to 60 mass % of a hydroxy-containing polymerizable unsaturated monomer (m2), based on the total mass of the monomer component (m).

7. The method for forming a multilayer coating film according to claim 1, wherein component (d2) is at least one polymerizable unsaturated monomer selected from the group consisting of N-substituted (meth)acrylamide, polymerizable unsaturated monomer having a polyoxyalkylene chain, N-vinyl-2-pyrrolidone, 2-hydroxyethyl acrylate, acrylic acid, and methacrylic acid.

8. The method for forming a multilayer coating film according to claim 1, wherein the monomer component (d) comprises 1 to 40 mass % of component (d1) and 5 to 99 mass % of component (d2), based on the total mass of the monomer component (d).

9. An article having a coating film formed by the method for forming a multilayer coating film of claim 1.

* * * * *